US008057030B2

(12) United States Patent
Hamano

(10) Patent No.: US 8,057,030 B2
(45) Date of Patent: Nov. 15, 2011

(54) INK SUPPLYING SYSTEM FOR INK JET PRINTER, INK SUPPLYING METHOD FOR INK JET PRINTER, AND INK JET PRINTER

(75) Inventor: Yuichiro Hamano, Chiba (JP)

(73) Assignee: Seiko I Infotech Inc. (JP)

( * ) Notice: Subject to any disclaimer, the term of this patent is extended or adjusted under 35 U.S.C. 154(b) by 325 days.

(21) Appl. No.: 12/322,697

(22) Filed: Feb. 5, 2009

(65) Prior Publication Data

US 2009/0201347 A1 Aug. 13, 2009

(30) Foreign Application Priority Data

Feb. 6, 2008 (JP) ..... 2008-026703

(51) Int. Cl.
*B41J 2/19* (2006.01)

(52) U.S. Cl. ..... 347/92; 347/85

(58) Field of Classification Search ..... 347/6, 7, 347/85, 86, 87, 92
See application file for complete search history.

(56) References Cited

U.S. PATENT DOCUMENTS 5,584,416 A * 12/1996 Florian ..... 222/1
7,490,926 B2 * 2/2009 Matsuba et al. ..... 347/84
2003/0007049 A1 * 1/2003 Hino ..... 347/92
2003/0227520 A1 * 12/2003 Yamanaka et al. ..... 347/85
2005/0062815 A1 3/2005 Yoshihira et al. ..... 347/89

FOREIGN PATENT DOCUMENTS

EP 1598192 11/2005
EP 1714788 10/2006

* cited by examiner

*Primary Examiner* — Julian Huffman
*Assistant Examiner* — Sharon A Polk
(74) *Attorney, Agent, or Firm* — Adams & Wilks

(57) ABSTRACT

An ink supplying system has a first pipe having one end that connects to a main ink tank storing ink containing no air and another end that removably connects to a primary auxiliary ink tank that receives ink from the main ink tank. A second pipe has one end that removably connects to the primary auxiliary ink tank. An ink jet head is connected to another end of the second pipe for performing printing by ejecting ink on a printing medium. A secondary auxiliary ink tank has a capacity smaller than that of the primary auxiliary ink tank and is selectively exchangeable with the primary auxiliary ink tank for removing air in the ink supplying system prior to printing by the ink jet head. The secondary auxiliary ink tank has a connection pipe that removably connects to the another end of the first pipe and to the one end of the second pipe in fluid communication therewith. The connection pipe has the same sectional area as that of the first and second pipes.

17 Claims, 39 Drawing Sheets

INK SUPPLYING SYSTEM FOR INK JET PRINTER, INK SUPPLYING METHOD FOR INK JET PRINTER, AND INK JET PRINTER

BACKGROUND OF THE INVENTION

1. Technical Field

The present invention relates to an ink supplying system for an ink jet printer, an ink supplying method for an ink jet printer, and an ink jet printer.

2. Background Art

In a conventional ink jet printer, an intermediate ink storing bag (auxiliary tank) is used in an ink passage that connects an ink cartridge (main tank) that stores ink and an ink jet head that ejects the ink and performs recording on a recording medium. This intermediate ink storing bag is provided in order to continue printing with the ink jet head even at the time of replacement of the ink cartridge. The intermediate ink storing bag is made of a flexible bag in order to store a predetermined volume of ink. At the top of the intermediate ink storing bag, for degassing at the time when the ink is filled or replaced, a tube that is arranged upward and has an on-off valve is provided (see, for example, Patent Document JP 2004-203056 A).

During ink filling in starting the ink jet printer, the ink is supplied from the ink cartridge to the ink jet head through the ink passage and via the intermediate ink storing bag. When the ink is supplied, because the intermediate ink storing bag is made of the flexible bag, the air tends to be accumulated in the inside thereof. Therefore, the air accumulated in the intermediate ink storing bag is exhausted by the on-off valve provided at the top.

However, in the conventional ink jet printer, the tube and the on-off valve as mechanisms for removing the air are attached even during normal use, and hence the ink jet printer is increase in size and complicated. The air removing by the tube provided in the upper part of the intermediate ink storing bag is extremely difficult because the on-off valve is adjusted while states of the air and the ink discharged to the tube are observed.

The present invention is made in view of the above-mentioned problems, and the object of the present invention is to provide an ink supplying system for an ink jet printer, an ink supplying method for an ink jet printer, and an ink jet printer with which ink supply work in starting to use the ink jet printer is easy and that can be reduced in size.

SUMMARY OF THE INVENTION

In order to solve the above-mentioned problems, the present invention proposes means described below.

An ink supplying system for an ink jet printer according to the present invention includes: a first pipe having one end which is connected to a main tank in which ink is stored with air therein being eliminated; a second pipe having one end which is connected to an auxiliary tank connected to another end of the first pipe with air therein being eliminated; and an ink jet head that is connected to another end of the second pipe, ejects the ink, and performs printing on a printing medium, in which the another end of the first pipe and the one end of the second pipe can be at least connected to or separated from the auxiliary tank or an auxiliary connecting means that is used in replacement of the auxiliary tank and has a capacity smaller than that of the auxiliary tank, and, a detachable unit that connects or separates, in connecting or separating the another end of the first pipe or the one end of the second pipe, the another end or the one end without allowing the air to flow into the auxiliary tank or the auxiliary connecting means is provided.

According to the present invention, it is possible to replace the auxiliary tank connected to the another end of the first pipe and the one end of the second pipe with the auxiliary connecting means and use the auxiliary connecting means.

Further the internal volume of the auxiliary connecting means is smaller than that of the auxiliary tank, and hence it is possible to easily fill the ink into the auxiliary connecting means. In a state in which the auxiliary connecting means is connected to the another end of the first pipe and the one end of the second pipe, if the ink stored in the main tank is led from the first pipe, it is possible to fill the ink while preventing the air from entering the first pipe, the auxiliary connecting means, the second pipe, and the ink jet head.

Further, the auxiliary connecting means is replaced with the auxiliary tank, from which the air is eliminated, by making use of the detachable unit, and the ink stored in the main tank is filled into the auxiliary tank, from which the air is eliminated. Consequently, the main tank, the first pipe, the auxiliary tank, the second pipe, and the ink jet head can be filled with the ink.

Therefore, the removing of bubbles contained in the ink, which was conventionally performed by the on-off valve provided to the tube provided in the auxiliary tank is unnecessary. Therefore, ink supply work in starting to use the ink supplying system of the ink jet printer can be facilitated.

Further, the tube and the on-off valve provided in the conventional auxiliary tank are unnecessary. Moreover, the auxiliary connecting means as a component used for removing the air in the ink supplying system is removed during the normal use. Therefore, the configuration of the entire ink supplying system of the ink jet printer can be reduced in size and simplified.

Further, it is preferable that the auxiliary connecting means have a connection pipe that directly connects a connecting section with the another end of the first pipe and a connecting section with the one end of the second pipe, and detachable mechanisms that can perform connection and separation without allowing the air to flow into the auxiliary tank or the auxiliary connecting means be provided in a connecting section of each of the another end of the first pipe and the one end of the second pipe and the auxiliary tank and a connecting section of each of the another end of the first pipe and the one end of the second pipe and the auxiliary connecting means.

According to the present invention, the connection pipe in the auxiliary connecting means is configured to directly connect the two connecting sections, and hence the air in the pipe tends to leak when the ink is filled. Therefore, in a state in which the auxiliary connecting means is connected to the another end of the first pipe and the one end of the second pipe, if the ink stored in the main tank is led from the first pipe, the ink can be filled into the first pipe, the connection pipe, the second pipe, and the ink jet head without letting the air into the same.

Further, the auxiliary connecting means is replaced with the auxiliary tank, from which the air is eliminated, by using the detachable mechanism without allowing the air to flow into the auxiliary tank. The ink stored in the main tank is filled into the auxiliary tank, from which the air is eliminated. Consequently, the main tank, the first pipe, the auxiliary tank, the second pipe, and the ink jet head can be filled with the ink without letting the air into the same.

Therefore, the removing of bubbles contained in the ink, which was conventionally performed by the on-off valve provided to the tube provided in the auxiliary tank is unnecessary. Therefore, ink supply work in starting to use the ink supplying system of the ink jet printer can be facilitated.

Further, the tube and the on-off valve provided in the conventional auxiliary tank are unnecessary. Moreover, the auxiliary connecting means as a component used for removing the air in the ink supplying system is removed during the normal use. Therefore, the configuration of the entire ink supplying system of the ink jet printer can be reduced in size and simplified.

Further, it is preferable that the auxiliary tank be filled with the ink with the air therein being eliminated.

According to the present invention, the auxiliary tank is filled with the ink with the air therein being eliminated. Therefore, in the ink supply work in starting to use the ink supplying system of the ink jet printer, a process for filling the ink stored in the main tank into the auxiliary tank is unnecessary. Therefore, the ink supply work can be performed in short time.

Further, it is preferable that an ink supplying system for an ink jet printer described above and a suction pump that sucks the ink from the ink jet head side be provided.

According to the present invention, the ink stored in the main tank can be automatically filled into the first pipe, the auxiliary connecting means, the second pipe, and the ink jet head with the suction pump. Therefore, the ink supply work can be more easily performed in starting to use the ink jet printer.

Further, the tube and the on-off valve provided in the conventional auxiliary tank are unnecessary. Moreover, the auxiliary connecting means as a component used for removing the air in the ink supplying system is removed during the normal use. Therefore, the configuration of the entire ink jet printer can be reduced in size and simplified.

Further, according to the present invention, there is provided an ink supplying method for an ink jet printer that uses an ink supplying system for an ink jet printer described above, the ink supplying method including: an auxiliary connecting means and main tank connecting step of connecting the auxiliary connecting means to each of the another end of the first pipe and the one end of the second pipe and connecting a main tank to the one end of the first pipe; an ink filling step of filling the ink stored in the main tank, into the first pipe, the auxiliary connecting means, the second pipe, and the ink jet head; a vacuum auxiliary connecting step of releasing connection between each of the another end of the first pipe and the one end of the second pipe and the auxiliary connecting means, and connecting the auxiliary tank to each of the another end of the first pipe and the one end of the second pipe, and a vacuum auxiliary tank filling step of filling the auxiliary tank with the ink stored in the main tank.

In the present invention, in starting to use the inkjet printer, first, in the auxiliary connecting means, and main tank connection step, the another end of the first pipe and the one end of the second pipe are connected to the auxiliary connecting means, and the main tank filled with the ink with the air therein being eliminated is connected to the one end of the first pipe. The internal volume of the auxiliary connecting means is smaller than that of the auxiliary tank, and hence the ink can be easily filled in the auxiliary connecting means. Therefore, when the ink stored in the main tank is filled in the next ink filling step, the air in the first pipe, the auxiliary connecting means, the second pipe, and the ink jet head are pushed out in this order. Therefore, it is possible to fill the ink while preventing the air from entering the first pipe, the auxiliary connecting means, the second pipe, and the ink jet head.

Next, in the vacuum auxiliary tank connecting step, the connection between each of the another end of the first pipe and the one end of the second pipe and the auxiliary connecting means by the detachable unit is released, and each of the another end of the first pipe and the one end of the second pipe and the auxiliary tank, from which the air is eliminated, are connected by the detachable unit. Finally, in the vacuum auxiliary tank filling step, the ink stored in the main tank is supplied into the auxiliary tank.

The detachable unit can be connected to or separated from the auxiliary tank or the auxiliary connecting means without allowing the air to flow into the auxiliary tank or the auxiliary connecting means. Therefore, it is possible to fill the ink and prepare for printing while preventing the air from entering the first pipe, the auxiliary tank, the second pipe, and the ink jet head from the main tank. Therefore, the removing of bubbles contained in the ink, which was conventionally performed by the on-off valve provided to the tube provided in the auxiliary tank is unnecessary. Therefore, the ink supply work in starting to use the ink supplying system of the ink jet printer can be facilitated.

Further, the tube and the on-off valve provided in the conventional auxiliary tank are unnecessary. Therefore, the configuration of the entire ink supplying system of the ink jet printer can be reduced in size and simplified.

Further, according to the present invention, there is provided an ink supplying method for an ink jet printer that uses an ink supplying system for an ink jet printer described above, the ink supplying method including: an auxiliary connecting means and main tank connecting step of connecting the auxiliary connecting means to each of the another end of the first pipe and the one end of the second pipe and connecting the main tank to the one end of the first pipe; an ink filling step of filling the ink stored in the main tank, into the first pipe, the auxiliary connecting means, the second pipe, and the ink jet head; and a filled auxiliary tank connecting step of releasing connection between each of the another end of the first pipe and the one end of the second pipe and the auxiliary connecting means and connecting the auxiliary tank filled with the ink, with the air therein being eliminated, to the another end of the first pipe and the one end of the second pipe.

In the present invention, in starting to use the inkjet printer, first, in the auxiliary connecting means, and main tank connection step, the another end of the first pipe and the one end of the second pipe are connected to the auxiliary connecting means, and the main tank filled with the ink with the air therein being eliminated is connected to the one end of the first pipe. The internal volume of the auxiliary connecting means is smaller than that of the auxiliary tank, and hence the ink can be easily filled in the auxiliary connecting means. Therefore, when the ink stored in the main tank is filled in the next ink filling step, the air in the first pipe, the auxiliary connecting means, the second pipe, and the ink jet head are pushed out in this order. Therefore, it is possible to fill the ink while preventing the air from entering the first pipe, the auxiliary connecting means, the second pipe, and the ink jet head.

Next, in the filled auxiliary tank connecting step, the connection between each of the another end of the first pipe and the one end of the second pipe and the auxiliary connecting means by the detachable unit is released, and each of the another end of the first pipe and the one end of the second pipe and the auxiliary tank, from which the air is eliminated and which is filled with the air, are connected by the detachable unit. Finally, in the vacuum auxiliary tank filling step, the ink stored in the main tank is supplied into the auxiliary tank.

The detachable unit can be connected to or separated from the auxiliary tank or the auxiliary connecting means without allowing the air to flow into the auxiliary tank or the auxiliary connecting means. Therefore, it is possible to fill the ink and prepare for printing while preventing the air from entering the first pipe, the auxiliary tank, the second pipe, and the ink jet head from the main tank. Therefore, the ink supply work in starting to use the ink supplying system of the ink jet printer can be facilitated.

Since the auxiliary tank filled with the ink with the air therein being eliminated is used, the ink jet printer can be used without filling the ink into the auxiliary tank in a later step.

Further, the tube and the on-off valve provided in the conventional auxiliary tank are unnecessary. Therefore, the configuration of the entire ink supplying system of the ink jet printer can be reduced in size and simplified.

Further, according to the present invention, there is provided an ink supplying method for an ink jet printer including: a first pipe having one end which is connected to a first main tank in which first ink is stored with air therein being eliminated; a second pipe having one end which is connected to a first auxiliary tank filled with the first ink with air therein being eliminated and connected to another end of the first pipe; an air lead-in valve that is provided in the second pipe and switches lead-in and blocking of the air into the second pipe; and an ink jet head that is connected to the another end of the second pipe and ejects the first ink, the ink jet printer performing printing on a printing medium with the first ink ejected from the ink jet head, the ink supplying method, including: a first auxiliary connecting means connecting step of releasing connection between each of the another end of the first pipe and the one end of the second pipe and the first auxiliary tank, and connecting the another end of the first pipe and the one end of the second pipe to a first auxiliary connecting means having a connection pipe that directly connects a connecting section with the another end of the first pipe and a connecting section with the one end of the second pipe; a first ink main tank storing step of leading the air into at least the second pipe from the air lead-in valve; a first and second auxiliary connecting means replacing step of releasing connection between each of the another end of the first pipe and the one end of the second pipe and the first auxiliary connecting means, and connecting the another end of the first pipe and the one end of the second pipe to a second auxiliary connecting means having a connection pipe that directly connects the connecting section with the another end of the first pipe and the connecting section with the one end of the second pipe; a first and second main tanks replacing step of releasing connection between the one end of the first pipe and the first main tank, and connecting the one end of the first pipe and a second main tank in which second ink is stored with air therein being eliminated; a second ink filling step of filling the second ink stored in the second main tank into the first pipe, the connection pipe of the second auxiliary connecting means, the second pipe, and the ink jet head; and a second auxiliary tank connecting step of releasing connection between each of the another end of the first pipe and the one end of the second pipe and the second auxiliary connecting means without allowing the air to flow into the first pipe, the second pipe, and the second auxiliary connecting means, and connecting the another end of the first pipe and the one end of the second pipe to a second auxiliary tank, which is filled with the second ink with air therein being eliminated, without allowing the air to flow into the first pipe, the second pipe, and the second auxiliary tank.

Before a type of the ink ejected from the ink jet head is changed, the first pipe, the second pipe, and the ink jet head are filled with the first ink.

According to the present invention, in changing a type of the ink ejected from the ink jet head, first, in the first auxiliary connecting means connecting step, the connection between each of the another end of the first pipe and the one end of the second pipe and the first auxiliary tank is released, and the another end of the first pipe and one end of the second pipe are connected to the first auxiliary connecting means. The connection pipe in the first auxiliary connecting means is configured to directly connect the two connecting sections, and hence the air in the first ink in the connection pipe tends to leak. Therefore, next, in the first ink main tank storing step, at least a part of the first ink in the second pipe can be stored in the first main tank by leading the air into at least the second pipe from the air lead-in valve.

Next, in the first and second auxiliary connecting means replacing step, the connection between each of the another end of the first pipe and the one end of the second pipe and the first auxiliary connecting means is released and the another end of the first pipe and the one end of the second pipe are connected to the second auxiliary connecting means. In the first and second main tanks replacing step, the connection between the one end of the first pipe and the first main tank is released and the one end of the first pipe and the second main tank are connected.

In the second ink supplying step subsequently performed, the second ink stored in the second main tank is filled into the first pipe, the connection pipe of the second auxiliary connecting means, the second pipe, and the ink jet head. The connection pipe in the second auxiliary connecting means is configured to directly connect the two connecting sections, and hence the air in the connection pipe tends to leak when the second ink is filled. Therefore, in a state in which the second auxiliary connecting means is connected to the another end of the first pipe and the one end of the second pipe, if the second ink stored in the second main tank is led from the first pipe, it is possible to fill the first pipe, the connection pipe, the second pipe, and the ink jet head without letting the air into the same.

When the second ink is filled, the first ink stored in the first pipe, the second pipe, and the ink jet head is discharged from the ink jet head side and discarded. At least a part of the first ink in the second pipe is stored in the first main tank in advance, and hence an amount of the ink to be discarded can be controlled.

Finally, in the second auxiliary tank connecting step, the connection between each of the another end of the first pipe and the one end of the second pipe and the second auxiliary connecting means is released without allowing the air to flow into the first pipe, the second pipe, and the second auxiliary connecting means. The another end of the first pipe and the one end of the second pipe are connected to the second auxiliary tank without allowing the air to flow into the first pipe, the second pipe, and the second auxiliary tank. Consequently, the second main tank, the first pipe, the second auxiliary tank, the second pipe, and the ink jet head can be filled with the second ink without letting the air to flow into the same.

Further, at least a part of the first ink in the second pipe is stored in the first main tank in advance, and hence it is possible to control an amount of the first ink mixed in the second ink when the second ink is filled into the second pipe. Therefore, the mixing of the first ink in replacing the first ink with the second ink can be reduced and the inks can be more surely replaced.

According to the present invention, it is possible to provide an ink supplying system for an ink jet printer, an ink supplying method for an ink jet printer, and an ink jet printer with which ink supply work in starting to use the ink jet printer is easy and that can be reduced in size.

DETAILED DESCRIPTION OF THE PREFERRED EMBODIMENTS

First Embodiment

Figure 1:
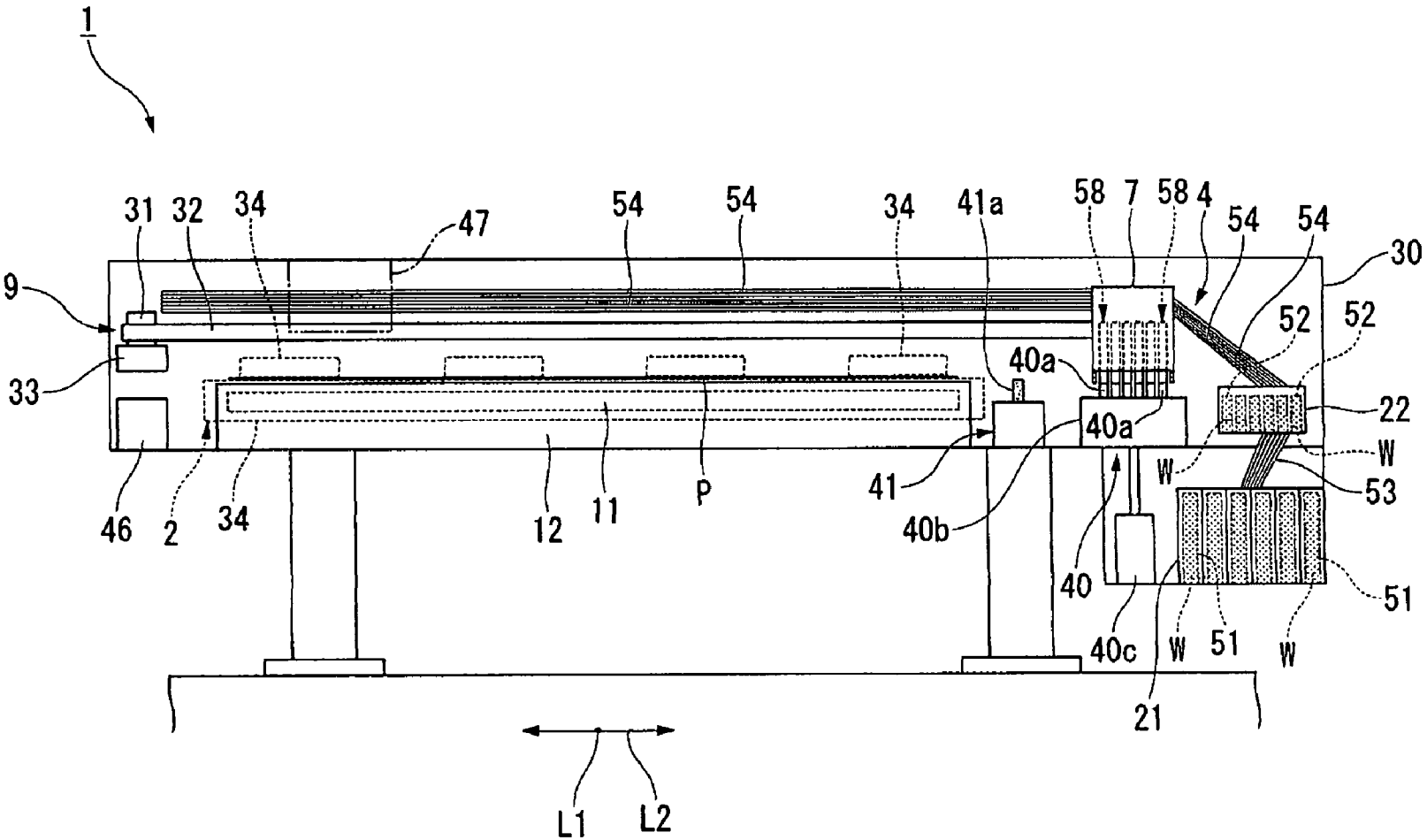
FIG. 1 is a front view illustrating an ink jet printer according to a first embodiment of the present invention.
Figure 2:
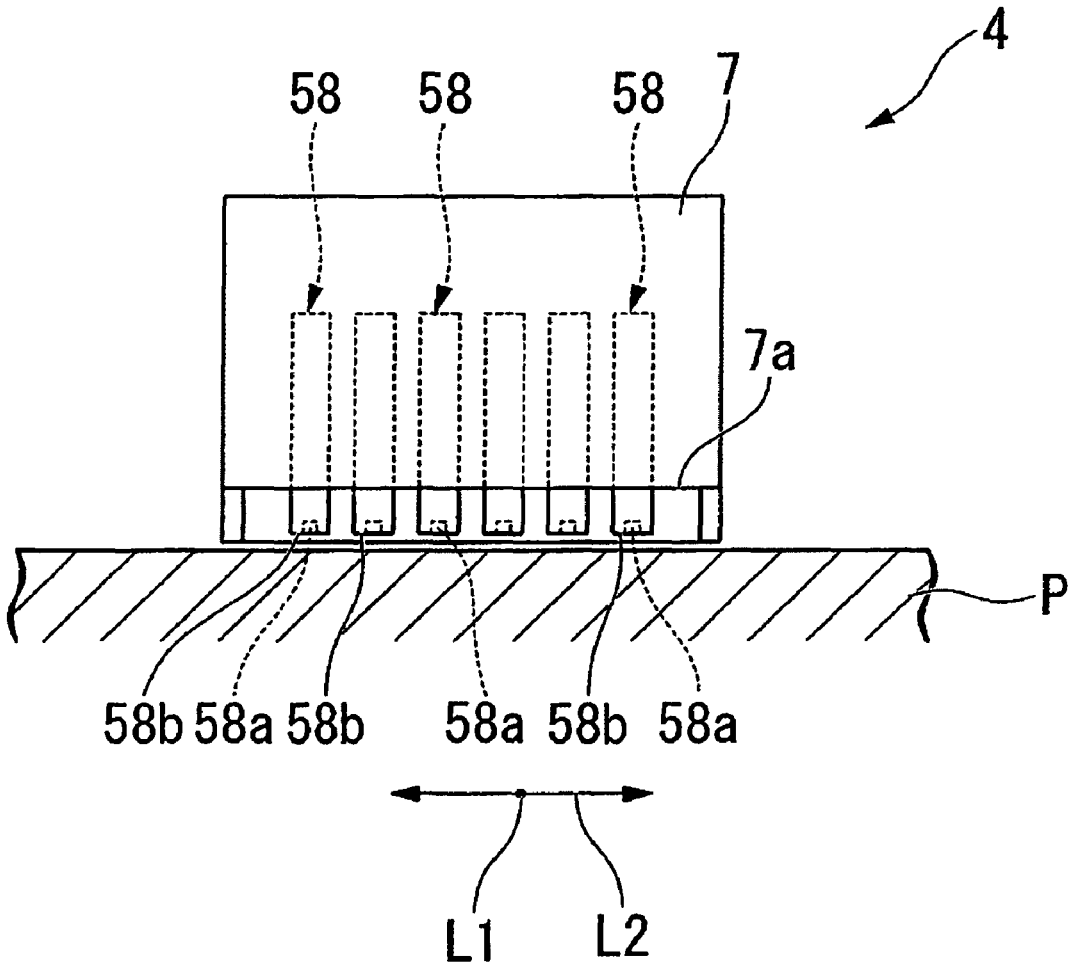
FIG. 2 is a configuration diagram of a carriage unit that configures the ink jet printer illustrated in FIG. 1.
Figure 3:
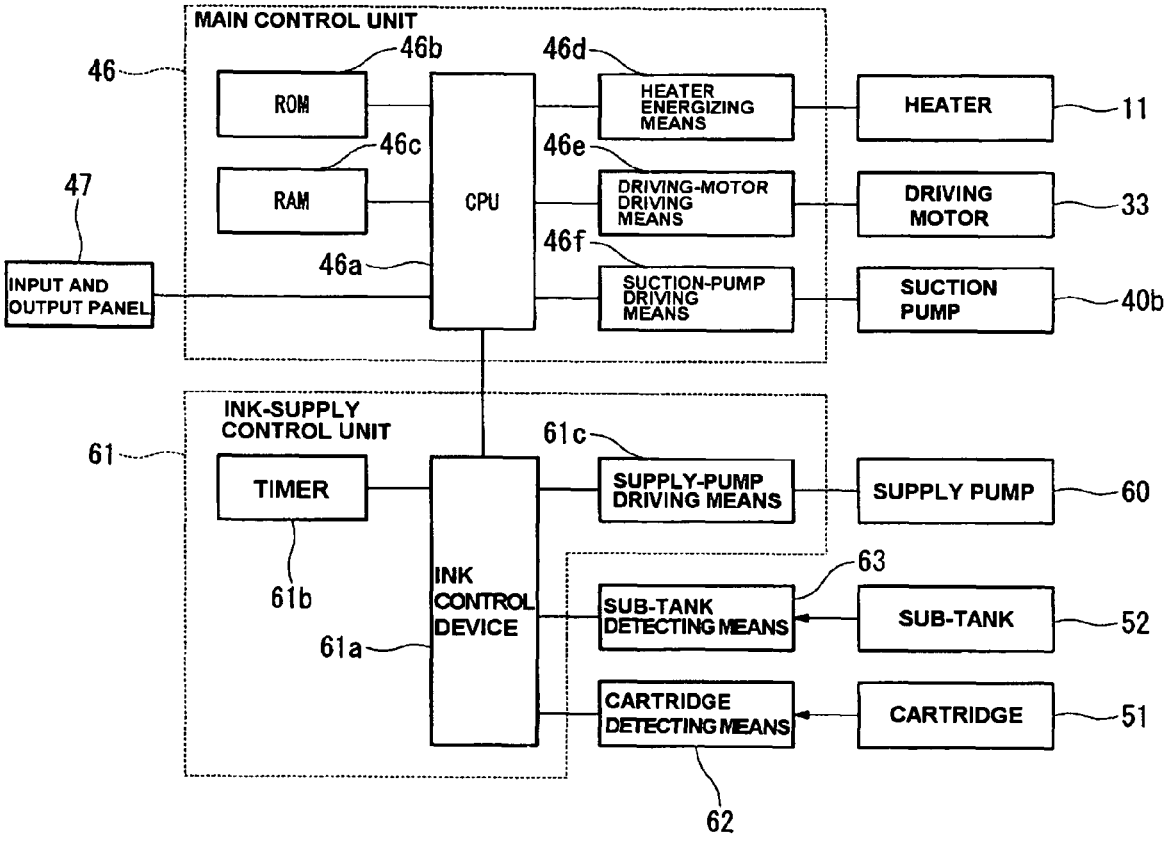
FIG. 3 is a block diagram of the ink jet printer according to the first embodiment of the present invention.

A first embodiment of the present invention is described in detail below with reference to the accompanying drawings. FIGS. 1 to 12 are explanatory diagram of an ink jet printer according to a first embodiment of the present invention. FIG. 1 is a front view of the ink jet printer, FIG. 2 is a configuration diagram of a carriage unit illustrated in FIG. 1, and FIG. 3 is a block diagram.

An ink jet printer 1 according to this embodiment schematically includes, as illustrated in FIG. 1, conveying means 2 that conveys recording sheet P as a printing medium in a conveying direction L1 determined in advance (direction perpendicular to a paper surface in FIG. 1), a carriage unit 4 that reciprocatingly moves a plurality of ink jet heads 58, which jet inks W having colors different from one another and perform printing on the recording sheet P, in an orthogonal direction L2 orthogonal to the conveying direction L1, a plurality of sub-tanks 52 that are connected to the plurality of ink jet heads 58, respectively, and from which the inside air is eliminated, cartridges 51 that are connected to the plurality of sub-tanks 52, respectively, and in which the inks W are stored with the inside air eliminated, and a main control unit 46 that controls the components.

As disclosed herein, each of the sub-tanks 52 corresponds to an auxiliary tank (primary auxiliary ink tank) and each of the cartridges 51 corresponds to a main tank (main ink tank).

In short, this ink jet printer 1 is an ink jet printer that moves, while conveying the recording sheet P in the conveying direction L1, the ink jet heads 58 in the orthogonal direction L2 orthogonal to the conveying direction L1 and records characters, images, and the like on the recording sheet P. In this embodiment, as an example, the ink jet printer 1 includes six ink jet heads 58 and ejects the inks W of black (Bk), cyan (C), magenta (M), yellow (Y), light magenta (Lm), and light cyan (Lc). Those six ink jet heads 58 are configured the same.

The carriage unit 4 is a unit that reciprocatingly moves, along the orthogonal direction L2, on the recording sheet P conveyed in a state in which the recording sheet P is placed on an upper surface of a platen 12 heated by a heater 11. As illustrated in FIGS. 1 and 2, the carriage unit 4 includes a carriage 7 and moving means 9.

Nozzle holes 58*a* for ejecting the inks Ware provided in nozzle surfaces 58*b* on lower surfaces of the ink jet heads 58, respectively. As illustrated in FIG. 2, the ink jet heads 58 are fixed to a head base 7*a* of the carriage 7 in a state in which the nozzle surfaces 58*b* of the ink jet heads 58 are opposed to the recording sheet P. In this case, the ink jet heads 58 are fixed such that the plurality of nozzle holes 58*a* are arranged along the conveying direction L1. The six ink jet heads 58 are fixed to the head base 7*a* to be arranged in the orthogonal direction L2 in which the carriage 7 moves.

As illustrated in FIG. 1, the ink jet heads 58 are connected to the sub-tanks 52 through an intermediation of second pipes 54, respectively. The sub-tanks 52 are connected to the cartridges 51 through an intermediation of first pipes 53, respectively.

Each of the second pipes 54 is a long tube made of a soft material and having flexibility such that the second pipe 54 does not affect the movement of the carriage 7.

As illustrated in FIG. 1, the carriage 7 is movably fixed on a carriage rail (not shown) fixed to a base 30 in a state in which the carriage rail is arranged along the orthogonal direction L2. The carriage 7 is coupled to a conveyor belt 32 wound around a pair of pulleys 31. One pulley 31 of the pair of pulleys 31 rotates according to a rotational driving force from a driving motor 33 fixed to the base 30. The other pulley (not shown) rotates following the conveyor belt 32. Consequently, the carriage 7 can reciprocatingly move in the orthogonal direction L2.

That is, the carriage rail, the pair of pulleys 31, the conveyor belt 32, and the driving motor 33 constitute the moving means 9.

Conveying rollers 34 are provided on the base 30 along the orthogonal direction L2. The conveying rollers 34 include one lower roller (not shown) located on a lower side of the recording sheet P and a plurality of upper rollers (not shown) located on an upper side of the recording sheet P. The lower roller is driven to rotate by a motor (not shown). The upper rollers function as pinch rollers that press the recording sheet P and rotate following the conveyance of the recording sheet P. In other words, the conveying rollers 34 are driven by the motor (not shown) and rotate in opposite directions in a state in which the conveying rollers 34 pinch the recording sheet P therebetween. Consequently, the recording sheet P is conveyed in the conveying direction L1. In other words, the conveying rollers 34 function as the conveying means 2.

The platen 12 incorporating the heater 11 is arranged on a lower surface of the recording sheet P. This platen 12 includes an absorbing mechanism (not shown). Consequently, the recording sheet P slides while sticking to an upper surface of the platen 12 and is conveyed by the conveying rollers 34.

The plurality of sub-tanks 52 are detachably attached to a sub-tank attaching unit 22 (second attaching unit). The plurality of cartridges 51 are detachably attached to a cartridge attaching unit 21 (first attaching unit). The sub-tank attaching unit 22 and the cartridge attaching unit 21 are fixed on the base 30.

That is, an operator of the ink jet printer 1 can easily replace the sub-tanks 52 and the cartridges 51 according to a remaining amount and a period of use of the sealed inks W. In this case, the sub-tanks 52 are arranged below the nozzle holes 58*a*, i.e., downward in the vertical direction such that a predetermined negative pressure is applied to the nozzle holes 58*a*. The cartridges 51 are arranged further below the sub-tanks 52.

Dummy sub-tanks 59 described later can be detachably attached to the sub-tank attaching unit 22 by replacing the sub-tanks 52.

A suction unit 40 and a wipe unit 41 are provided on the base 30. The suction unit 40 is provided in a position where the carriage 7 stays on standby away from an upper region (printing region) of the recording sheet P, i.e., a home position. The suction unit 40 includes suction caps 40*a* and a suction pump 40*b*. When the carriage 7 is arranged in the home position, the respective suction caps 40*a* come into contact with the respective nozzle surfaces 58*b* of the ink jet heads 58.

The suction pump 40*b* is a pump that forcibly performs suction in the nozzle holes 58*a* from the ink jet heads 58 side of an ink supplying system 50 described later to discharge the inks W. Consequently, when the nozzle holes 58*a* clog up because of some cause, suction can be performed in the home position to solve the clogging in the nozzle holes 58*a* by the forcible discharge of the inks W. The discharged inks W are collected in a waste liquid tank 40*c* connected to the suction pump 40*b*.

The wipe unit 41 is provided between the recording sheet P and the suction unit 40. The wipe unit 41 has an elastic or porous wipe section 41*a* that comes into contact with the nozzle surfaces 58*b* and wipes the nozzle surfaces 58*b* to remove dirt and the like when the wipe unit 41 operates. Consequently, the nozzle surfaces 58*b* of the ink jet heads 58 are maintained in as clean a state as possible.

As illustrated in FIG. 3, the main control unit 46 provided to the inkjet printer 1 includes a CPU 46*a* that controls an arithmetic operation and the entire system on the basis of a predetermined control program, a ROM 46*b* that stores therein the control program for the CPU 46*a* and the like in a predetermined region, a RAM 46*c* for storing data read out from the ROM 46 band the like and an arithmetic operation result necessary in an arithmetic operation process of the CPU 46*a*, heater energizing means 46*d* for energizing the heater 11, driving-motor driving means 46*e* for driving the driving motor 33, and suction-pump driving means 46*f* for driving the suction pump 40*b*.

The CPU 46*a* is connected to the ROM 46*b*, the RAM 46*c*, the heater energizing means 46*d*, the driving-motor driving means 46*e*, the suction-pump driving means 46*f*, and an ink control device 61*a* of an ink-supply control unit 61 described later.

The CPU 46*a* is further connected to an input and output panel 47. A user can obtain information from the CPU 46*a* and output various commands to the CPU 46*a* via the input and output panel 47.

The ink jet printer 1 includes six sets of ink supplying systems 50 for the inks of W six colors. One set of the ink supplying systems 50 illustrated in FIG. 4 is described as an example.

Figure 4:
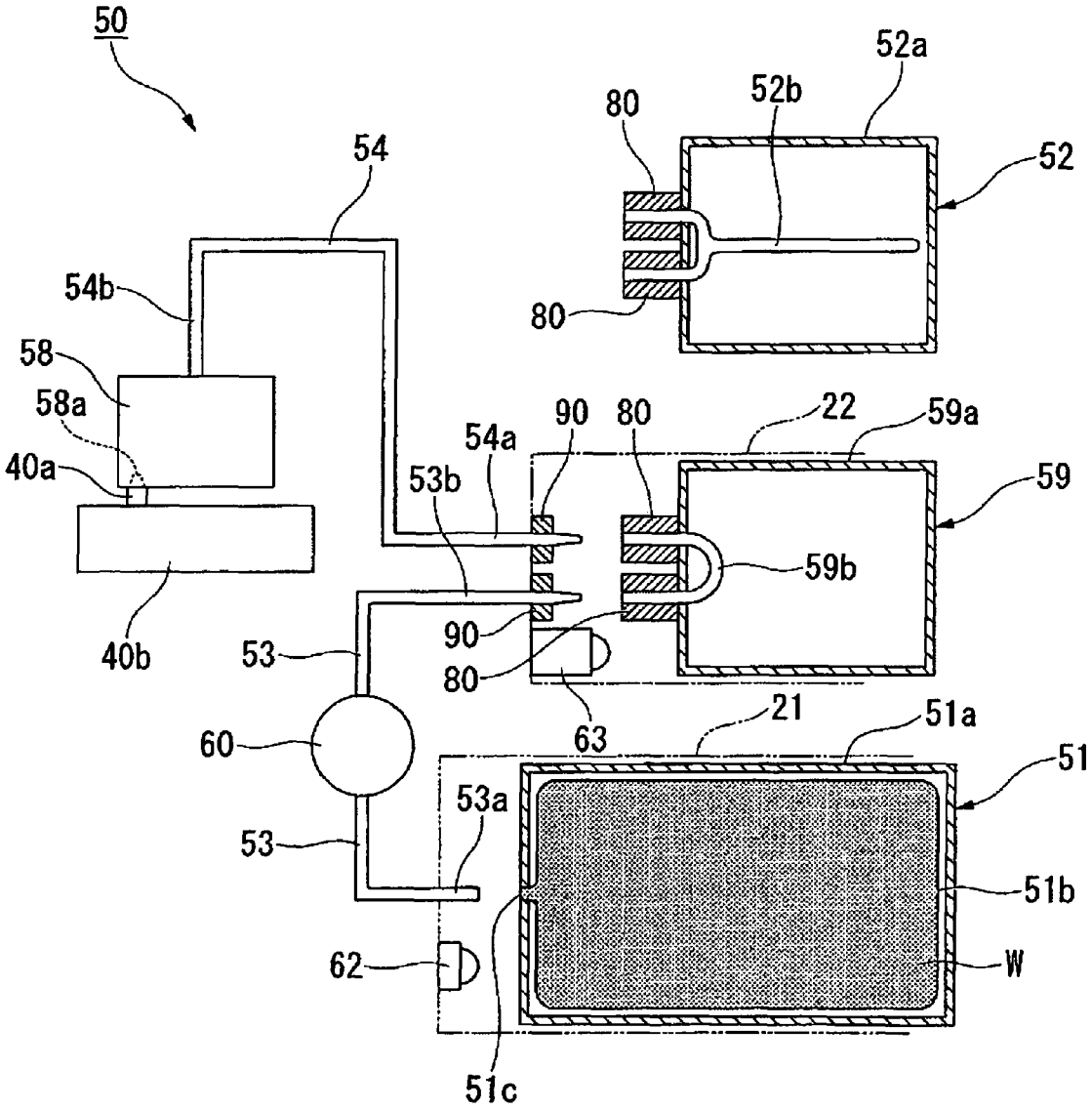
FIG. 4 is a configuration diagram of an ink supplying system of the ink jet printer according to the first embodiment of the present invention.

As illustrated in FIGS. 3 and 4, the ink supplying system 50 includes a first pipe 53 having one end 53*a* which is connected to the cartridge 51, a second pipe 54 having one end 54*a* which is connected to the sub-tank 52 connected to the another end 53*b* of the first pipe 53, an ink jet head 58 that is connected to the another end 54*b* of the second pipe 54 and ejects ink to perform printing on the recording sheet P, sub-tank detecting means 63 (second detecting means) fixed to the sub-tank attaching unit 22, cartridge detecting means 62 (first detecting means fixed to the cartridge attaching unit 21, and the ink-supply control unit 61 that controls the components according to commands from the main control unit 46.

When ink is supplied by the ink supplying system 50, the cartridge 51, the sub-tank 52, and the dummy sub-tank 59 used in replacement of the sub-tank 52 are used.

As disclosed herein, the dummy sub-tank 59 corresponds to the auxiliary connecting means (secondary auxiliary ink tank).

The sub-tank detecting means 63 and the cartridge detecting means 62 include contact sensors. The sub-tank detecting means 63 detects whether or not the sub-tank 52 or the dummy sub-tank 59 is attached to the sub-tank attaching unit 22. The cartridge detecting means 62 detects whether or not the cartridge 51 is attached to the cartridge attaching unit 21.

The sub-tank detecting means 63 and the cartridge detecting means 62 transmit detection results to the ink control device 61*a*.

The cartridge 51 includes a cartridge case 51*a* made of a resin molded in a box shape, a cartridge bag 51*b* that is arranged in the inside of the cartridge case 51*a*, eliminates the air in the inside, and stores the ink W, and a cartridge connecting section 51*c* serving as an inlet and an outlet of the ink W to and from the cartridge bag 51*b*.

On the other hand, the sub-tank 52 includes a sub-tank case 52*a* made of a resin molded in a box shape, a sub-tank bag 52*b* that is arranged in the inside of the sub-tank case 52*a* and can be filled with the ink W, in which a vacuum is drawn in the inside thereof in advance, and two valve unit main bodies 80 connected to the another end 53*b* of the first pipe 53 and the one end 54*a* of the second pipe 54, respectively. The valve unit main bodies 80 are described in detail later.

A portion between the sub-tank bag 52*b* and each of the two valve unit main bodies 80 is sealed to prevent the ink W and the air from entering and leaking from the portion. The two valve unit main bodies 80 serve as inlets and outlets when the ink W flows in from and flows out to the sub-tank bag 52*b*, and are attached to one side of the sub-tank case 52*a*.

Joint members 90 are respectively provided at the another end 53*b* of the first pipe 53 and the one end 54*a* of the second pipe 54 connected to the valve unit main bodies 80. The joint members 90 function as detachable units configured not to allow the air to flow in to the valve unit main bodies 80 side when the pipes are connected to the valve unit main bodies 80.

The dummy sub-tank 59 includes a dummy sub-tank case 59*a* made of a resin molded in a box shape same as the shape of the sub-tank case 52*a*, two valve unit main bodies 80 connected to the another end 53*b* of the first pipe 53 and the one end 54*a* of the second pipe 54, respectively, and a U-shaped connection pipe 59*b* which is molded by a resin or the like and directly connects the two valve unit main bodies 80. The two valve unit main bodies 80 are attached to one side of the dummy sub-tank case 59*a* in the same manner as the sub-tank 52.

It is preferable that the dummy sub-tank 59 be connected to the first pipe 53 or the second pipe 54 and configured not to prevent a flow of ink when an ink channel is formed. It is also preferable that the dummy sub-tank 59 be configured to have an extremely small ink volume that can present therein when compared with the sub-tank 52. The ink volume that can present in the sub-tank 52 means an ink volume that can fill the sub-tank bag 52*b*. The ink volume that can present in the dummy sub-tank 59 means an ink volume that can present in the connection pipe 59*b*. Moreover, it is preferable that the ink volume that can be present in the dummy sub-tank 59 be equal to or smaller than 1/10 of that in the sub-tank 52 as a reference.

The connection pipe 59*b* can be prevented from being an obstacle of the flow of ink by being formed of a pipe having a sectional area same as that of the first pipe 53 or the second pipe 54. The connection pipe 59*b* may be formed of a pipe same as the first pipe 53 or the second pipe 54.

When the sub-tank 52 is attached to the sub-tank attaching unit 22, the joint members 90 provided at the another end 53*b* of the first pipe 53 and the one end 54*a* of the second pipe 54 and the two valve unit main bodies 80 provided in the sub-tank 52 are connected to each other. When the sub-tank 52 is removed from the sub-tank attaching unit 22, the connection between the joint members 90 provided at the another end 53*b* of the first pipe 53 and the one end 54*a* of the second pipe 54 and the two valve unit main bodies 80 provided in the sub-tank 52 is released.

The same holds true for the dummy sub-tank 59 that is used by replacing the sub-tank attaching unit 22. That is, when the dummy sub-tank 59 is attached to the sub-tank attaching unit 22, the joint members 90 provided at the another end 53*b* of the first pipe 53 and the one end 54*a* of the second pipe 54 and the two valve unit main bodies 80 provided in the dummy sub-tank 59 are connected to each other. When the dummy sub-tank 59 is removed from the sub-tank attaching unit 22, the connection between the joint members 90 provided at the another end 53*b* of the first pipe 53 and the one end 54*a* of the second pipe 54 and the two valve unit main bodies 80 provided in the sub-tank 59 is released.

When the cartridge 51 is attached to the cartridge attaching unit 21, the one end 53*a* of the first pipe 53 and the cartridge connecting unit 51*c* of the cartridge 51 are connected to each other. When the cartridge 51 is removed from the cartridge attaching unit 21, the connection between the one end 53*a* of the first pipe 53 and the cartridge connecting unit 51*c* is released.

It is also possible that the joint member 90 is provided at the one end 53*a* of the first pipe 53 and the valve unit main body 80 is used instead of the cartridge connecting unit 51*c* to perform connection and separation in the same manner as described above.

The cartridge bag 51*b* of the cartridge 51 and the sub-tank bag 52*b* of the sub-tank 52 are made of a thin polyethylene bag or the like, on the surface of which aluminum is deposited, and have flexibility. The ink W can be pushed out by pressing the cartridge bag 51*b* and the sub-tank bag 52*b* with a hand.

The dummy sub-tank case 59*a* is provided to form an external appearance of the dummy sub-tank 59 same as that of the sub-tank 52. The dummy sub-tank case 59*a* may not be used or may be reduced in size.

A supply pump 60 is arranged in a route of the first pipe 53 and generates a driving force for carrying the ink W stored in the cartridge 51 to the first pipe 53. The supply pump 60 can switch open and closed states of the route in which the ink W of the first pipe 53 flows.

Figure 5:
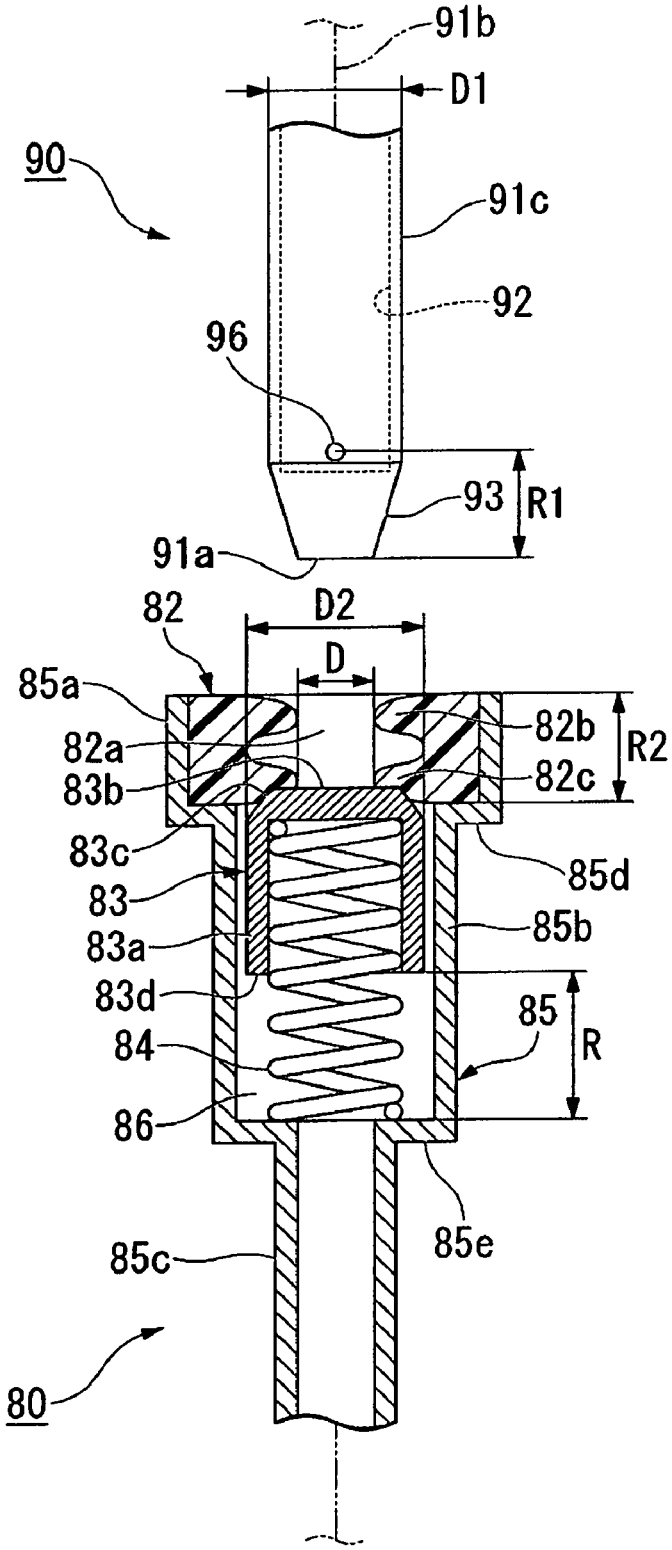
FIG. 5 is an explanatory diagram of configurations and actions of a valve unit main body and a joint member of the ink jet printer according the first embodiment of the present invention.
Figure 6:
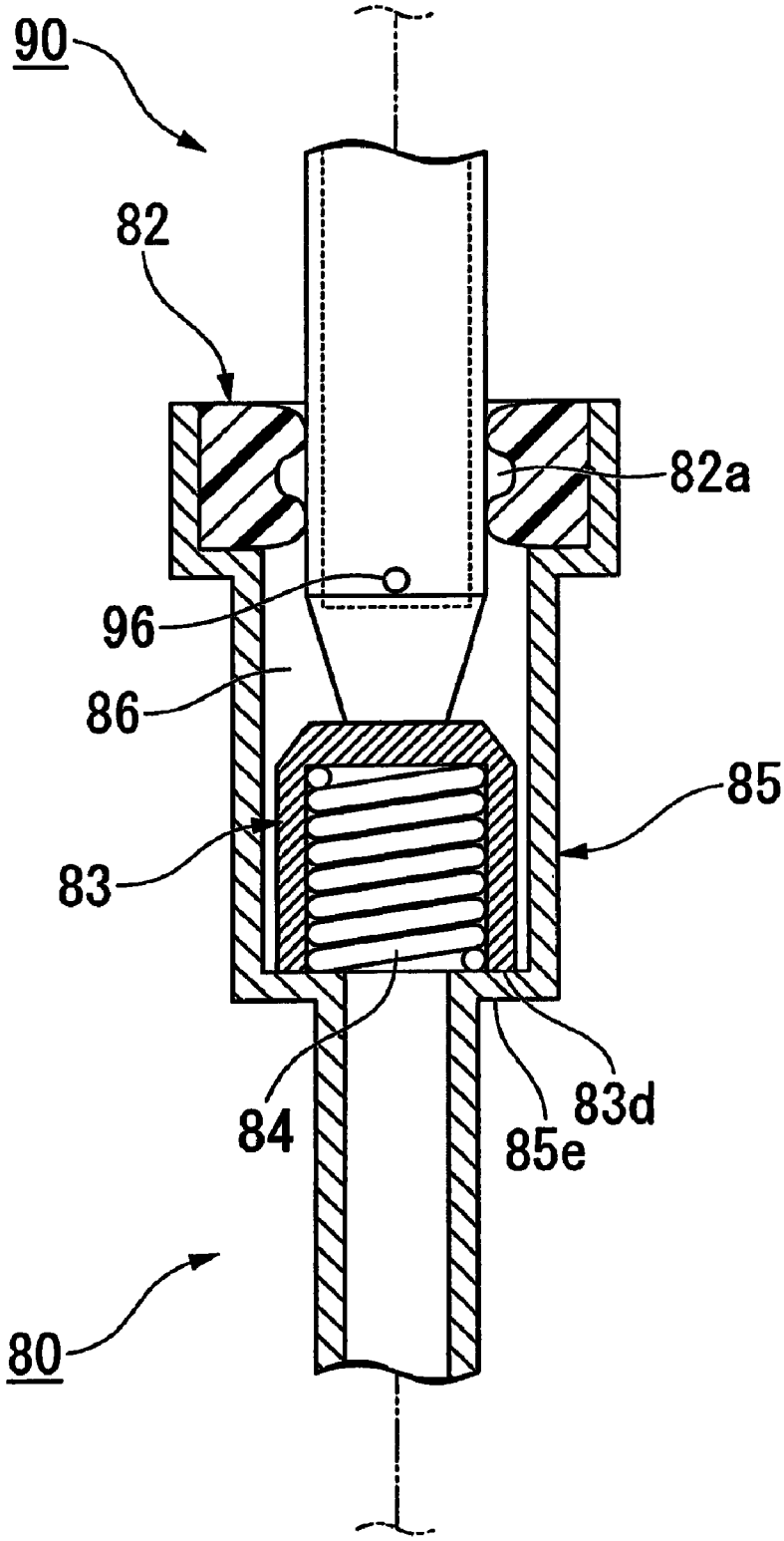
FIG. 6 is an explanatory diagram of the configurations and the actions of the valve unit main body and the joint member of the ink jet printer according to the first embodiment of the present invention.

FIGS. 5 and 6 are explanatory diagrams of configurations and operations of the valve unit main body 80 and the joint member 80.

FIG. 5 is a diagram illustrating a state in which the valve unit main body 80 and the joint member 80 are separated from each other. FIG. 6 is a diagram illustrating a state in which the valve unit main body 80 and the joint member 90 are connected to each other.

The valve main body 80 generally includes, as illustrated in FIG. 5, a valve seat 82, a valve element 83 closely fitted to the valve seat, an urging spring 84 that urges the valve element 83 toward the valve seat 82, and a valve main body 85 that houses the valve seat 82, the valve element 83, and the urging member 84.

A fitting hole 82*a* is provided in the center of the valve seat 82 such that the valve seat 82 is generally formed in a substantially ring shape. This valve seat 82 is made of a resin that is elastically deformable when being pressed. The fitting hole 82*a* is a hole for fitting a distal end 91*a* of the joint member 90 described later therein. On an inner peripheral surface of the valve seat 82 opposed to this fitting hole 82*a*, two contact projecting sections 82*b* and 82*c*, which project inward over a circumferential direction, are vertically provided side by side.

The valve element 83 is formed in a substantially bottomed cylindrical shape including a sidewall section 83*a* formed in a cylindrical shape and a bottom section 83*b* formed to close one end side peripheral edge of this sidewall section 83*a*. At an edge where the sidewall section 83*a* and the bottom section 83*b* are connected, a tapered surface edge 83*c* inclined with respect to the bottom section 83*b* is provided. A diameter D2 of the bottom section 83*b* including this tapered surface edge 83*c* (which coincides with an outer diameter of the sidewall section 83*a*) is set larger than a diameter D of the fitting hole 82*a* provided in the valve seat 82. This valve element 83 is arranged with the bottom section 83*b* directed to the valve seat 82 side. The urging spring 84 is provided in the inside of this valve element 83. This urging spring 84 is arranged in the inside of this valve element 83 such that one end of the urging spring 84 comes into contact with a surface of the bottom section 83*b* on an internal side and the another end thereof comes into contact with a Step 85*e* described later in the inside of the valve main body 85. Consequently, the urging spring 84 supports the valve element 83 such that the valve element 83 can be brought close to or separated from the valve seat 82, and urges the valve element 83 toward the valve seat 82.

A moving distance R in which this valve element 83 can be brought close to or separated from the valve seat 82 (hereinafter referred to as "valve element moving distance") is a distance in which the valve element 83 moves from a state illustrated in FIG. 5 in which the bottom section 83*b* and the tapered surface edge 83*c* of the valve element 83 are in contact with the contact projecting section 82*c* of the valve seat 82 while pressing the contact projecting section 82*c* upward to a state illustrated in FIG. 6 in which an opening end 83*d* of the valve element 83 is in contact with the Step 85*e*.

Small holes (not shown) are provided in the sidewall section 83*a* of the valve element 83. Even if the opening end 83*d* comes into contact with the Step 85*e*, the ink W can flow through the small holes.

The valve main body 85 houses the valve seat 82, the valve element 83, the urging spring 84, and the ink W described above such that the ink W can flow in and out. The valve main body 85 is formed to be opened on both upper and lower sides and is formed in a substantially cylindrical shape formed as if cylinders having three kinds of different diameters, which decrease one after another from large to medium and small, are coupled. In a valve seat housing cylinder section 85*a* formed by this large-diameter cylinder, the valve seat 82 described above is pressed and fitted thereto.

In a valve element housing cylinder section 85*b* formed by this medium-diameter cylinder, the valve element 83 and the urging spring 84 described above are housed. An inner diameter of this valve element housing cylinder section 85*b* is set larger than an outer diameter of the valve element 83. Consequently, a clearance is formed between an inner peripheral surface of this valve element housing cylinder section 85 and an outer peripheral surface of the sidewall section 83*a* of the valve element 83. The ink W flows in and out through this clearance. The sub-tank bag 52*b*, the connection pipe 59*b*, and the like are attached to an ink inflow cylinder section 85*c* formed by this small-diameter cylinder.

Diameters of the valve seat housing cylinder section 85*a* and the valve element housing cylinder section 85*b* adjacent to each other are different and diameters of the valve element housing cylinder section 85 band the ink inflow cylinder section 85*c* adjacent to each other are different, respectively, and hence steps 85*d* and 85*e* are formed. The valve seat 82, the valve element 83, and the urging spring 84 are positioned by those steps 85*d* and 85*e*. In other words, the valve seat 82 is in contact with the Step 85*d* and the another end of the urging spring 84 is in contact with the Step 85*e*.

Consequently, the urging spring 84 urges the valve element 83 toward the valve seat 82. The urging force of the urging spring 84 in the valve unit main body 80 attached to the sub-tank 52 is determined as described below. That is, the urging force is set to be larger than a total of force applied to the bottom section 83*b* of the valve element 83 by the atmospheric pressure from the direction of the joint member 90 illustrated in FIG. 5.

This is because it is necessary to keep an inside 86 of the valve main body 85 in a vacuum even if the valve element 83 is subjected to the atmospheric pressure from the direction of the joint member 90.

As illustrated in FIG. 5, the joint member 90 is formed in a bottomed cylindrical shape. Specifically, in the joint member 90, a bottom section 91*a* fitted in the fitting hole 82*a* of the valve main body 80 is provided on a distal end side and an opening section 91*b* connected to the another end 53*b* of the first pipe 53 and the one end 54*a* of the second pipe 54 is provided on a proximal end side. In other words, an inside 92 of this joint member 90 formed in the bottomed cylindrical shape is formed in a cavity shape and ink flows in and out through the inside 92. In this bottom section 91*a*, a tapered section 93 is provided to be tapered toward a distal end thereof. The tapered section 93 is provided in this way, and hence it is easy to fit the joint member 90 in the fitting hole 82*a* at the time of fitting.

An outer diameter D1 of a peripheral wall section 91*c* extending from the distal end to the proximal end of this joint member 90 is set larger than the diameter D of the fitting hole 82*a* provided in the valve seat 82. Consequently, when the joint member 90 is fitted in the fitting hole 82*a* from an axial direction thereof, the contact projecting sections 82*b* and 82*c* provided on the inner peripheral surface of the valve seat 82 come into close contact with an outer peripheral surface of the peripheral wall section 91*c* of this joint member 90 while pressing the outer peripheral surface to thereby realize a sealed state.

A small-diameter ink supply hole 96 for causing the inside 92 to communicate with the outside is provided in the peripheral wall section 91*c* of this joint member 90. A distance R1 from the bottom section 91*a* as the distal end is set smaller than the valve element moving distance R and is set larger than the thickness R2 of the valve seat 82. Consequently, when the joint member 90 is fitted in the valve main body 80 from the fitting hole 82*a* as illustrated in FIG. 6, the ink supply hole 96 is preferably arranged in the inside 86 of the valve main body 85 after climbing over the valve seat 82.

In this way, when the valve unit main body 80 and the joint member 90 are connected to each other as illustrated in FIG. 6, the ink W can flow in both directions between the valve unit main body 80 and the joint member 90.

On the other hand, when the valve unit main body 80 and the joint member 90 are separated from each other as illustrated in FIG. 5, the valve seat 82 and the valve element 83 come into close contact with each other, and hence the valve unit main body 80 blocks the inflow and the outflow of not only the ink W but also the air. The small-diameter ink supply hole 96 is provided in the joint member 90. However, whether the ink W and the air flow in and flow out from this ink supply hole 96 depends on a diameter of a hole provided at the another end of the pipe and the like to which the joint member 90 is connected, a water head difference between both ends of the pipe, and the like. Details are described later.

As illustrated in FIG. 3, the ink-supply control unit 61 includes the ink control device 61*a* that performs various arithmetic operations according to commands from the CPU 46*a*, a timer 61*b* that measures a predetermined time and sends a signal to the ink-supply control unit 61, and supply-pump driving means 61*c* for driving the supply pump 60.

The ink control device 61*a* is connected to the CPU 46*a*, the timer 61*b*, and the supply-pump driving means 61*c*.

Figure 7:
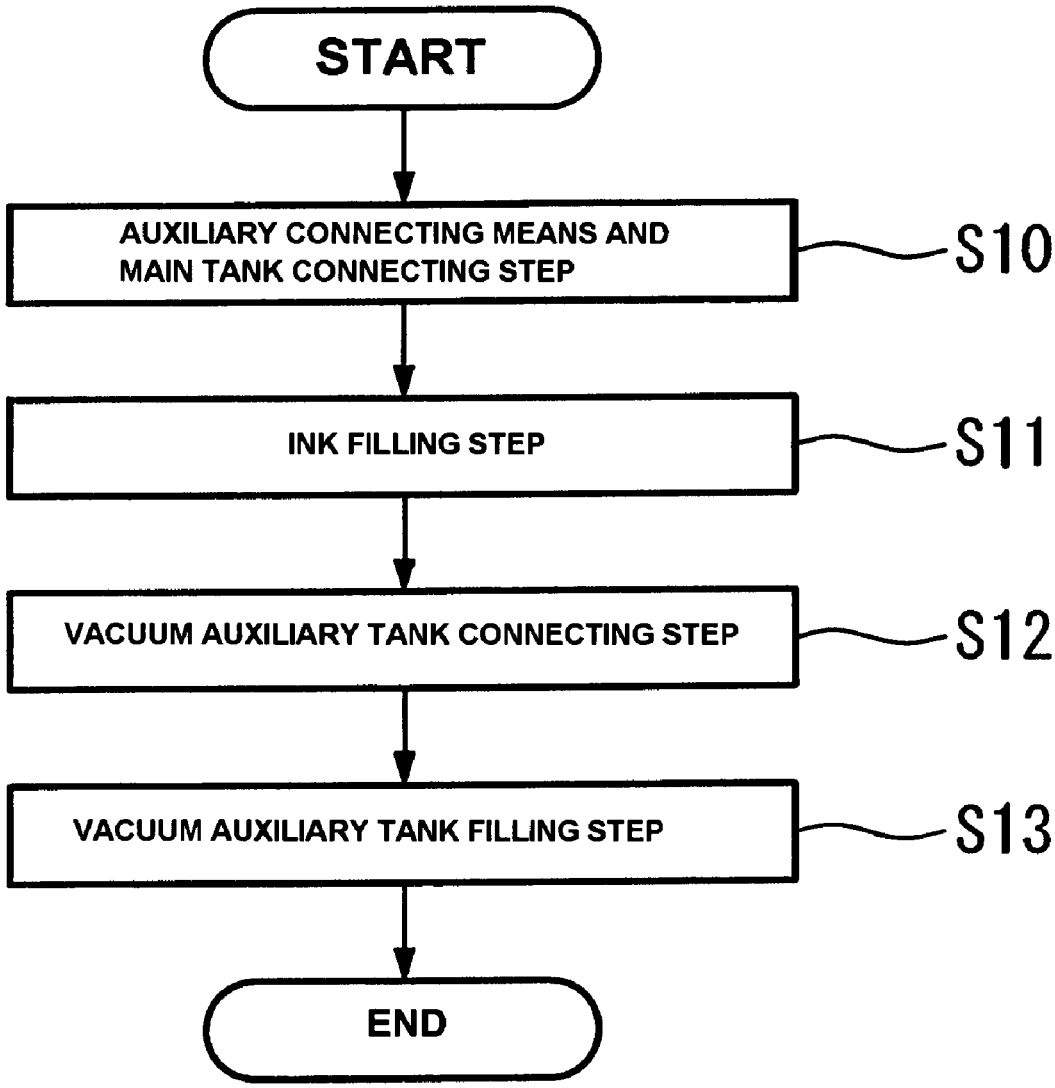
FIG. 7 is a flowchart of an ink supplying method for the ink supplying system of the ink jet printer according to the first embodiment of the present invention.

Next, an ink supplying method in the ink jet printer according to the present invention is described. FIG. 7 is a flowchart of the ink supplying method. FIGS. 8 to 12 are explanatory diagrams illustrating respective steps of the ink supplying method.

In order to clarify the description of the respective steps of the ink supplying method, only a main part of the ink supplying system 50 is illustrated in the figure and described. One set illustrated in FIG. 8 among six sets of the ink supplying system 50 provided to the ink jet printer 1 is described as an example.

Figure 8:
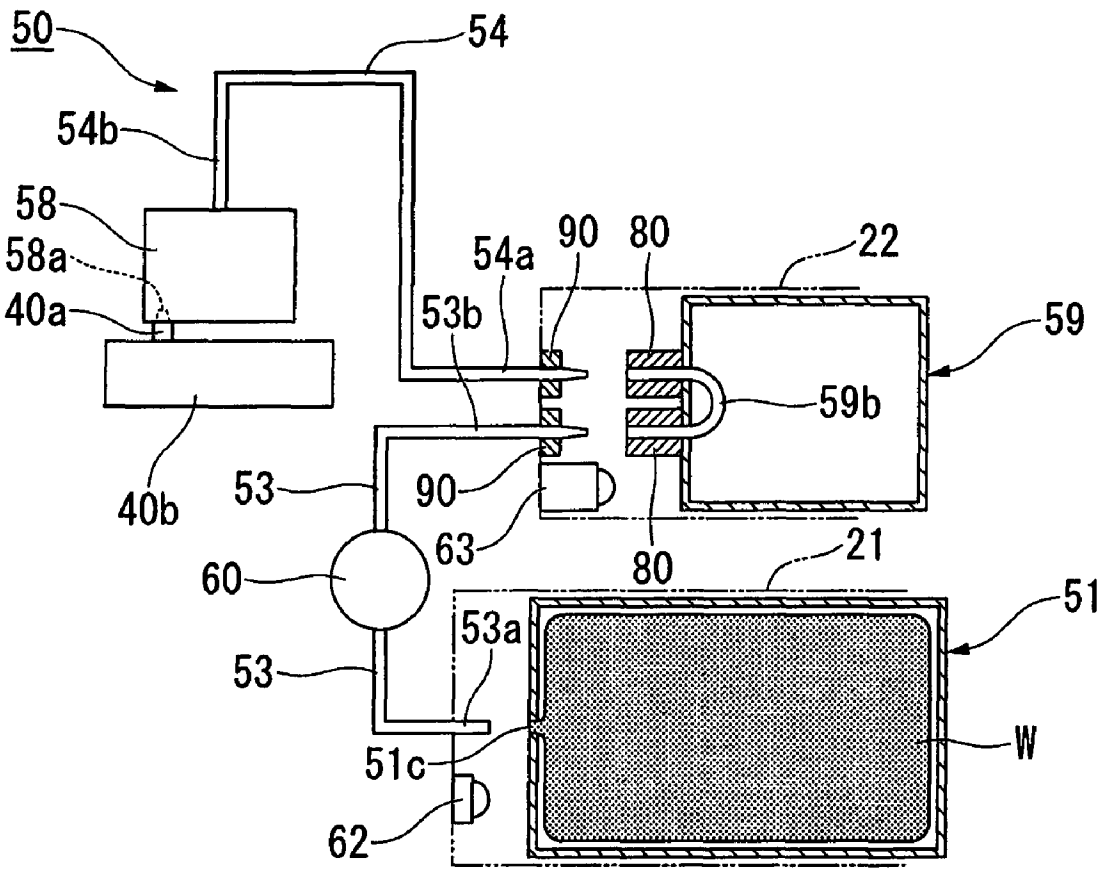
FIG. 8 is an explanatory diagram illustrating steps of the ink supplying method for the ink supplying system of the ink jet printer according to the first embodiment of the present invention.
Figure 9:
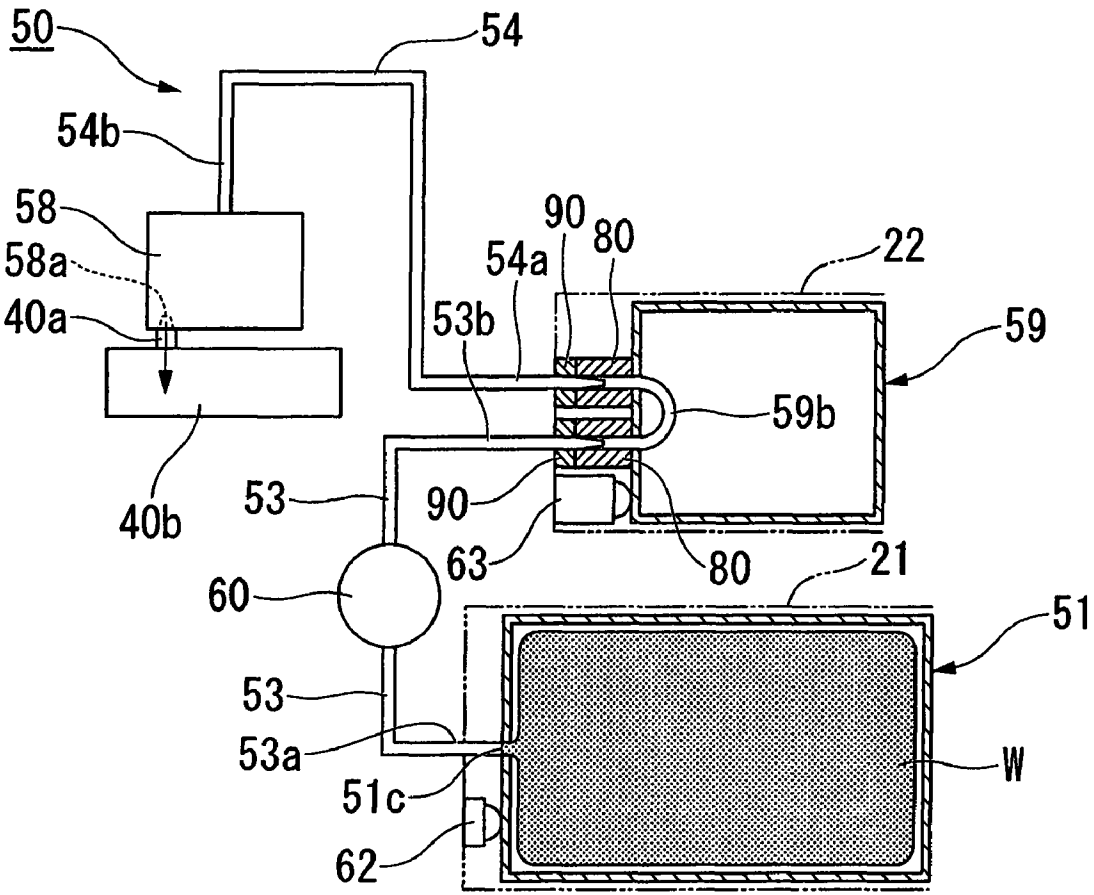
FIG. 9 is an explanatory diagram illustrating steps of the ink supplying method for the ink supplying system of the ink jet printer according to the first embodiment of the present invention.

As illustrated in FIG. 8, before the ink jet printer 1 is used, nothing is attached to the sub-tank attaching unit 22 and the cartridge attaching unit 21. This is for the purpose of preventing the ink W in the cartridge 51 from coming into contact with the air to be oxidized or dried and of realizing convenience of transportation of the ink jet printer 1.

The carriage 7 is arranged in the home position in advance by the driving motor 33. The suction caps 40*a* of the suction unit 40 are in contact with the nozzle surfaces 58*b* of the ink jet heads 58, respectively.

When the ink control device 61*a* of the ink-supply control unit 61 receives a command from the CPU 46*a* of the main control unit 46 to execute an initial filling step for the ink W, first, in an auxiliary connecting means and main tank connecting step (Step S10), the ink control device 61*a* instructs the supply-pump driving means 61*c* to set the supply pump 60 in a closed state.

The operator of the ink jet printer 1 attaches the dummy sub-tank 59 to the sub-tank attaching unit 22. Consequently, the joint member 90 provided at the another end 53*b* of the first pipe 53 and the joint member 90 provided at the one end 54*a* of the second pipe 54, and the two valve unit main bodies 80 provided in the dummy sub-tank 59 are connected to each other, respectively. The operator connects the cartridge connecting section 51*c*, which is provided to the cartridge 51 filled with the ink W with the air therein being eliminated, to the one end 53*a* of the first pipe 53 (see FIG. 9).

The ink control device 61*a* detects, with use of the sub-tank detecting means 63, that the dummy sub-tank 59 is attached to the sub-tank attaching unit 22. The ink control device 61*a* further detects, with use of the cartridge detecting means 62, that the cartridge 51 is attached to the cartridge attaching unit 21. The ink control device 61*a* shifts to Step S11.

Next, in an ink filling step (Step S11), the ink control device 61*a* instructs the supply-pump driving means 61*c* to set the supply pump 60 in an open state. The ink control device 61*a* instructs the CPU 46*a* to drive the suction pump 40*b* via the suction-pump driving means 46*f* and fill the ink W stored in the cartridge 51 into the first pipe 53, the connection pipe 59*b*, the second pipe 54, and the ink jet head 58. The ink control device 61*a* shifts to Step S12 (see FIG. 10).

The connection pipe 59*b* is configured to directly connect the two valve unit main bodies 80, and hence the air in the connection pipe 59*b* tends to leak when the ink W is filled. Therefore, when the ink W stored in the cartridge 51 is filled, the air in the first pipe 53, the connection pipe 59*b*, the second pipe 54, and the ink jet head 58 is pushed out in this order. It is possible to fill the first pipe 53, the connection pipe 59*b*, the second pipe 54, and the ink jet head 58 with the ink W without letting the air into the same.

Next, in a vacuum auxiliary tank connecting step (Step S12), the ink control device 61*a* instructs the supply-pump driving means 61*c* to set the supply pump 60 in the closed state.

The operator removes the dummy sub-tank 59 from the sub-tank attaching unit 22 and attaches the sub-tank 52 to the sub-tank attaching unit 22.

Consequently, the connection between each of the joint member 90 provided at the another end 53*b* of the first pipe 53 and the joint member 90 provided at the one end 54*a* of the second pipe 54, and the two valve unit main bodies 80 provided in the dummy sub-tank 59 is released. Moreover, the two joint members 90 and the two valve unit main bodies 80 provided to the sub-tank 52 in which a vacuum is drawn in the inside of the sub-tank bag 52*b* in advance are connected to each other (see FIG. 11).

The ink control device 61*a* detects, with use of the sub-tank detecting means 63, that the sub-tank 52 is attached to the sub-tank attaching unit 22. The ink control device 61*a* shifts to Step S13.

The ink supply hole 96 is provided to the joint member 90 provided at the another end 53*b* of the first pipe 53. However, the air does not flow into the joint member 90 from the another end 53*b* of the first pipe 53 because the connection between the joint members 90 and the valve unit main bodies 80 is released when the supply pump 60 is in the closed state and because the another end 53*b* of the first pipe 53 is arranged at the top of the first pipe 53.

The ink supply hole 96 is provided to the joint member 90 provided at the one end 54*a* of the second pipe 54 and the nozzle hole 58*a* is provided to the ink jet head 58 connected to the another end 54*b* of the second pipe 54. The nozzle hole 58*a* is arranged above the ink supply hole 96, and hence the ink W tends to flow from the another end 54*b* side to the one end 54*a* side of the second pipe 54 with own weight thereof. However, the nozzle hole 58*a* is extremely small and the viscosity of the ink W is high, and hence the ink W at the another end 54*b* section cannot flow to the one end 54*a* side. Consequently, the ink W on the one end 54*a* side does not move either and the air does not flow into the second pipe 54.

In this way, even if the connection between the valve unit main bodies 80 and the joint members 90 is released, the air does not flow in from the valve unit main bodies 80 and the joint members 90. As described above, even if the valve unit main bodies 80 and the joint members 90 are connected to each other, the air does not flow in.

In this way, detachable mechanisms are configured by the valve unit main bodies 80, the joint members 90, the first pipe 53, the supply pump 60, the second pipe 54, and the ink jet head 58. It is possible to connect to and separate from each other the another end 53*b* of the first pipe 53 and the one end 54*a* of the second pipe 54, and the sub-tank 52, or the another end 53*b* of the first pipe 53 and the one end 54*a* of the second pipe 54, and the dummy sub-tank 59 without allowing the air to flow into the first pipe 53, the second pipe 54, the sub-tank 52, and the dummy sub-tank 59.

The sub-tank 52 in which a vacuum is drawn in the inside of the connection pipe 59*b* in advance can be used as a common component regardless of a color of the ink W stored in the cartridge 51. Therefore, types of components necessary for the ink supplying system 50 can be reduced.

Figure 12:
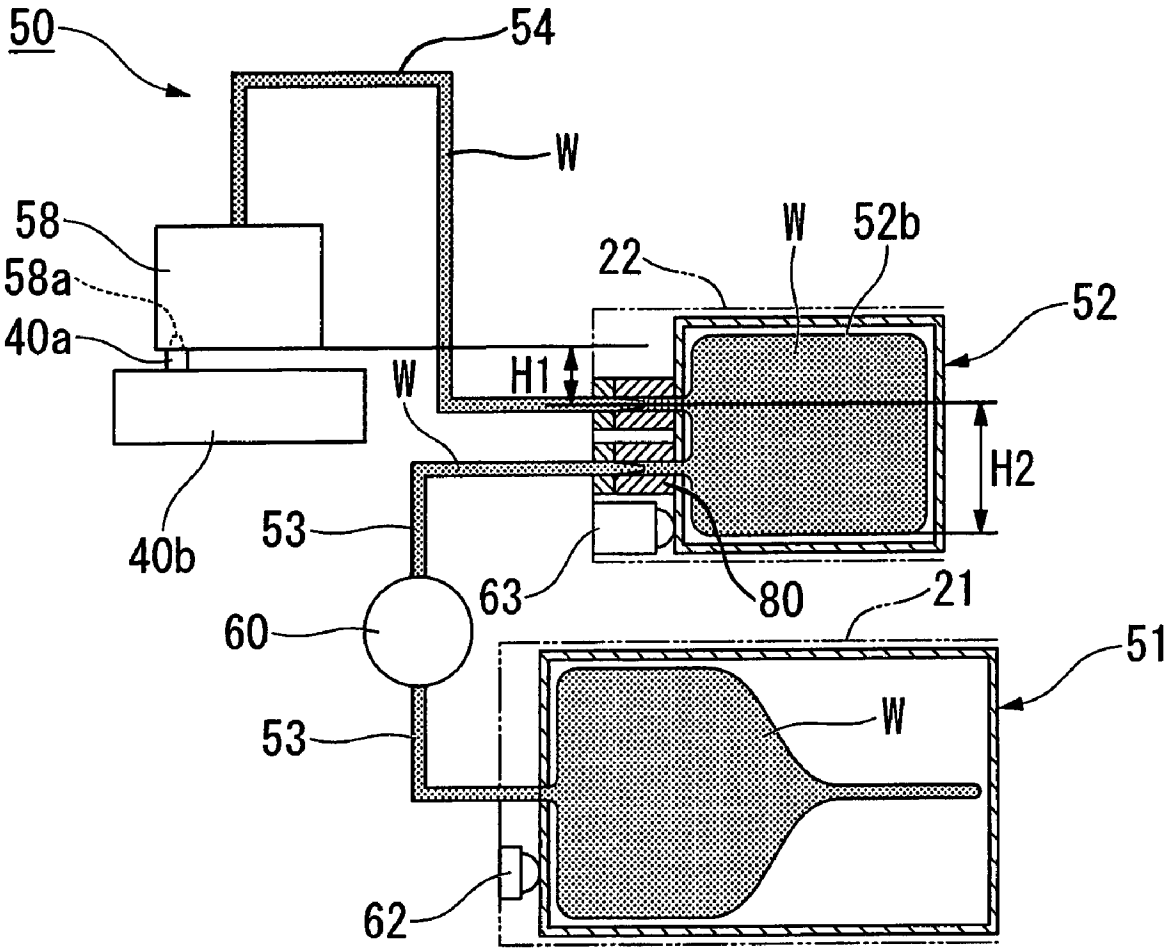
FIG. 12 is an explanatory diagram illustrating steps of the ink supplying method for the ink supplying system of the ink jet printer according to the first embodiment of the present invention.

Finally, in a vacuum auxiliary tank filling step (Step S13), the ink control device 61*a* instructs the supply-pump driving means 61*c* to drive the supply pump 60 and fills the ink W stored in the cartridge 51 into the sub-tank 52 (see FIG. 12).

In this way, with the ink jet printer according to the embodiment of the present invention, it is possible to fill the cartridge 51, the first pipe 53, the sub-tank 52, the second pipe 54, and the ink jet head 58 with the ink W without letting the air into the same and prepare for printing. Therefore, the degassing for the ink conventionally performed by the on-off valve provided to the tube provided in the auxiliary tank is unnecessary. Ink supply work in starting to use the ink jet printer 1 can be facilitated.

The tube and the on-off valve provided in the conventional auxiliary tank are unnecessary. Moreover, the dummy sub-tank 59 as a component used for removing the air in the ink supplying system 50 is removed during normal use. Therefore, a configuration of the entire ink supplying system 50 of the ink jet printer can be reduced in size and simplified.

Figure 13:
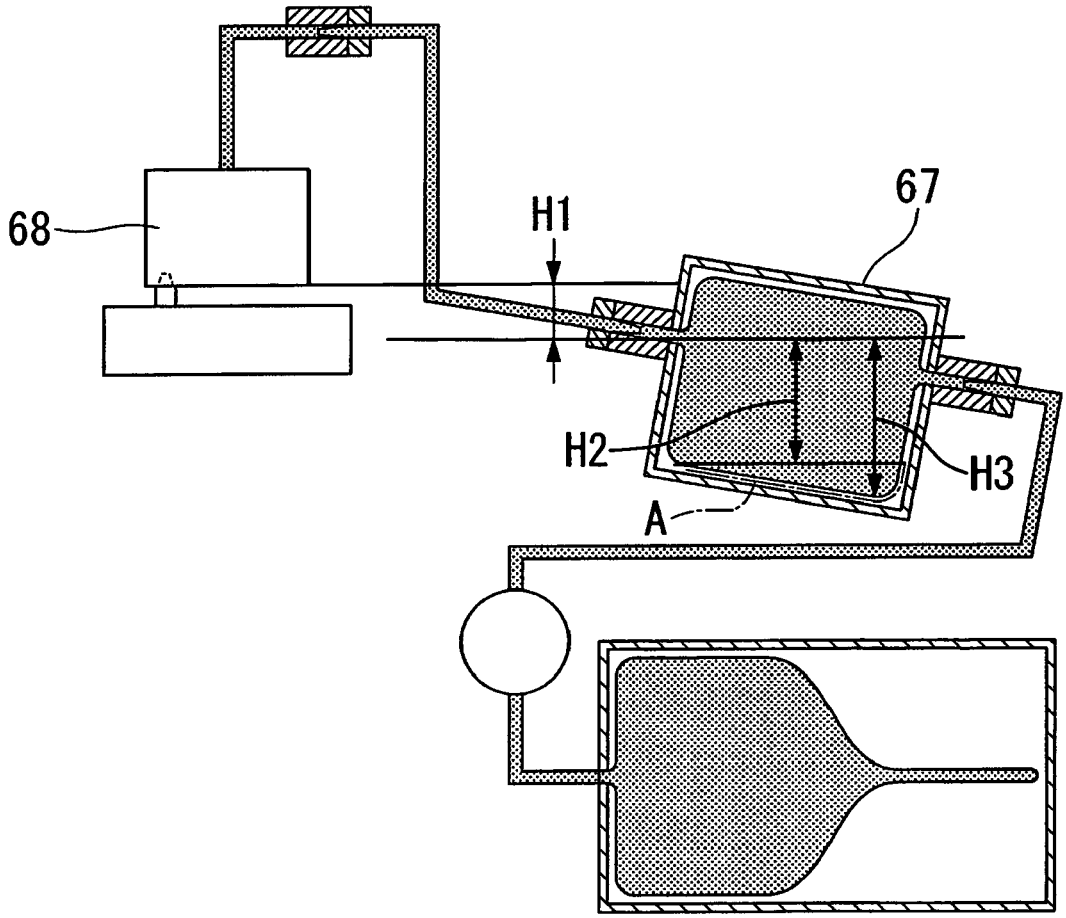
Fig.13 prior art
FIG. 13 is a configuration diagram of a conventional ink supplying system illustrated as a comparative example.

A conventional ink supplying system is illustrated in FIG. 13 as a comparative example. The dummy sub-tank 59 is not provided to the conventional ink supplying system.

Therefore, first, a sub-tank 67 is obliquely attached to a sub-tank attaching unit, the air is collected in an upper part of the sub-tank 67, and the air collected in the upper part is forcibly fed in the direction of an ink jet head 68 together with ink.

On the other hand, in this embodiment, as illustrated in FIG. 12, the ink supplying system 50 can prevent the inflow of the air, and hence the sub-tank 52 can be horizontally arranged. In the following description, the sub-tank 52 is horizontally arranged and a water head difference is controlled such that all ink in the sub-tank 52, i.e., ink in a water head difference H1+a water head difference H2 from the nozzle hole 58*a* can be used for printing. In the conventional ink supplying system illustrated in FIG. 13, if ink in a range up to the water head difference H1+the water head difference H2 from a nozzle hole can be used for printing in the same manner as this embodiment, the sub-tank 67 is obliquely attached, and hence an amount of unusable ink increases when compared with the sub-tank 52 horizontally attached. That is, ink in a range from a water head difference H3 to the water head difference H2 is the unusable ink. Consequently, in the conventional ink supplying system, even usable ink in the sub-tank 52 in the embodiment of the present invention is left in a range A illustrated in FIG. 13, i.e., the range from the water head difference H3 to the water head difference H2.

Therefore, in the supplying system according to this embodiment, more ink in the sub-tank can be used for printing.

Second Embodiment

Figure 14:
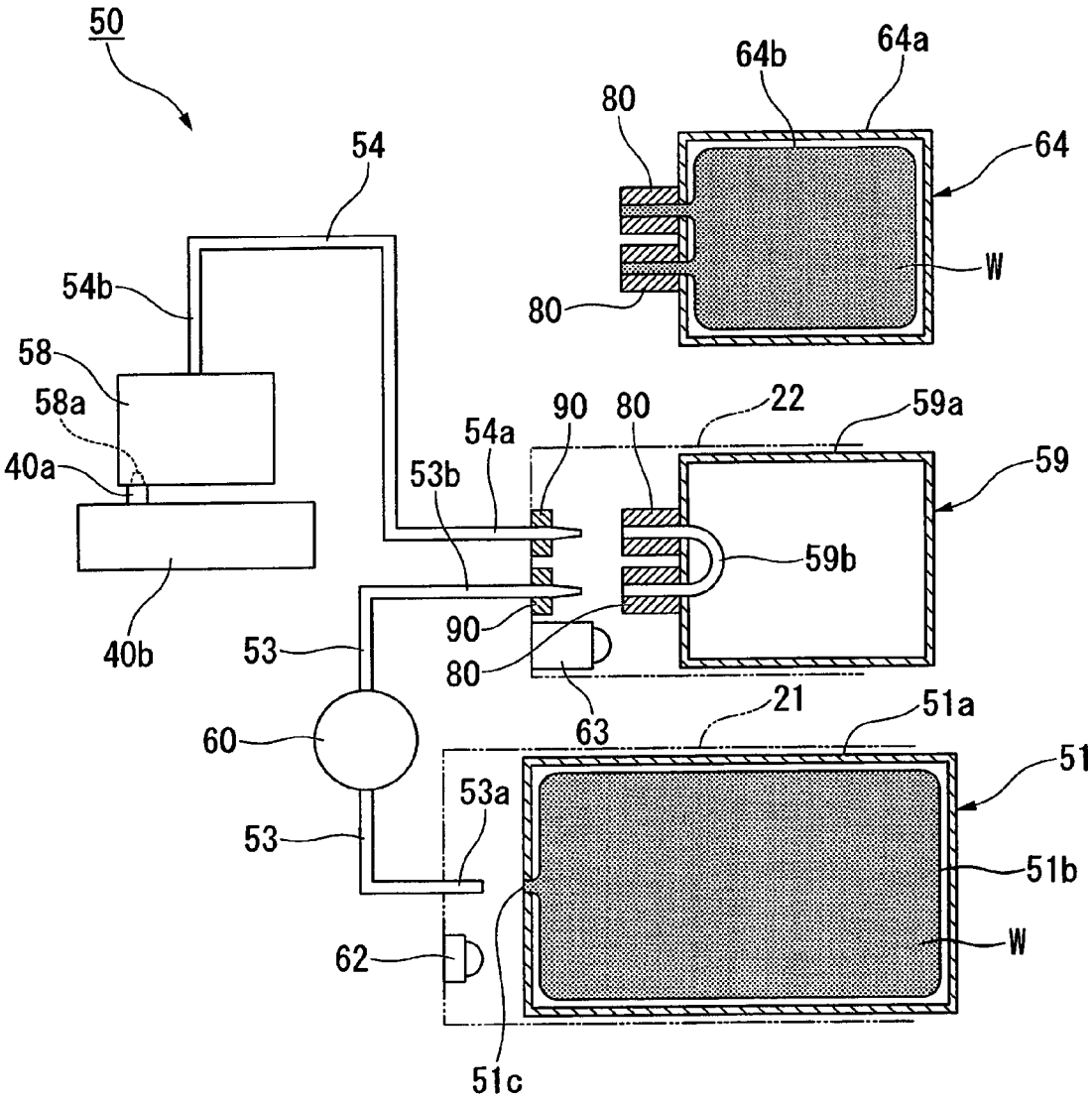
FIG. 14 is a configuration diagram of an ink supplying system of the ink jet printer according to the second embodiment of the present invention.

A second embodiment of the present invention is described below. FIG. 14 is a configuration diagram of an ink supplying system of an ink jet printer.

For convenience of description, in the second embodiment of the present invention, components same as those described in the first embodiment are denoted by the same reference symbols and description of the components is omitted.

The second embodiment is different from the first embodiment in two points. As a first difference, in the first embodiment, as illustrated in FIG. 4, the sub-tank 52 including the sub-tank bag 52*b* in which a vacuum is drawn in advance is used. On the other hand, in the second embodiment, as illustrated in FIG. 14, a sub-tank 64 filled with the ink W with the air therein being eliminated is used instead of the sub-tank 52.

That is, in the second embodiment, a sub-tank bag 64*b* provided to the sub-tank 64 is filled with the ink W with the air therein being eliminated. The inflow of the air is prevented by the two valve unit main bodies 80 provided to the sub-tank 64. The sub-tank 64 includes a sub-tank case 64*a* made of a resin molded in a box shape, the sub-tank bag 64*b* that is arranged in the inside of the sub-tank case 64*a* and filled with the ink W, and the two valve unit main bodies 80.

As a second difference, in the first embodiment, in order to keep the inside of the sub-tank bag 52*b* provided to the sub-tank 52 in a vacuum, a spring having an urging force strong enough for resisting the atmospheric pressure is used as the urging spring 84 provided to the valve unit main body 80. On the other hand, in the second embodiment, the sub-tank bag 64*b* is filled with the ink W, and hence the urging force of the urging spring 84 may be set weaker than the urging force in the first embodiment.

Figure 15:
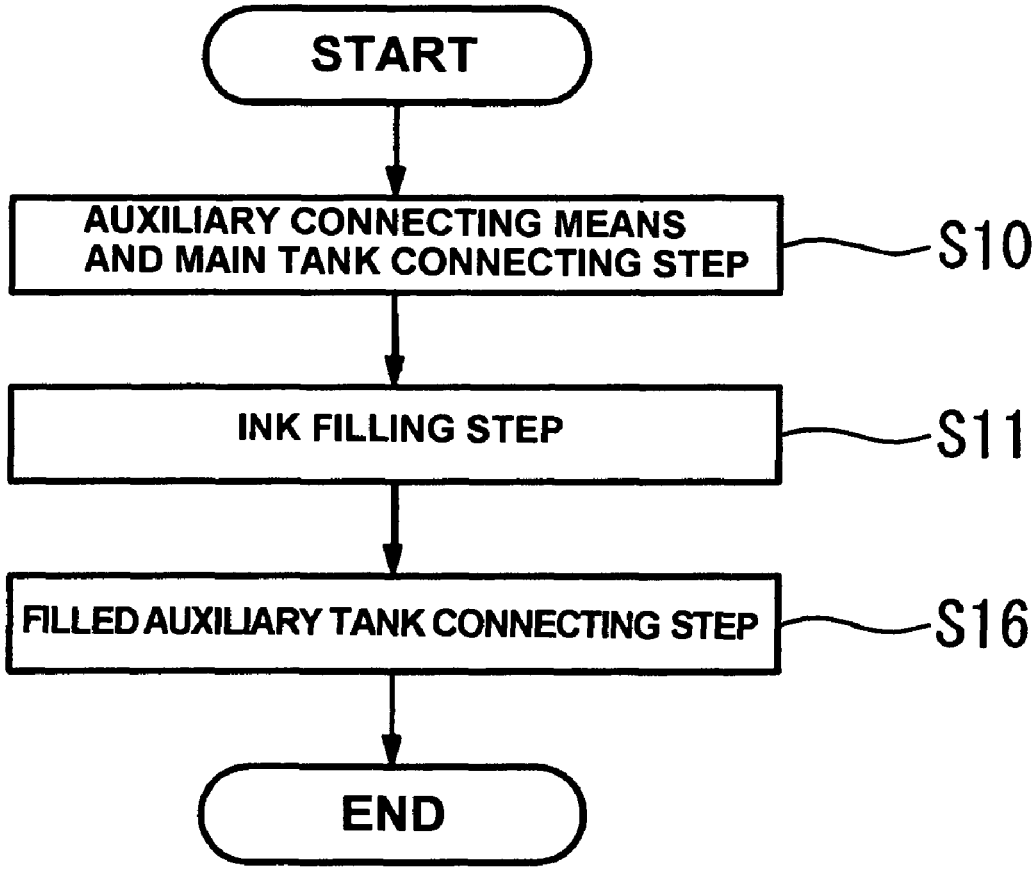
FIG. 15 is a flowchart of an ink supplying method for the ink supplying system of the ink jet printer according to the second embodiment of the present invention.
Figure 16:
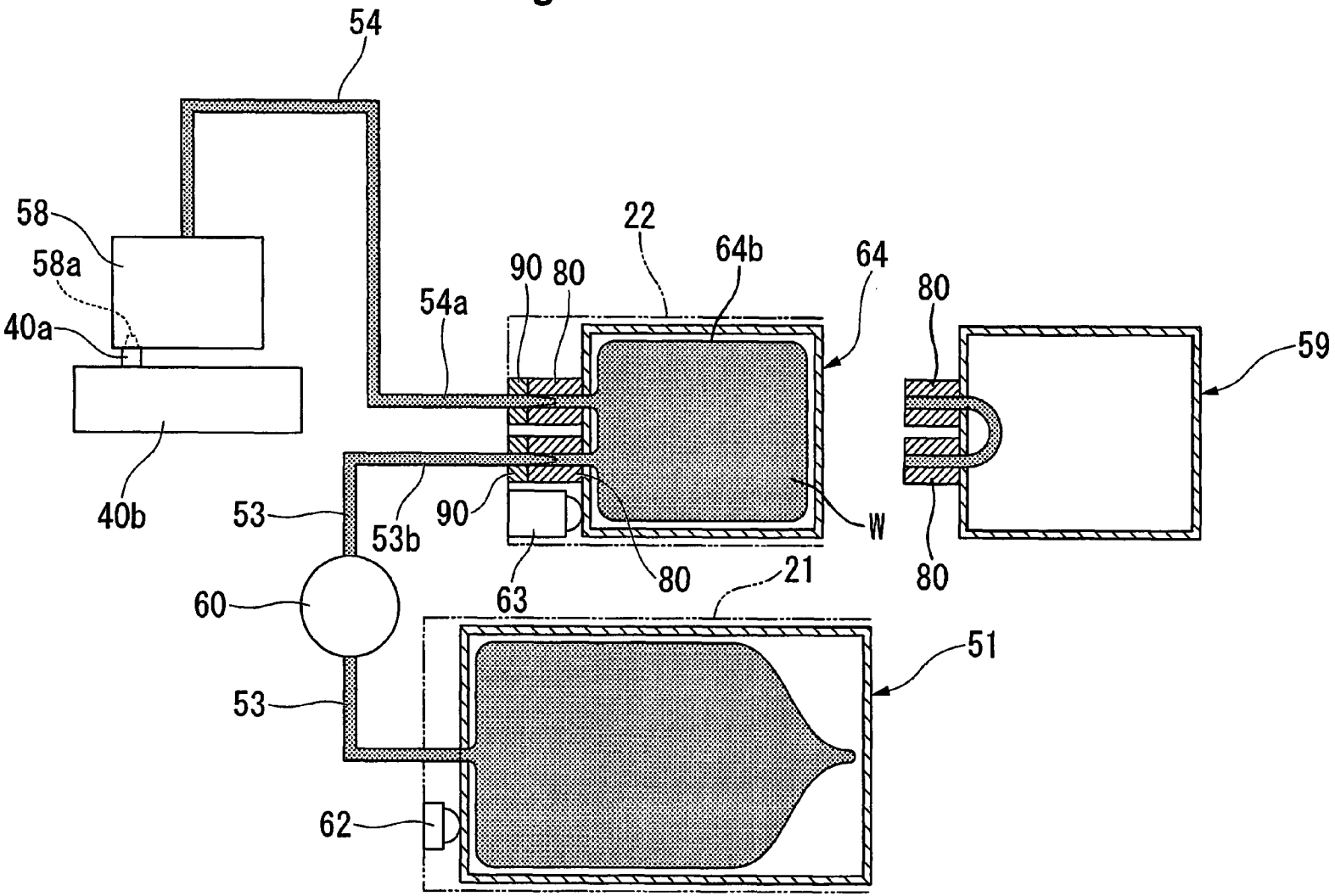
FIG. 16 is an explanatory diagram illustrating steps of the ink supplying method for the ink supplying system of the ink jet printer according to the second embodiment of the present invention.

Next, an ink supplying method in the ink jet printer according to the present invention is described. FIG. 15 is a flowchart of the ink supplying method. FIG. 16 is an explanatory diagram illustrating steps of the ink supplying method.

In the second embodiment, steps up to the ink filling step (Step S11) illustrated in FIG. 7 are the same as those in the first embodiment and only steps after that are different.

Figure 10:
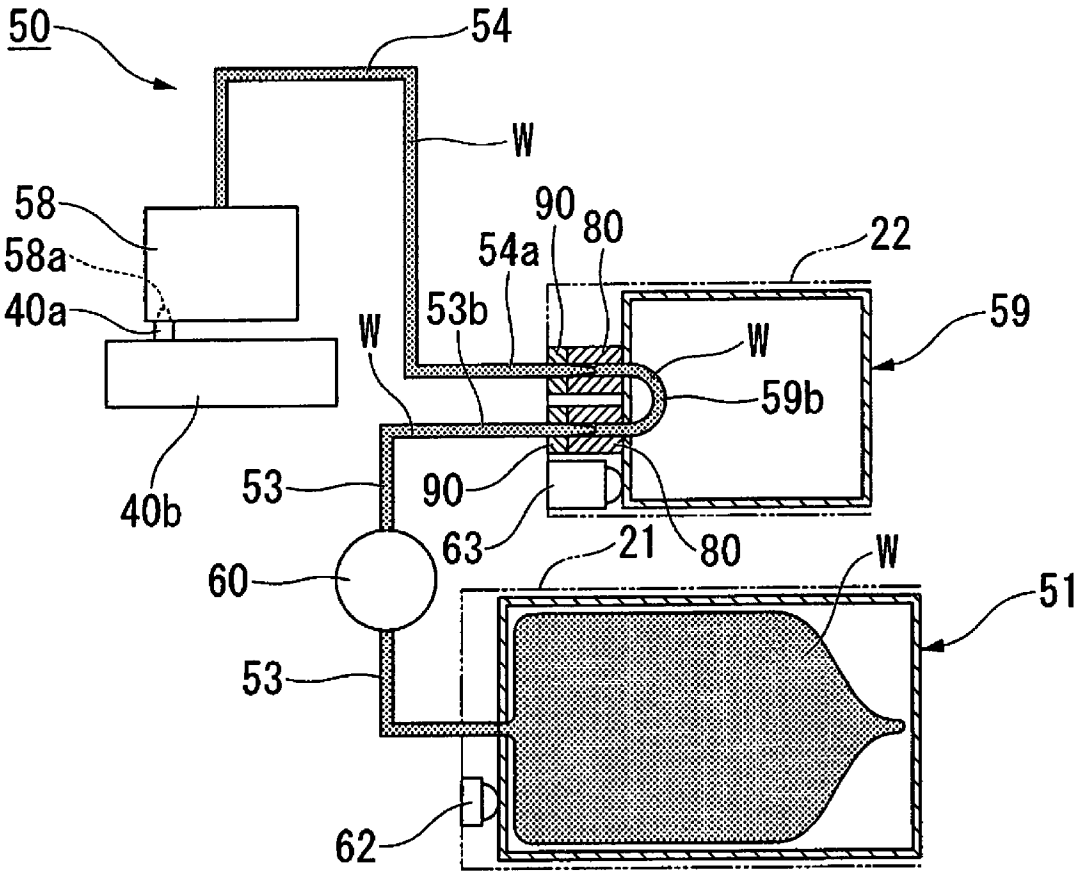
FIG. 10 is an explanatory diagram illustrating steps of the ink supplying method for the ink supplying system of the ink jet printer according to the first embodiment of the present invention.
Figure 11:
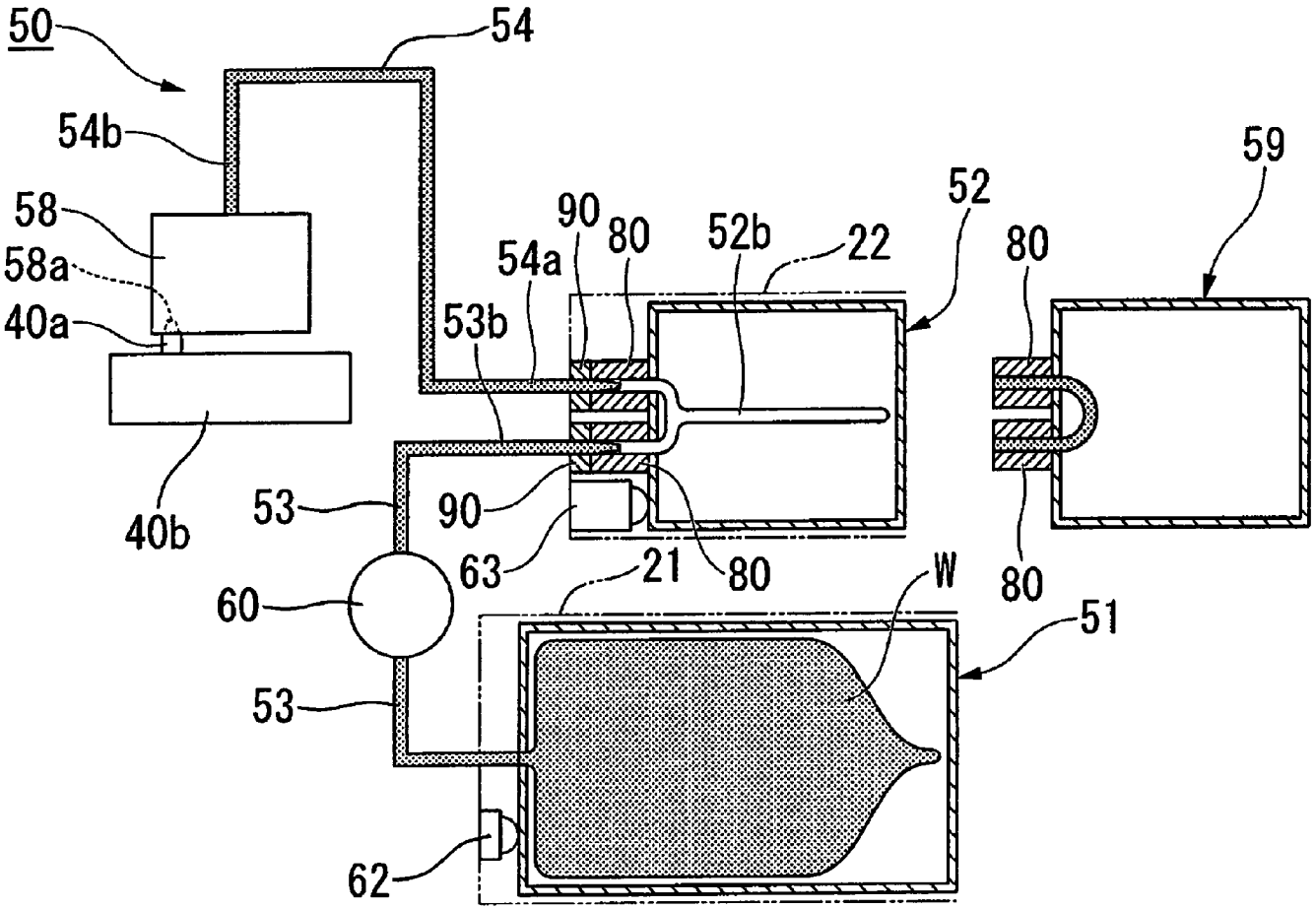
FIG. 11 is an explanatory diagram illustrating steps of the ink supplying method for the ink supplying system of the ink jet printer according to the first embodiment of the present invention.

As illustrated in FIG. 15, in a filled auxiliary tank connecting step (Step S16) performed following the ink filling step (Step S11), in the state illustrated in FIG. 10, the operator removes the dummy sub-tank 59 from the sub-tank attaching unit 22 and attaches the sub-tank 64 to the sub-tank attaching unit 22.

Consequently, the connection between each of the joint member 90 provided at the another end 53*b* of the first pipe 53 and the joint member 90 provided at the one end 54*a* of the second pipe 54 and the two valve unit main bodies 80 provided in the dummy sub-tank 59 is released. Moreover, the two joint members 90 and the two valve unit main bodies 80 provided to the sub-tank 64 filled with the ink W with the air therein being eliminated are connected to each other (see FIG. 16).

In this way, with the ink jet printer according to the second embodiment of the present invention, the sub-tank 64 filled with the ink W with the air therein being eliminated is used, and hence a step of filling the ink W stored in the cartridge 51 into the sub-tank 64 is unnecessary. Therefore, ink supply work can be performed in a short time.

The first embodiment and the second embodiment of the present invention have been described in detail with reference to the drawings. However, a specific configuration is not limited to the embodiments. Changes and the like of the configuration are provided to the present invention without departing from the spirit of the present invention.

For example, in the first embodiment, the operator performs the work for attaching the dummy sub-tank 59 to the sub-tank attaching unit 22, replacing the dummy sub-tank 59 attached to the sub-tank attaching unit 22 with the sub-tank 52, and attaching the cartridge 51 to the cartridge attaching unit 21. However, a sub-tank replacing device and a cartridge replacing device that automatically perform the work under the command of the ink-supply control unit 61 may be provided anew.

The same configuration can be adopted in the second embodiment as well.

In the first embodiment and the second embodiment, the dummy sub-tank 59 including the connection pipe 59*b* that directly connects the two valve unit main bodies 80 is used. However, instead of the connection pipe 59*b*, a dummy sub-tank bag that is sealed in sections thereof between the two valve unit main bodies 80, has a capacity smaller than that of the sub-tank tab 52*b*, and has flexibility may be used.

The capacity of the dummy sub-tank is smaller than that of the sub-tank 52, and hence the ink W can be easily filled into the dummy sub-tank 59. In a state in which the dummy sub-tank is connected to the another end 53*b* of the first pipe 53 and the one end 45*a* of the second pipe 54, i.e., a state in which the dummy sub-tank bag is used instead of the connection pipe 59*b* of the dummy sub-tank 59 illustrated in FIG. 9, the ink W stored in the cartridge 51 is led from the first pipe 53. Then, it is possible to fill the ink W into the first pipe 53, the auxiliary connecting means, the second pipe 54, and the ink jet head 58 while preventing the air from entering the same.

The sub-tank detecting means 63 and the cartridge detecting means 62 provided to the ink supplying system 50 in the first embodiment and the second embodiment may be removed. This is because, even if the sub-tank detecting means 63 and the cartridge detecting means 62 are not present, it is possible to detect the sub-tank 52 and the dummy sub-tank 59 attached to the sub-tank attaching unit 22 and the cartridge 51 attached to the cartridge attaching unit 21 by the operator.

In the description of the first embodiment and the second embodiment, the respective steps are described on the assumption that, before the ink jet printer 1 is started to be used, the cartridge 51 is not attached to the cartridge attaching unit 21 and the dummy sub-tank 59 is not attached to the sub-tank attaching unit 22.

However, when the cartridge 51 is attached to the cartridge attaching unit 21 and the dummy sub-tank 59 is attached to the sub-tank attaching unit 22 in advance before the ink jet printer 1 is started to be used, it is sufficient to omit the auxiliary connecting means and main tank connecting step (Step S10) and perform the ink filling step (Step S11) and subsequent steps.

In the first embodiment and the second embodiment, the suction pump 40*b* is used in order to fill the ink W stored in the cartridge 51 into the first pipe 53, the connection pipe 59*b*, the second pipe 54, and the ink jet head 58 of the ink supplying system 50 attached with the dummy sub-tank 59. However, the cartridge bag 51*b* has flexibility, and hence the ink W may be filled into the first pipe 53, the connection pope 59*b*, the second pipe 54, and the ink jet head 58 by pressing the cartridge case 51*a* in which the ink W is stored without using the suction pump 40*b*.

In the second embodiment, the two valve unit main bodies 80 are attached to one side of the sub-tank case 64*a* of the sub-tank 64.

Figure 17A:
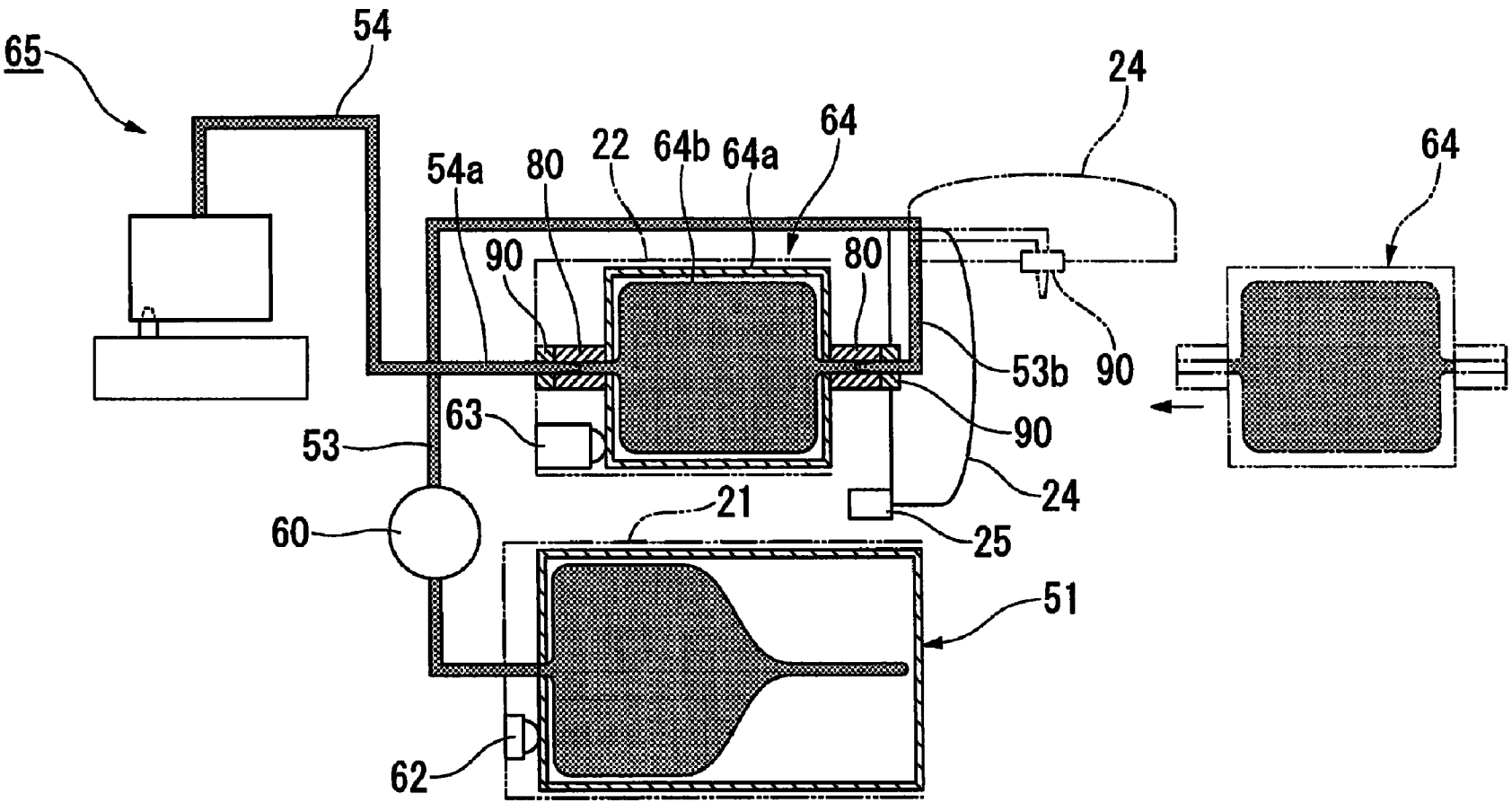
FIG. 17A is an explanatory diagram illustrating a modification of the embodiment of the ink jet printer according to the present invention.

However, as illustrated in FIG. 17A, the valve unit main bodies 80 may be attached to both sides of the sub-tank case 64*a*, respectively.

In this case, a lid 24 openably and closably attached to the sub-tank attaching unit 22 is provided to the sub-tank attaching unit 22. The joint member 90 provided at the another end 53*b* of the first pipe 53 is attached to the lid 24.

When the sub-tank 64 is attached to the sub-tank attaching unit 22, the sub-tank 64 is connected to the one end 54*a* of the second pipe 54. When the lid 24 is closed, the sub-tank 64 is connected to the another end 53*b* of the first pipe 53. In this way, the sub-tank 64 is set in an ink supplying system 65.

When the lid 24 is opened, the connection between the sub-tank 64 and the another end 53*b* of the first pipe 53 is released. Therefore, it is preferable that an open and close sensor 25 that detects opening and closing of the lid 24 and issues warming be provided.

Figure 17B:
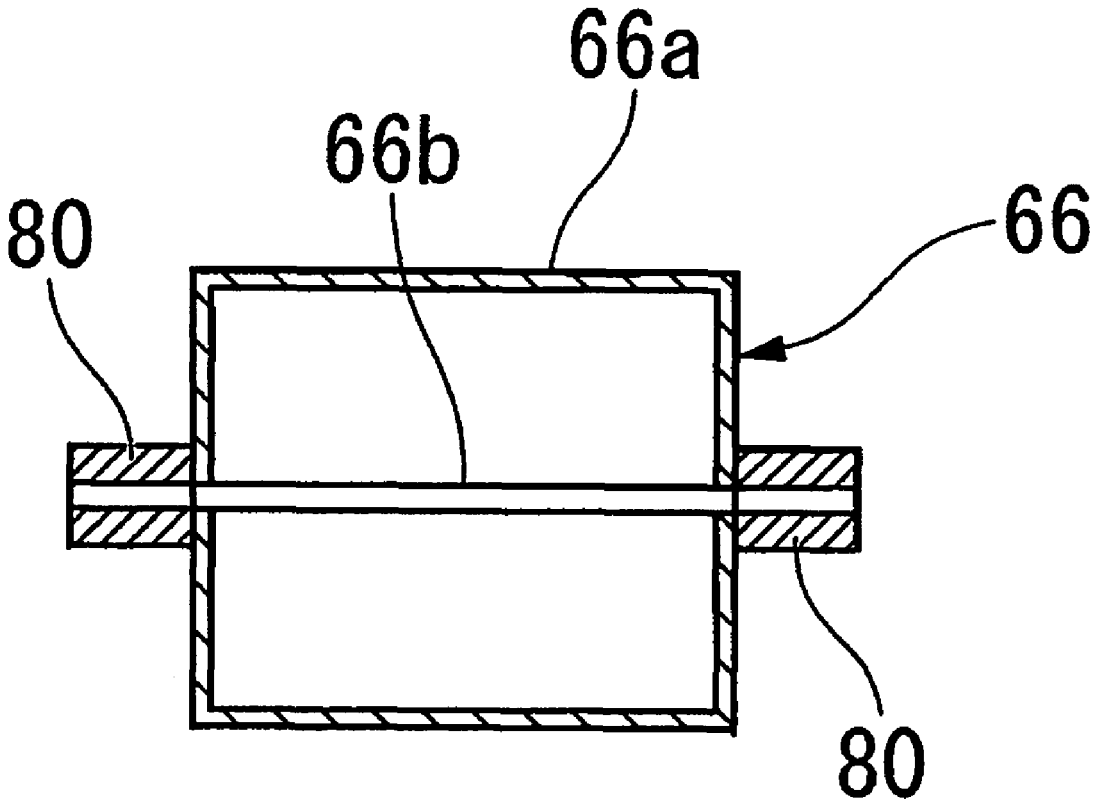
FIG. 17B is an explanatory diagram of a dummy sub-tank used in the modification of the embodiment of the ink jet printer according to the present invention.

As illustrated in FIG. 17B, in a dummy sub-tank 66, the two valve unit main bodies 80 are attached to both sides of a dummy sub-tank case 66*a* made of a resin molded in a box shape, respectively. A connection pipe 66*b* has a shape of a substantially straight pipe.

The same configuration can be adopted in the first embodiment as well.

Third Embodiment

Figure 18A:
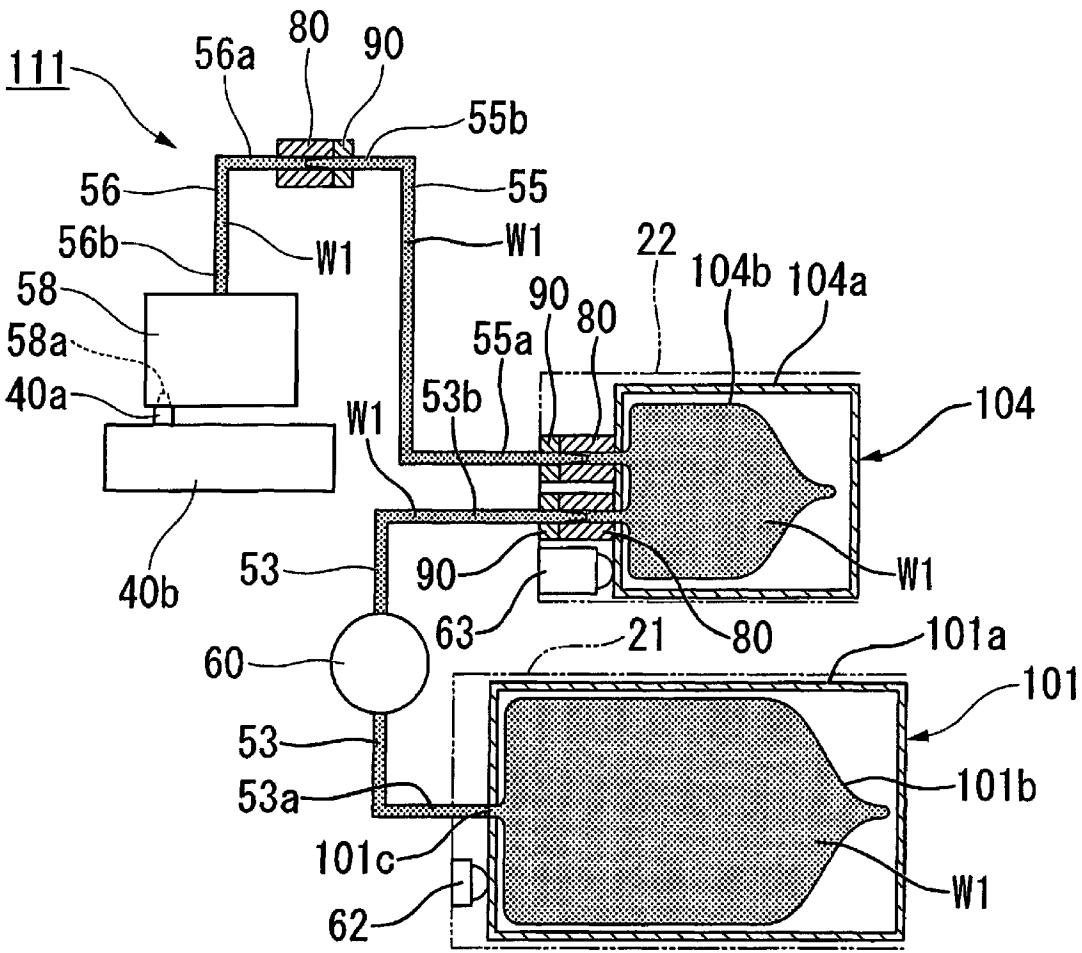
FIG. 18A is a configuration diagram of an ink supplying system of the ink jet printer according to a third embodiment of the present invention.
Figure 18B:
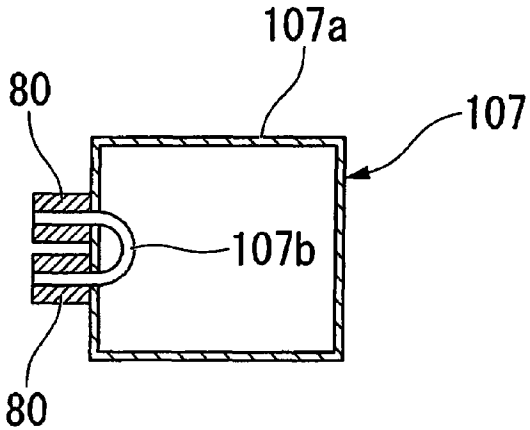
FIG. 18B is an explanatory diagram for describing a first dummy sub-tank 107 used in the third embodiment of the present invention.
Figure 18C:
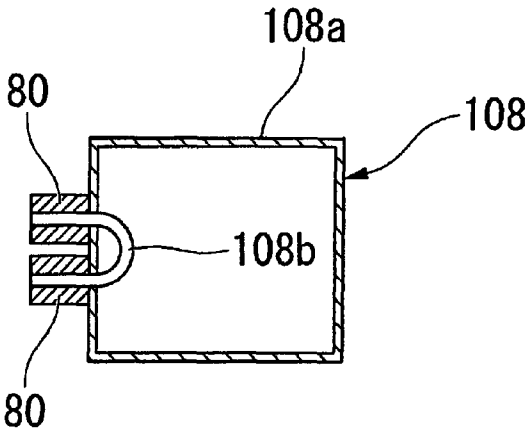
FIG. 18C is an explanatory diagram for describing a second dummy sub-tank 108 used in the third embodiment of the present invention.
Figure 18D:
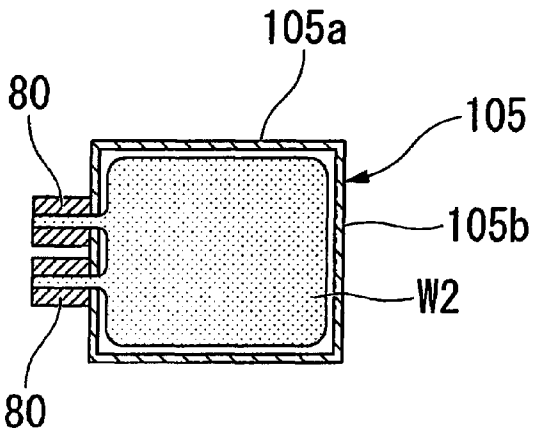
FIG. 18D is an explanatory diagram for describing a second sub-tank used in the third embodiment of the present invention.
Figure 18E:
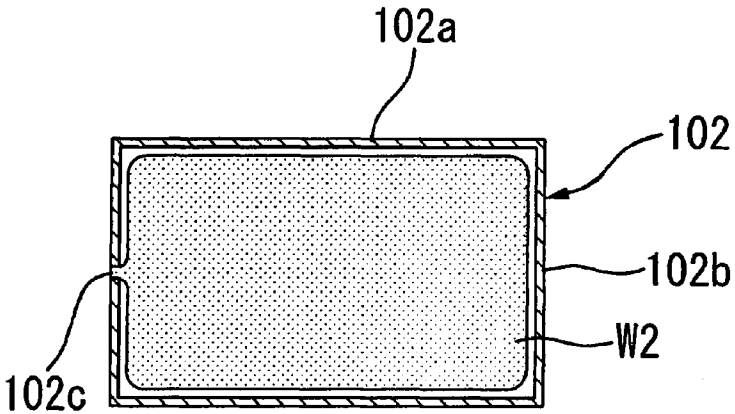
FIG. 18E is an explanatory diagram for describing a second cartridge used in the third embodiment of the present invention.

A third embodiment of the present invention is described below. FIG. 18A is a configuration diagram of an ink supplying system of an inkjet printer. FIG. 18B is an explanatory diagram for describing a first dummy sub-tank 107 used in the third embodiment of the present invention. FIG. 18C is an explanatory diagram for describing a second dummy sub-tank 108 used in the third embodiment of the present invention. FIG. 18D is an explanatory diagram for describing a second sub-tank used in the third embodiment of the present invention. FIG. 18E is an explanatory diagram for describing a second cartridge used in the third embodiment of the present invention.

For convenience of description, in the third embodiment of the present invention, components same as those described in the second embodiment are denoted by the same reference symbols and description of the components is omitted.

With an ink supplying system 111 according to this embodiment, ink ejected from the ink jet head 58 can be changed from first ink W1 to second ink W2 by a method described below. The first ink W1 and the second ink W2 may be different in color or may be the same in color and different in solvent.

The ink supplying system 111 is different from the ink supplying system 50 according to the second embodiment illustrated in FIG. 14 in two points described below.

First, in the ink supplying system 111, the first dummy sub-tank 107 and the second dummy sub-tank 108 are used instead of the dummy sub-tank 59 used in the ink supplying system 50.

The first dummy sub-tank 107 includes a dummy sub-tank case 107*a* made of a resin molded in a box shape same as the shape of a sub-tank case 104*a*, two valve unit main bodies 80, and a U-shaped connection pipe 107*b* made of a resin or the like that directly connects the two valve unit main bodies 80.

Similarly, the second dummy sub-tank 108 includes a dummy sub-tank case 108*a* made of a resin molded in a box shape same as the shape of the sub-tank case 104*a*, two valve unit main bodies 80, and a U-shaped connection pipe 108*b* made of a resin or the like that directly connects the two valve unit main bodies 80.

Second, in the ink supplying system 111, instead of the second pipe 54 provided to the ink supplying system 50, there are provided a first divided pipe 55 having one end 55*a* connected to a first sub-tank 104 and having the another end 55*b* at which the joint member 90 is provided, and a second divided pipe 56 having one end 56*a* at which the valve unit main body 80 is provided and having the another end 56*b* connected to the ink jet head 58.

The valve unit main body 80 provided at the one end 56*a* of the second divided pipe 56 and the joint member 90 provided at the another end 56*b* of the first divided pipe 55 correspond to the air lead-in valve in claims.

In the third embodiment, the first sub-tank 104 and a second sub-tank 105 are used instead of the sub-tank 64 used in the second embodiment.

The first sub-tank 104 is different from the sub-tank 64 in that, whereas filled ink is the ink W in the sub-tank 64, the filled ink is the first ink W1 in the first sub-tank 104. On the other hand, the second sub-tank 105 is different from the sub-tank 64 in that, whereas filled ink is the ink W in the sub-tank 64, the filled ink is the second ink W2 in the second sub-tank 105.

That is, the first sub-tank 104 includes the sub-tank case 104*a* made of a resin molded in a box shape, a sub-tank bag 104*b* that is arranged in the inside of the sub-tank case 104 and filled with the first ink W1, and the two valve unit main bodies 80.

Similarly, the second sub-tank 105 includes the sub-tank case 105*a* made of a resin molded in a box shape, a sub-tank bag 105*b* that is arranged in the inside of the sub-tank case 105 and filled with the second ink W2, and the two valve unit main bodies 80.

In the third embodiment, a first cartridge 101 and a second cartridge 102 are used instead of the cartridge 51 used in the second embodiment.

The first cartridge 101 is different from the cartridge 51 in that, whereas stored ink is the ink W in the cartridge 51, the stored ink is the first ink W1 in the first cartridge 101. On the other hand, the second cartridge 102 is different from the cartridge 51 in that, whereas stored ink is the ink W in the cartridge 51, the stored ink is the second ink W2 in the second cartridge 102.

That is, the first cartridge 101 includes a cartridge case 101*a* made of a resin molded in a box shape, a cartridge bag 101*b* that is arranged in the inside of the cartridge case 101*a*, eliminates the air in the inside, and stores the first ink W1, and a cartridge connecting section 101*c* serving as an inlet and an outlet of the first ink W1 to and from the cartridge bag 101*b*.

Similarly, the second cartridge 102 includes a cartridge case 102*a* made of a resin molded in a box shape, a cartridge bag 102*b* that is arranged in the inside of the cartridge case 102*a*, eliminates the air in the inside, and stores the second ink W2, and a cartridge connecting section 102*c* serving as an inlet and an outlet of the second ink W2 to and from the cartridge bag 102*b*.

As in the embodiments described above, the sub-tank bag 104*b*, the sub-tank bag 105*b*, the cartridge bag 101*b*, and the cartridge bag 102*b* are made of a thin polyethylene bag or the like, on the surface of which aluminum is deposited, and has flexibility. The ink can be pushed out by pressing the cartridge bags with a hand.

Figure 19:
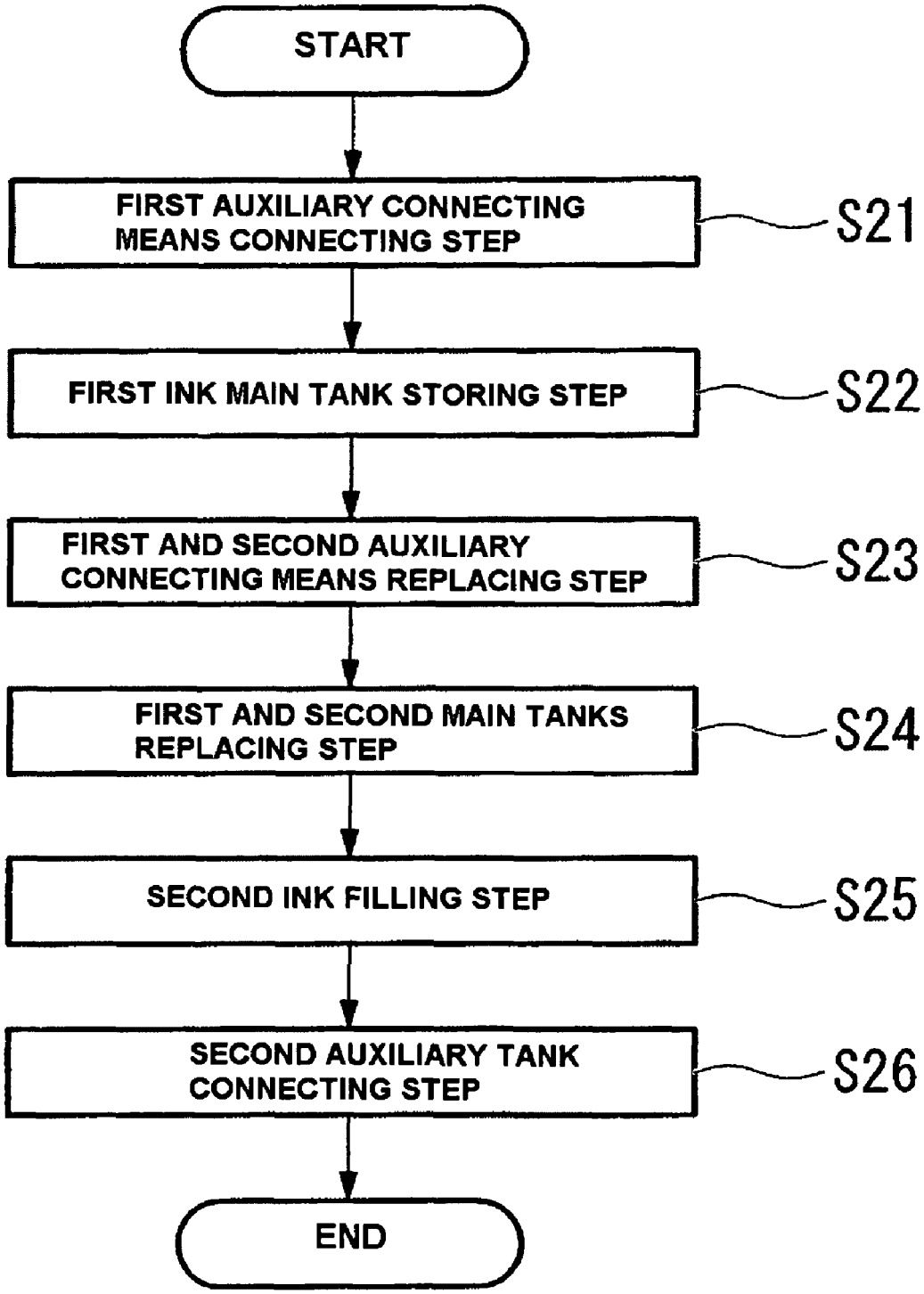
FIG. 19 is a flowchart of an ink supplying method for the ink supplying system of the ink jet printer according to the third embodiment of the present invention.
Figure 20:
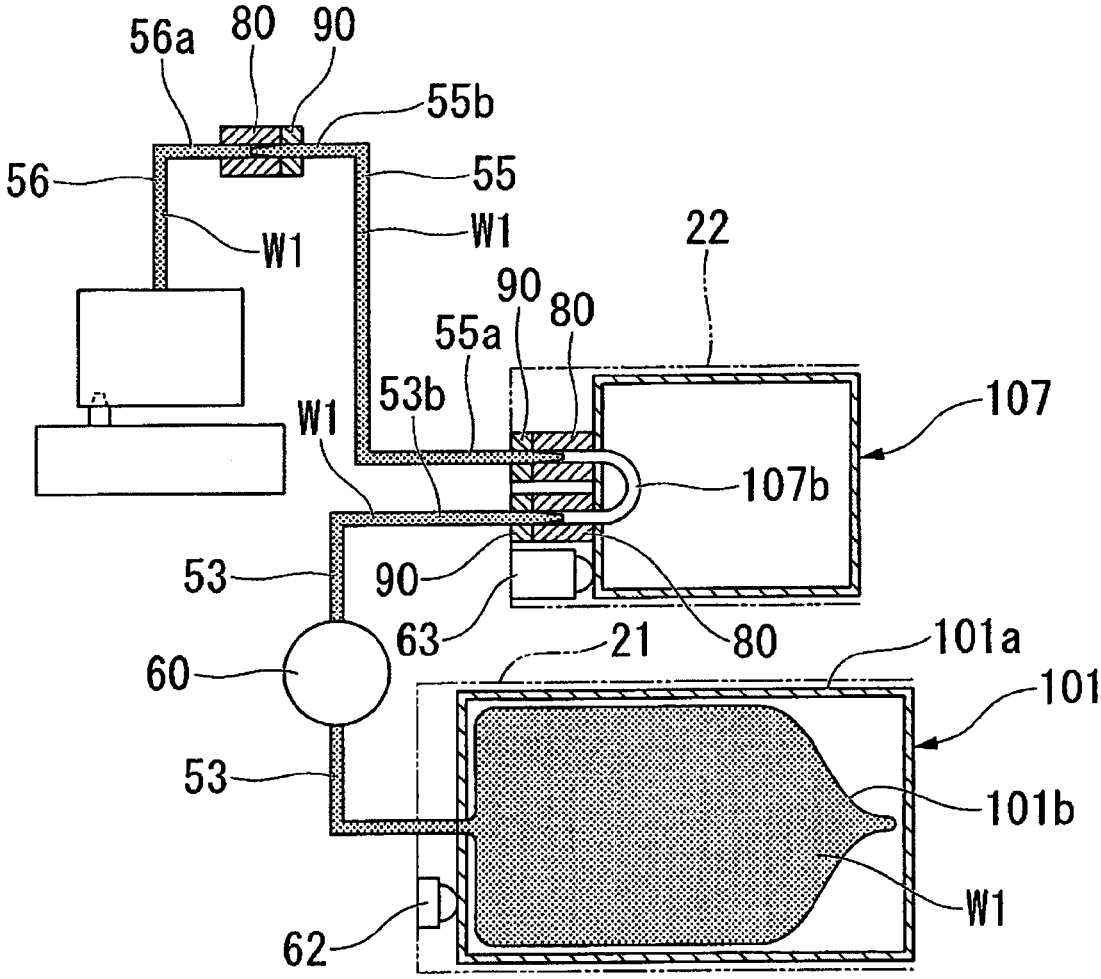
FIG. 20 is a flowchart of an ink supplying method for the ink supplying system of the ink jet printer according to the third embodiment of the present invention.

Next, an ink supplying method in the ink jet printer according to the present invention is described. FIG. 19 is a flowchart of the ink supplying method. FIGS. 20 to 24 are explanatory diagrams illustrating respective steps of the ink supplying step.

Note that, in replacing the ink from the first ink W1 to the second ink W2, as illustrated in FIGS. 18A to 18E, each of the joint member 90 provided at the another end 53*b* of the first pipe 53 and the joint member 90 provided at the one end 55*a* of the first divided pipe 55 and the two valve unit main bodies 80 provided in the first sub-tank 104 are connected. Further, the first cartridge 101 is connected to the one end 53*a* of the first pipe 53. The joint member 90 provided at the another end 55*b* of the first divided pipe 55 and the valve unit main body 80 provided at the one end 56*a* of the second divided pipe 56 are connected. Further, the first pipe 53, the first divided pipe 55, the second divided pipe 56, and the ink jet head 58 are filled with the first ink W1.

When the ink control device 61*a* of the ink-supply control unit 61 receives a command from the CPU 46*a* of the main control unit 46 to replace the ink, first, in a first auxiliary connecting means connecting step (Step S21), the ink control device 61*a* instructs the supply-pump driving means 61*c* to set the supply pump 60 in a closed state.

An operator of the ink jet printer releases the connection between each of the joint member 90 provided at the another end 53*b* of the first pipe 53 and the joint member 90 provided at the one end 55*a* of the first divided pipe 55 and the two valve unit main bodies 80 provided in the first sub-tank 104. Then, the operator connects the two joint members 90 and the two valve unit main bodies 80 provided in the first dummy sub-tank 107 (see FIG. 20).

The ink control device 61*a* detects, with the sub-tank detecting means 63, that the first dummy sub-tank 107 is attached to the sub-tank attaching unit 22. The ink control device 61*a* further detects, with the cartridge detecting means 62, that the first cartridge 101 is attached to the cartridge attaching unit 21. The ink control device 61*a* shifts to Step S22.

Next, in a first ink main tank storing step (Step S22), the ink control device 61*a* instructs the supply-pump driving means 61*c* to set the supply pump 60 in an open state.

Figure 21:
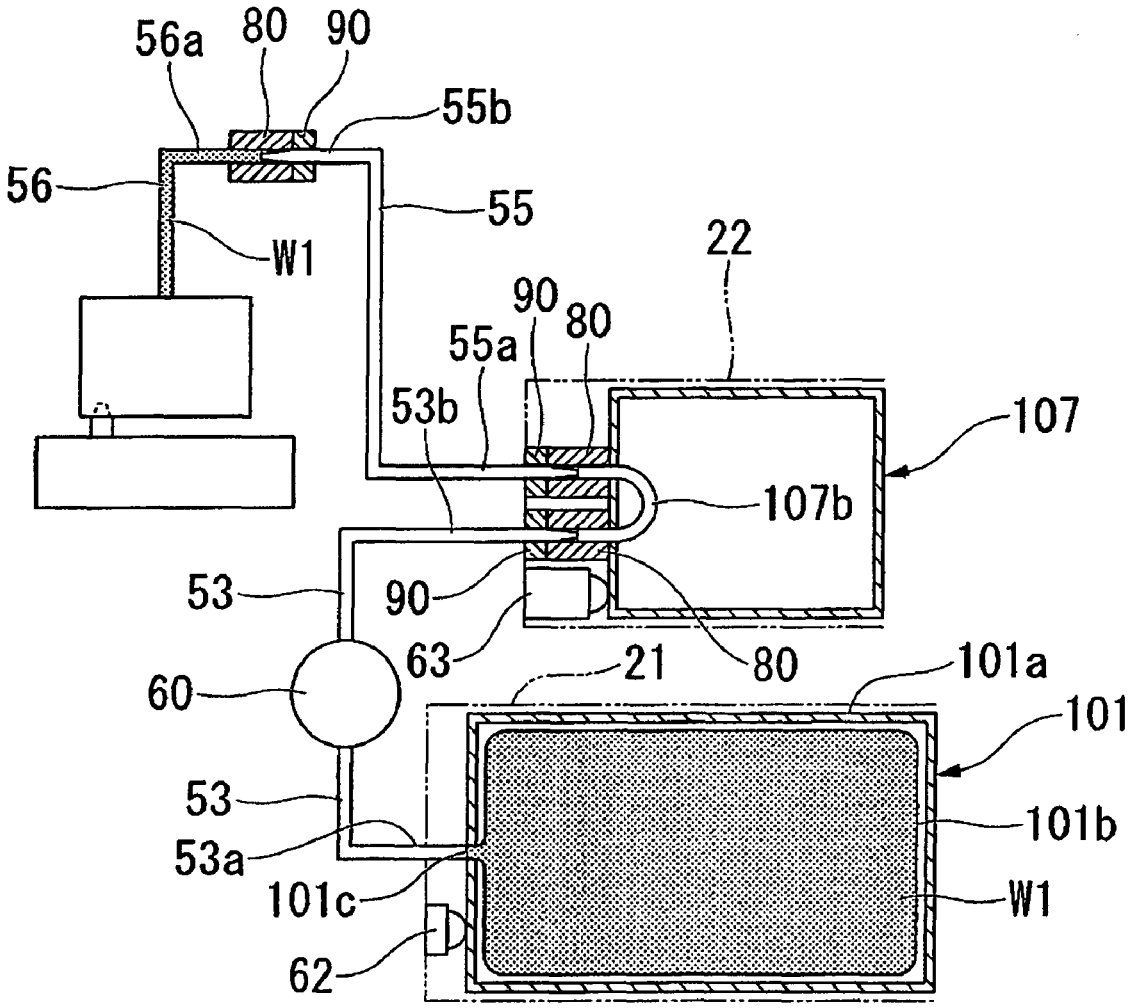
FIG. 21 is a flowchart of an ink supplying method for the ink supplying system of the ink jet printer according to the third embodiment of the present invention.

The operator temporarily releases the connection between the joint member 90 provided at the another end 55*b* of the first divided pipe 55 and the valve unit main body 80 provided at the one end 56*a* of the second divided pipe 56, leads the air into the first divided pipe 55 from the joint member 90, and shifts to Step S23 (see FIG. 21).

Then, at least a part of the first ink W1 in the first divided pipe 55 and the first pipe 53 is stored in the cartridge bag 101*b* of the first cartridge 101.

An amount of the first ink W1 stored in the cartridge bag 101*b* is, at the maximum, a total of capacities of the first divided pipe 55 and the first pipe 53. An amount of ink discarded during ink replacement can be more effectively controlled.

Next, in a first and second auxiliary connecting means replacing step (Step S23), the ink control device 61*a* instructs the supply-pump driving means 61*c* to set the supply pump 60 in the closed state.

The operator releases the connection between each of the joint member 90 provided at the another end 53*b* of the first pipe 53 and the joint member 90 provided at the one end 55*a* of the first divided pipe 55 and the two valve unit main bodies 80 provided in the first dummy sub-tank 107. Then, the operator connects the two joint members 90 and the two valve unit main bodies 80 provided in the second dummy sub-tank 108.

Figure 22:
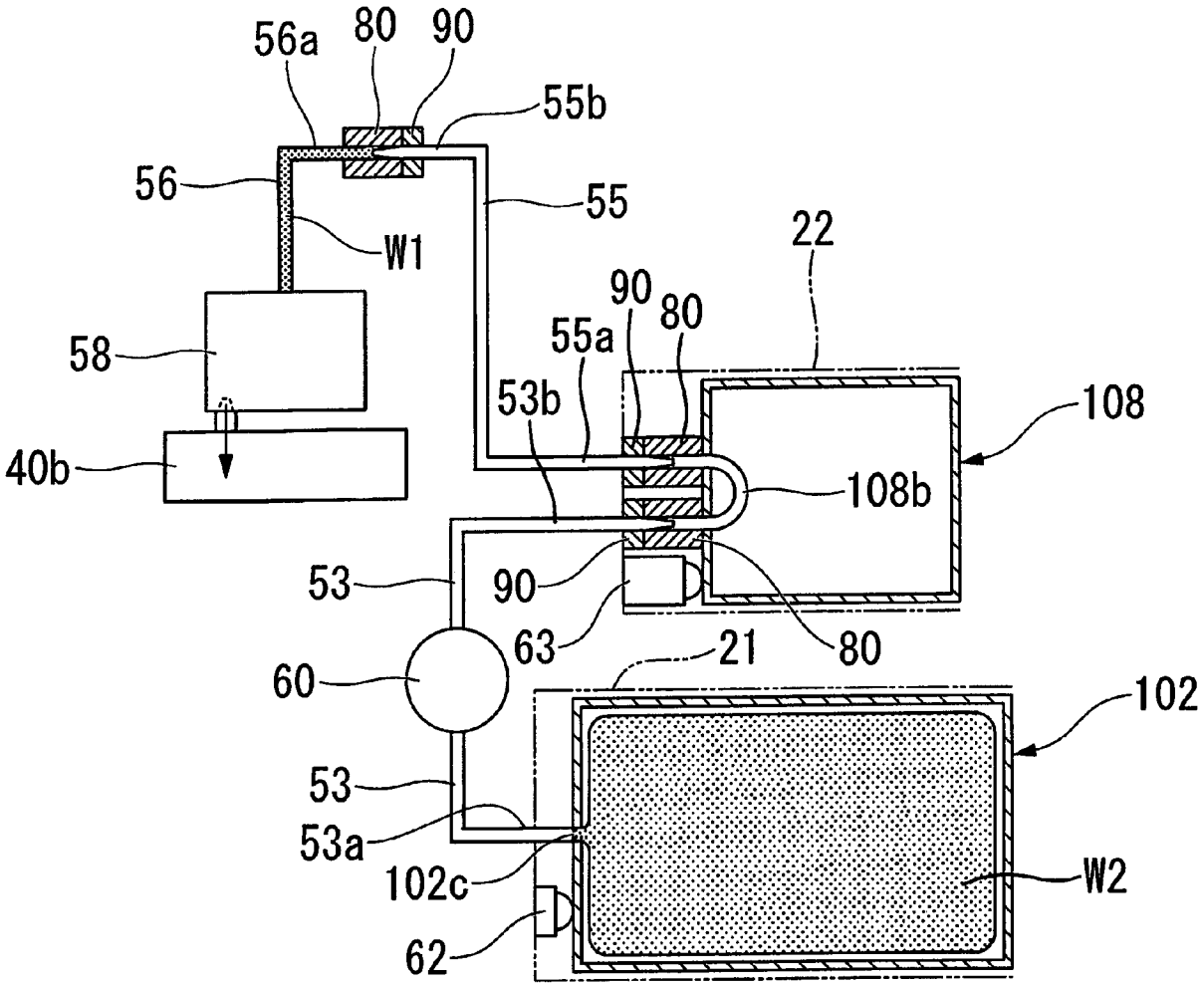
FIG. 22 is a flowchart of an ink supplying method for the ink supplying system of the ink jet printer according to the third embodiment of the present invention.
Figure 23:
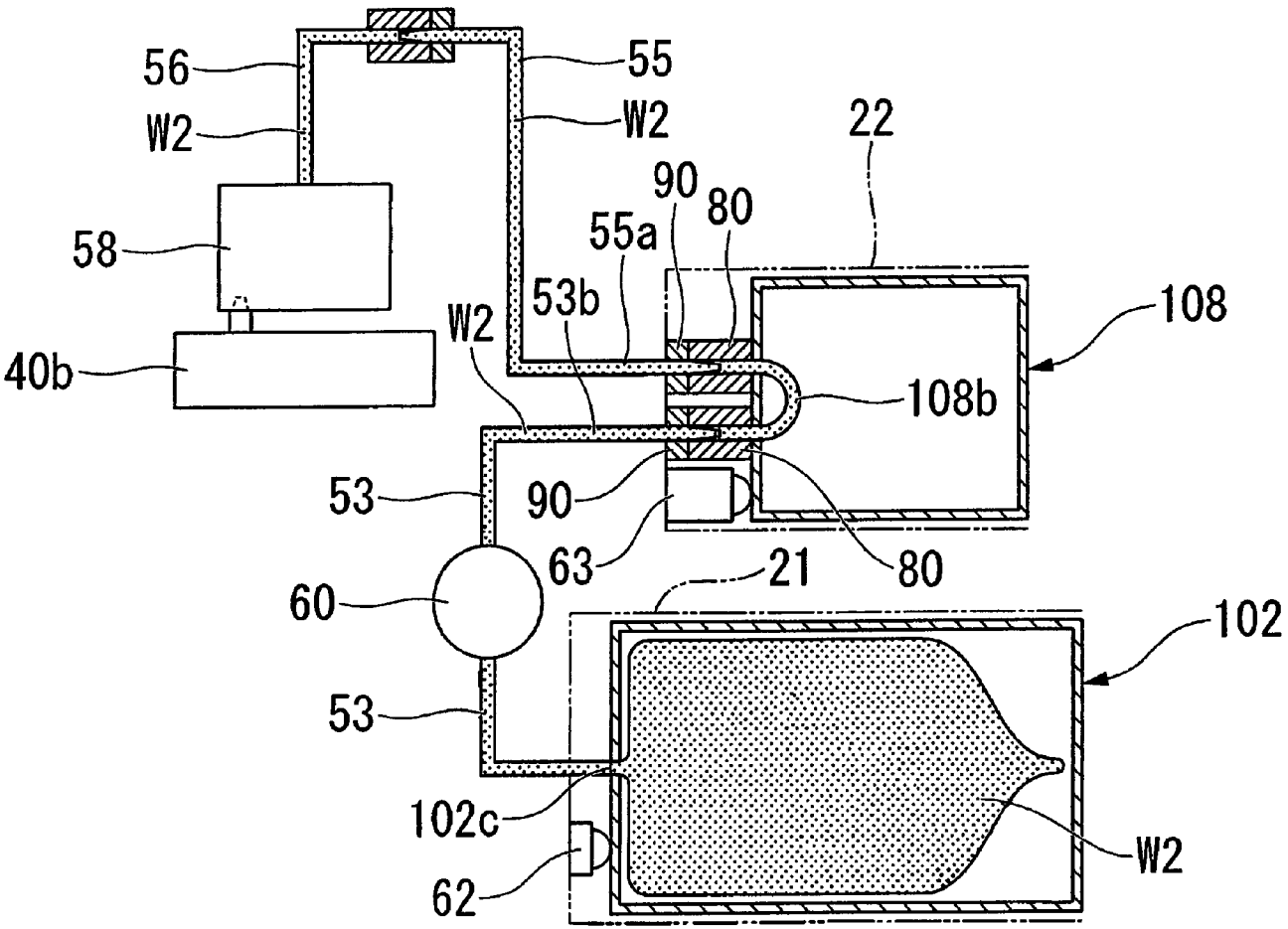
FIG. 23 is a flowchart of an ink supplying method for the ink supplying system of the ink jet printer according to the third embodiment of the present invention.
Figure 24:
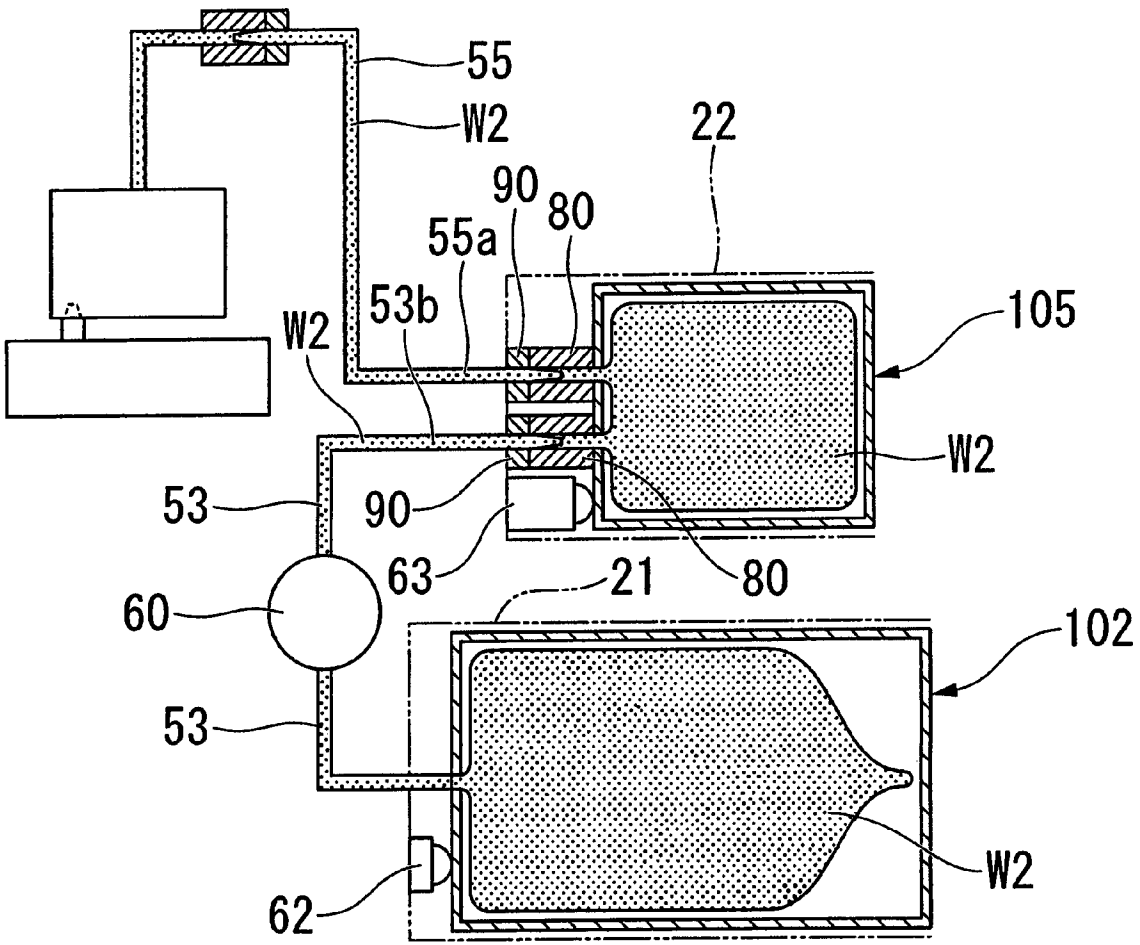
FIG. 24 is a flowchart of an ink supplying method for the ink supplying system of the ink jet printer according to the third embodiment of the present invention.

Moreover, in a first and second main tanks replacing step (Step S24), the operator releases the connection between the one end 53*a* of the first pipe 53 and the first cartridge 101, and connects the one end 53*a* of the first pipe 53 and the second cartridge 102 (see FIG. 22). Then, the operator sends a signal representing the end of Step S24 to the ink control device 61*a* via the input and output panel 47 and shifts to Step S25.

Next, in a second ink filling step (Step S25), when the ink control device 61*a* detects that Step S24 ends, the ink control device 61*a* instructs the supply-pump driving means 61*c* to set the supply pump 60 in the open state. Moreover, the ink control device 61*a* drives the suction pump 40*b*, fills the second ink W2 stored in the second cartridge 102 into the first pipe 53, a connection pipe 108*b* of the second dummy sub-tank 108, the first divided pipe 55, the second divided pipe 56, and the ink jet head 58, stops the suction pump 40*b*, and shifts to Step S26 (see FIG. 23).

The connection pipe 108*b* is configured to directly connect the two valve unit main bodies 80, and hence the air in the connection pipe 108*b* tends to leak when the second ink W2 is filled. Therefore, when the second ink W2 stored in the second cartridge 102 is filled, the air in the first pipe 53, the connection pipe 108*b*, the first divided pipe 55, the second divided pipe 56, and the ink jet head 58 is pushed out in this order. It is possible to fill the first pipe 53, the connection pipe 59*b*, the second pipe 54, and the ink jet head 58 with the second ink W2 without letting the air to flow into the same.

When the second ink W2 is filled, the first ink W1 stored in the first pipe 53, the first divided pipe 55, the second divided pipe 56, and the ink jet head 58 is discharged from the ink jet head 58 side and discarded. At least a part of the first ink W1 in the first divided pipe 55 is stored in the first cartridge 101 in advance, and hence an amount of the first ink W1 to be discarded can be controlled.

Finally, in a second auxiliary tank connecting step (Step S26), the ink control device 61*a* instructs the supply-pump driving means 61*c* to set the supply pump 60 in the closed state.

The operator releases the connection between each of the joint member 90 provided at the another end 53*b* of the first pipe 53 and the joint member 90 provided at the one end 55*a* of the first divided pipe 55 and the two valve unit main bodies 80 provided to the second dummy sub-tank 108. Then, the operator connects the two joint members 90 and the two valve unit main bodies 80 provided to the second sub-tank 105 (see FIG. 24).

At least a part of the first ink W1 in the first divided pipe 55 is stored in the first cartridge 101 in advance, and hence it is possible to control an amount of the first ink W1 mixed in the second ink W2 when the second ink W2 is supplied into the first divided pipe 55. Therefore, it is possible to reduce the mixing of the first ink W1 in replacing the first ink W1 to the second ink W2, and to more surely replace ink.

In this embodiment, as in the first embodiment and the second embodiment, the work for attaching the first dummy sub-tank 107 to the sub-tank attaching unit 22, attaching the first cartridge 101 to the cartridge attaching unit 21, and temporarily releasing the connection between the valve unit main bodies 80 and the joint members 90 may be automatically performed under the command of the ink-supply control unit 61.

Further, in this embodiment, as in the first embodiment and the second embodiment, the cartridge bag 102*b* and the like has flexibility, and hence the second ink W2 may be filled by pressing the cartridge case 102*a* without using the suction pump 40*b*.

Further, in this embodiment, as illustrated in FIG. 17A in the first embodiment and the second embodiment, for example, the two valve unit main bodies 80 may be attached to both sides of the sub-tank case 104*a* of the first sub-tank 104, respectively.

Further, the sub-tank detecting means 63 and the cartridge detecting means 62 provided to the ink supplying system 111 in this embodiment may be removed. This is because, even if the sub-tank detecting means 63 and the cartridge detecting means 62 are not present, it is possible to detect the first sub-tank 104 and the first dummy sub-tank 107 attached to the sub-tank attaching unit 22 and to detect the first cartridge 101 attached to the cartridge attaching unit 21 by the operator.

First Modification

A first modification is described below.

For convenience of description, in the first modification, components same as those described in the embodiments of the present invention are denoted by the same reference symbols and description of the components is omitted.

Figure 25:
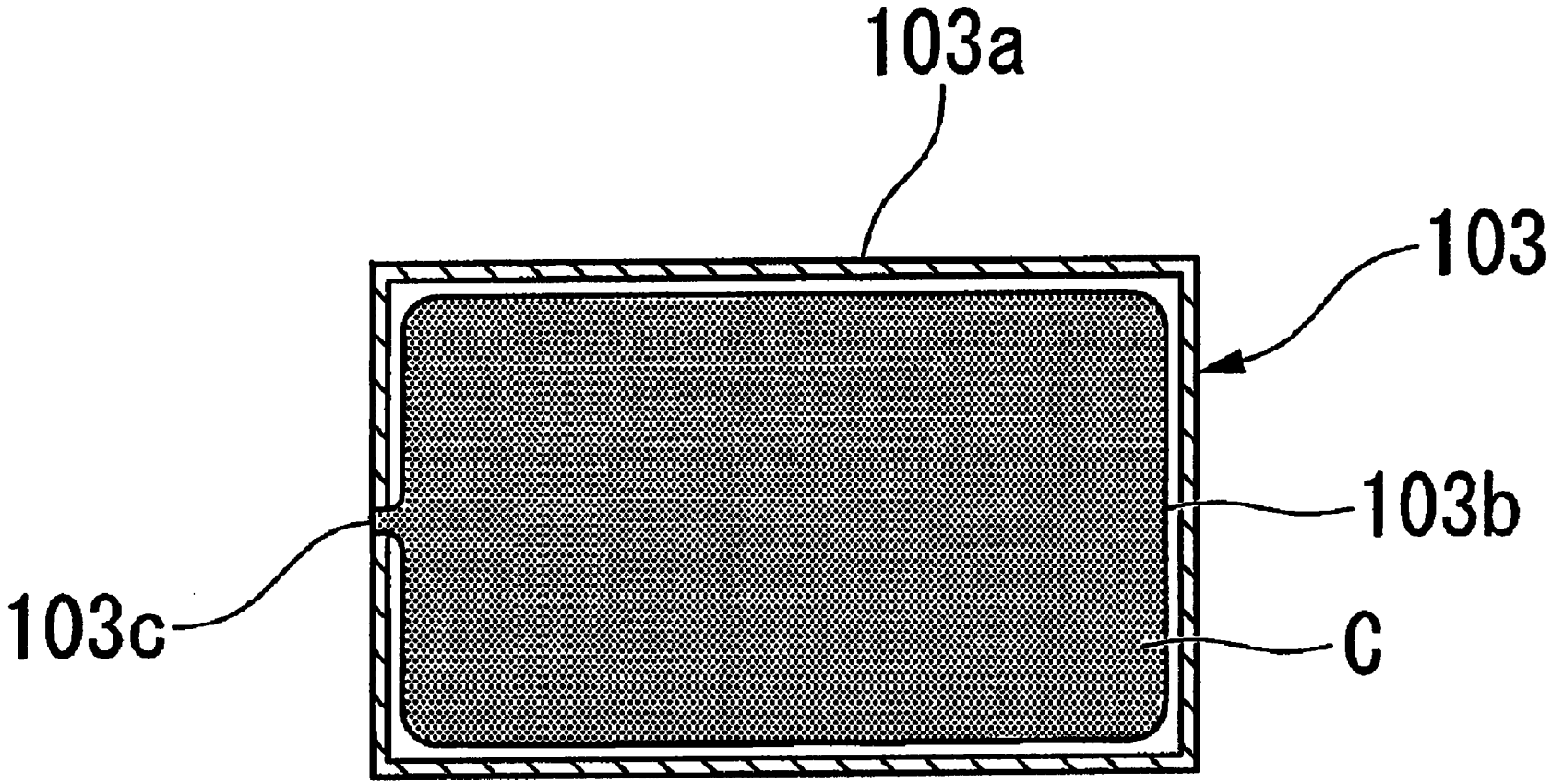
FIG. 25 is an explanatory diagram of an ink supplying system of the ink jet printer according to the first modification of the present invention.

An ink supplying system according to this modification is the same as the ink supplying system 111 according to the third embodiment illustrated in FIGS. 18A to 18E. Moreover, the first sub-tank 104, the second sub-tank 105, the first cartridge 101, the second cartridge 102, the first dummy sub-tank 107, and the second dummy sub-tank 108 illustrated in FIGS. 18A to E and a cleaning cartridge 103 illustrated in FIG. 25 are used.

That is, the cleaning cartridge 103 includes a cartridge case 103*a* made of resin molded in a box shape, a cartridge bag 103*b* that is arranged in the inside of the cartridge case 103*a* and stores cleaning liquid C for cleaning ink, and a cartridge connecting section 103*c* serving as an inlet and an outlet of the cleaning liquid C to and from the cartridge bag 103*b*.

With the ink supplying system according to this modification, ink ejected from the ink jet head 58 can be replaced, while being cleaned, from the first ink W1 to the second ink W2 by a method described below.

Figure 26:
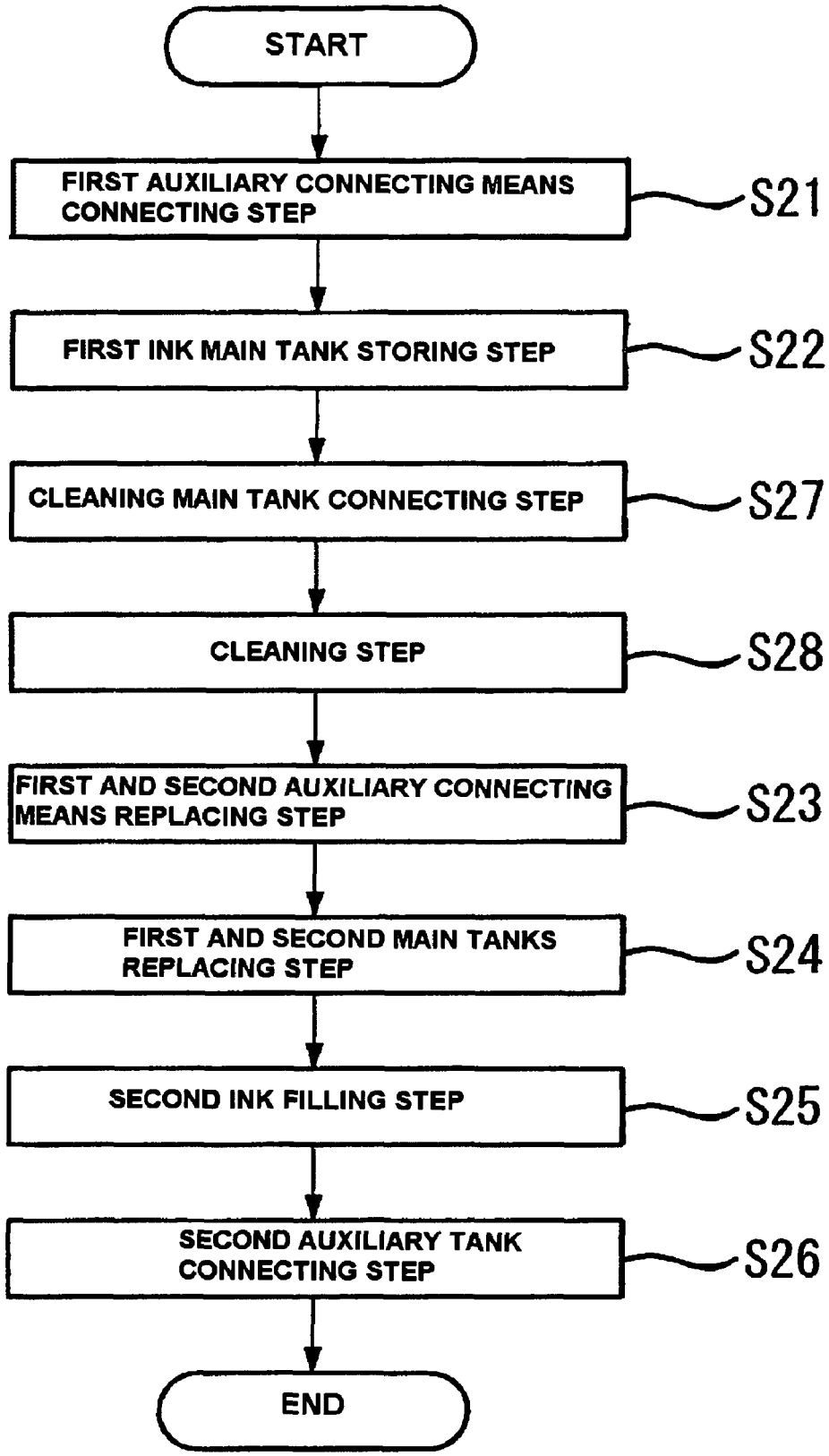
FIG. 26 is a flowchart of an ink supplying method for the ink supplying system of the ink jet printer according to the first modification of the present invention.
Figure 27:
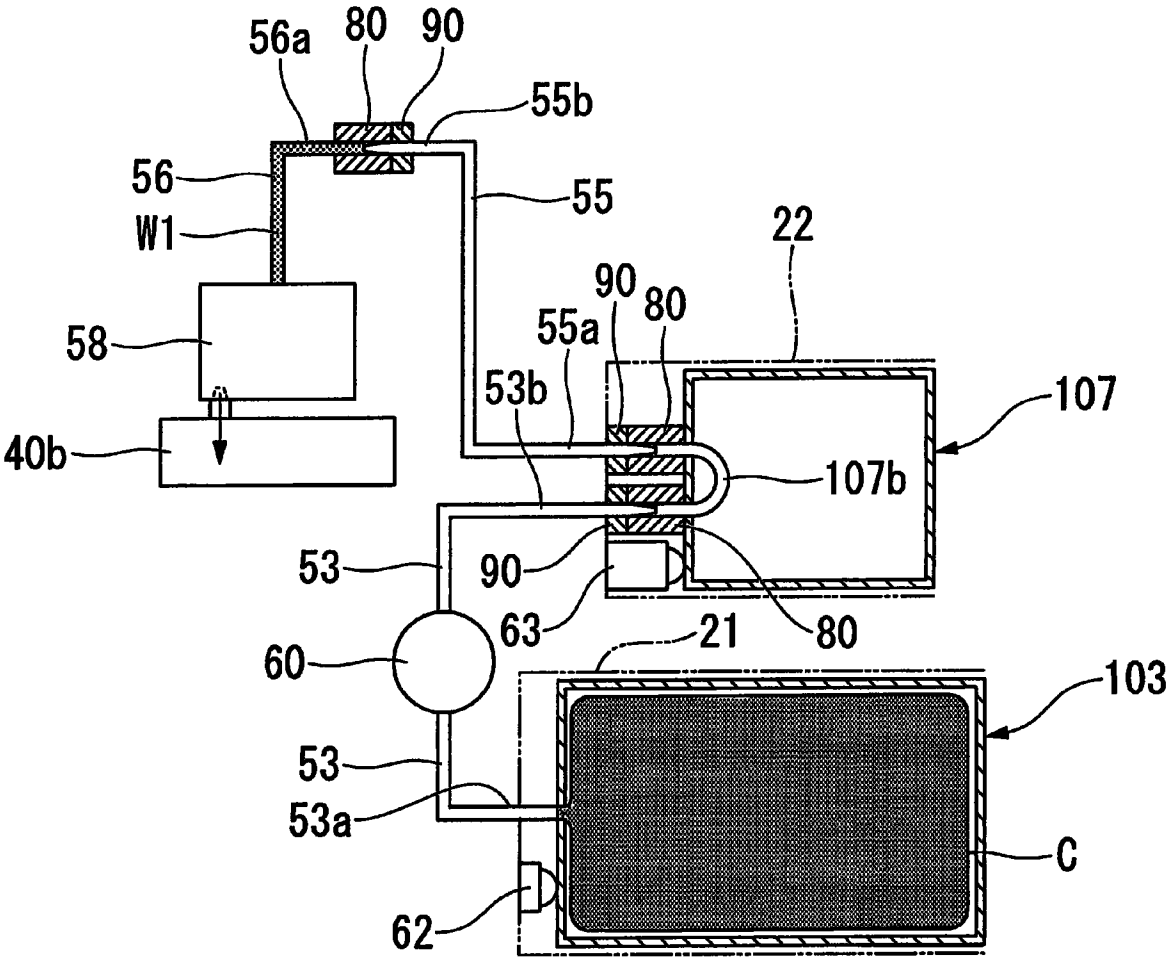
FIG. 27 is an explanatory diagram illustrating steps of the ink supplying method for the ink supplying system of the ink jet printer according to the first modification of the present invention.
Figure 28:
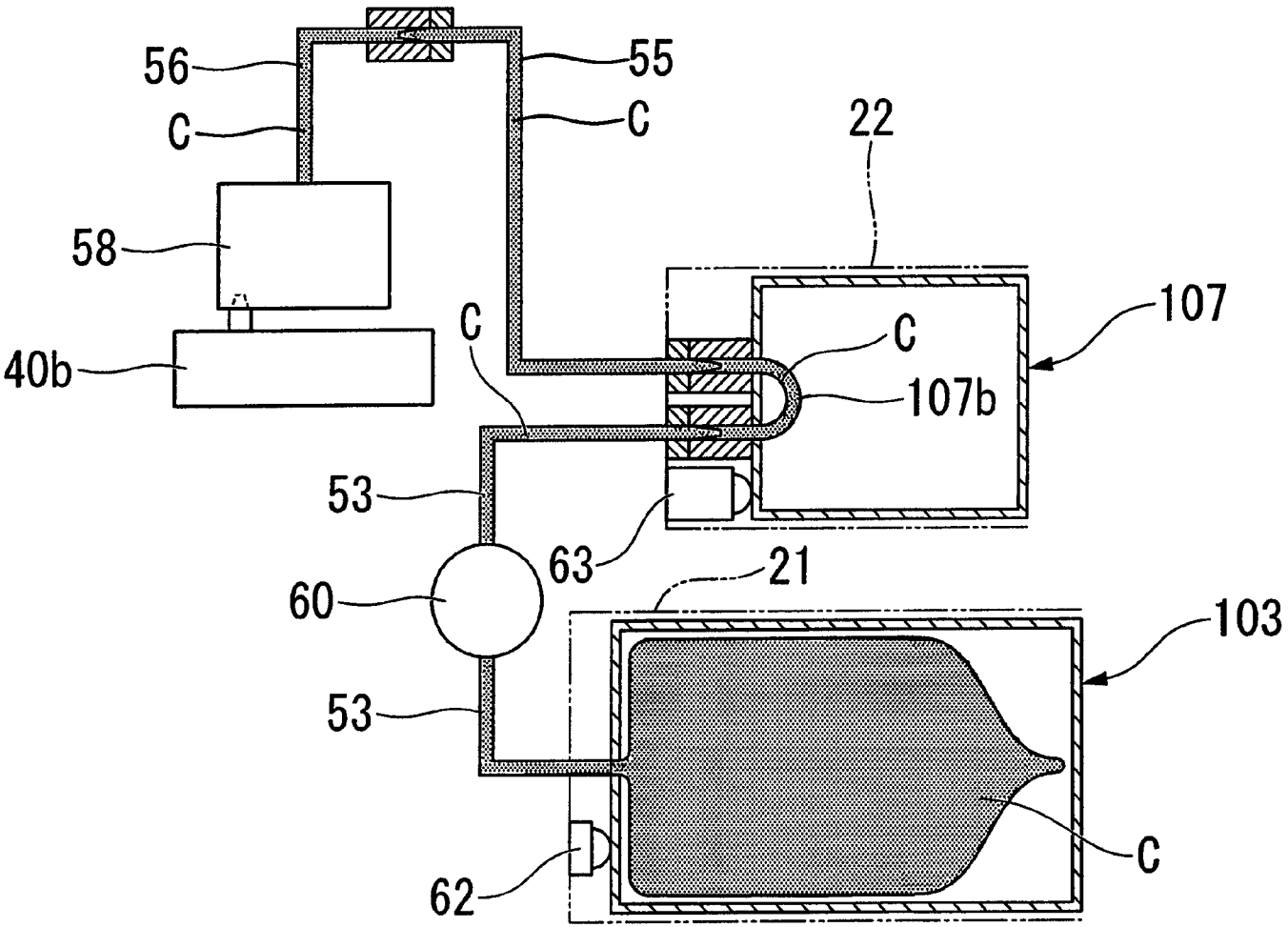
FIG. 28 is an explanatory diagram illustrating steps of the ink supplying method for the ink supplying system of the ink jet printer according to the first modification of the present invention.
Figure 29:
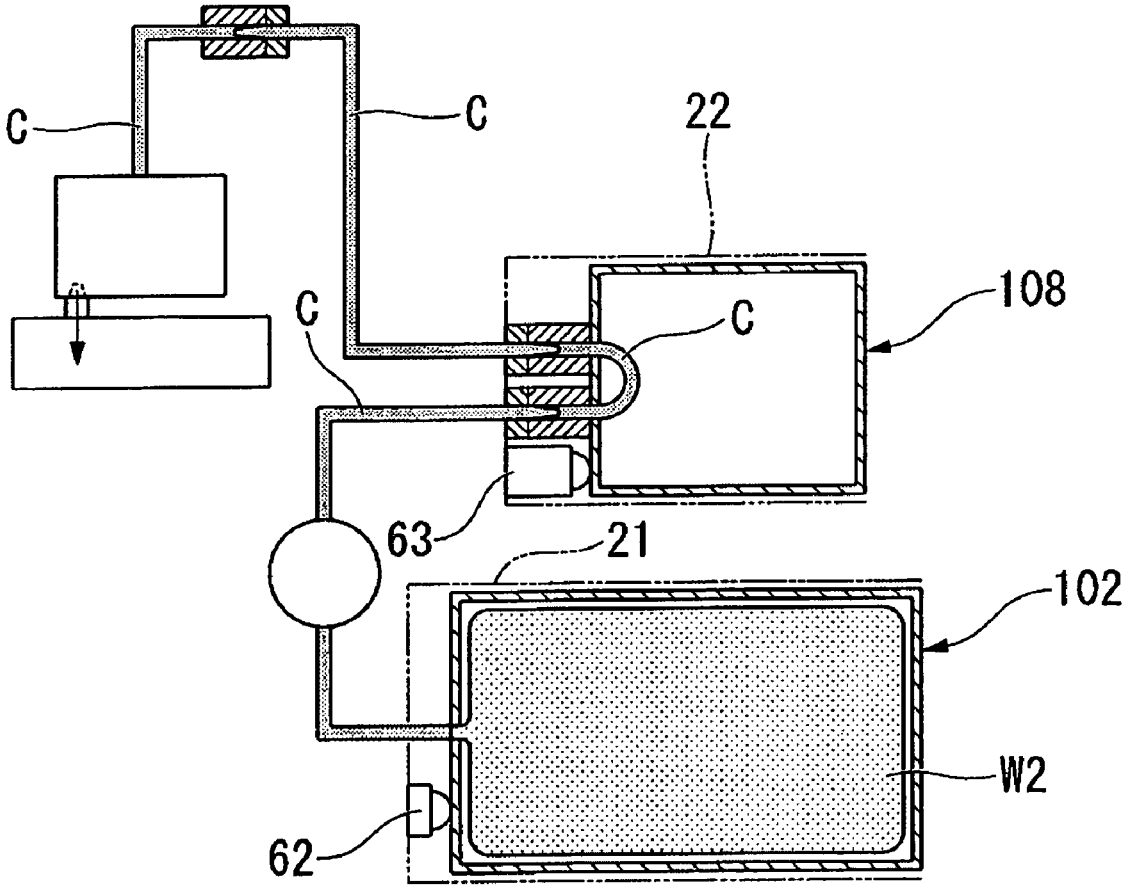
FIG. 29 is an explanatory diagram illustrating steps of the ink supplying method for the ink supplying system of the ink jet printer according to the first modification of the present invention.

Next, an ink supplying method in the ink supply system according to the first modification is described. FIG. 26 is a flowchart of the ink supplying method. FIGS. 27 to 29 are explanatory diagrams illustrating respective steps of the ink supplying method. Further, a part of the explanatory diagrams illustrating the respective steps is the same as the explanatory diagram in the third embodiment of the present invention, and hence the explanatory diagram in the third embodiment is also referred to.

As illustrated in FIG. 26, in the ink supplying method by the ink supplying system according to the first modification, a cleaning main tank connecting step (Step S27) and a cleaning step (Step S28) are inserted between the first ink main tank storing step (Step S22) and a first and second auxiliary connecting means replacing step (Step S23) of the ink supplying method by the ink supplying system according to the third embodiment of the present invention illustrated in FIG. 19.

Following the first ink main tank storing step (Step S22), in the cleaning main tank connecting step (Step S27) performed in the state illustrated in FIG. 21, the operator of the ink jet printer releases the connection between the one end 53*a* of the first pipe 53 and the first cartridge 101 and connects the one end 53*a* of the first pipe 53 and the cleaning cartridge 103. Then, the operator sends a signal representing the end of Step S27 to the ink control device 61*a* via the input and output panel 47 and shifts to Step S28 (see FIG. 27).

Next, in the cleaning step (Step S28), when the ink control device 61*a* detects that Step S27 ends, the ink control device 61*a* drives the suction pump 40*b*, fills the cleaning liquid C stored in the cleaning cartridge 103 into the first pipe 53, the connection pipe 107*b* of the first dummy sub-tank 107, the first divided pipe 55, the second divided pipe 56, and the ink jet head 58, sucks out the first ink W1, cleans an ink path, stops the suction pump 40*b*, and shifts to Step S23 (see FIG. 28).

In this way, the insides of the first pipe 53, the first divided pipe 55, the second divided pipe 56, and the ink jet head 58 are cleaned by the cleaning liquid C. Therefore, when the second ink W2 is filled later, the first ink W1 and the second ink W2 can be prevented from being mixed.

Next, when the first and second auxiliary connecting means replacing step (Step S23) and the first and second main tanks replacing step (Step S24) described in the third embodiment of the present invention are performed, the ink supplying system changes to a state illustrated in FIG. 29.

Steps after this are the same as the steps described in the third embodiment of the present invention. Therefore, description of the steps is omitted.

Second Modification

A second modification is described below.

For convenience of description, in the second modification, components same as those described in the embodiments of the present invention and the first modification are denoted by the same reference symbols and description of the components is omitted.

With the ink supplying system according to this modification, ink ejected from the ink jet head 58 can be replaced from the first ink W1 to the second ink W2 by a method described below.

An ink supplying system according to this modification is the same as the ink supplying system 111 according to the third embodiment illustrated in FIGS. 18A to 18E. Moreover, the first sub-tank 104, the second sub-tank 105, the first cartridge 101, the second cartridge 102, and the second dummy sub-tank 108 illustrated in FIGS. 18A to 18E are used.

Figure 30:
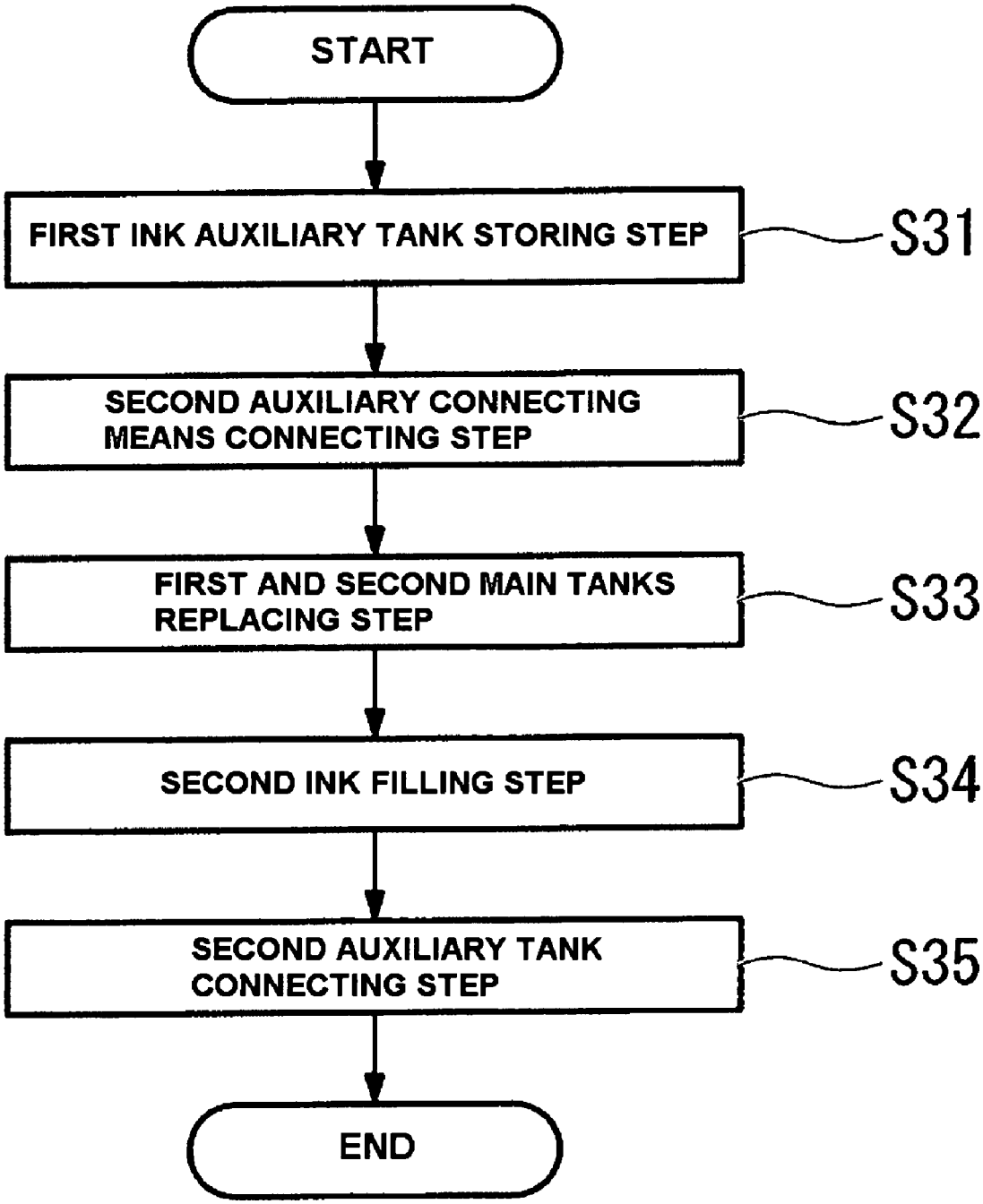
FIG. 30 is an explanatory diagram illustrating steps of the ink supplying method for the ink supplying system of the ink jet printer according to the first modification of the present invention.

Next, an ink supplying method in the ink supply system according to the second modification is described. FIG. 30 is a flowchart of the ink supplying method. FIGS. 31 to 34 are explanatory diagrams illustrating respective steps of the ink supplying method.

In replacing the ink from the first ink W1 to the second ink W2, as illustrated in FIGS. 18A to 18E, each of the joint member 90 provided at the another end 53*b* of the first pipe 53 and the joint member 90 provided at the one end 55*a* of the first divided pipe 55 and the two valve unit main bodies 80 provided in the first sub-tank 104 are connected. Further, the first cartridge 101 is connected to the one end 53*a* of the first pipe 53. The joint member 90 provided at the another end 55*b* of the first divided pipe 55 and the valve unit main body 80 provided at the one end 56*a* of the second divided pipe 56 are connected. Further, the first pipe 53, the first divided pipe 55, the second divided pipe 56, and the ink jet head 58 are filled with the first ink W1.

When the ink control device 61*a* of the ink-supply control unit 61 receives a command from the CPU 46*a* of the main control unit 46 replace the ink, first, in a first ink auxiliary tank storing step (Step S31), the ink control device 61*a* sets the supply pump 60 in an opened state.

Figure 31:
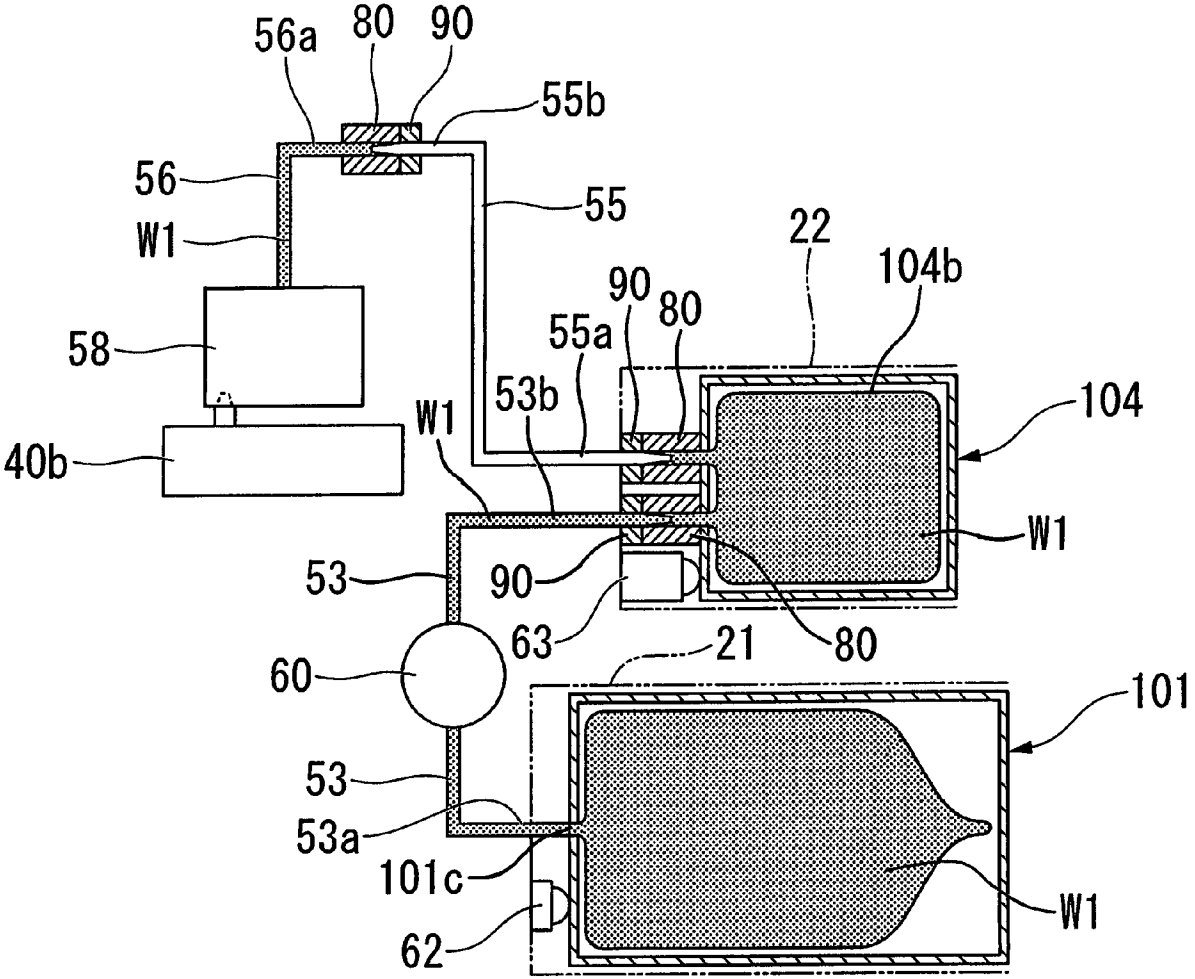
FIG. 31 is an explanatory diagram illustrating steps of the ink supplying method for the ink supplying system of the ink jet printer according to the second modification of the present invention.
Figure 32:
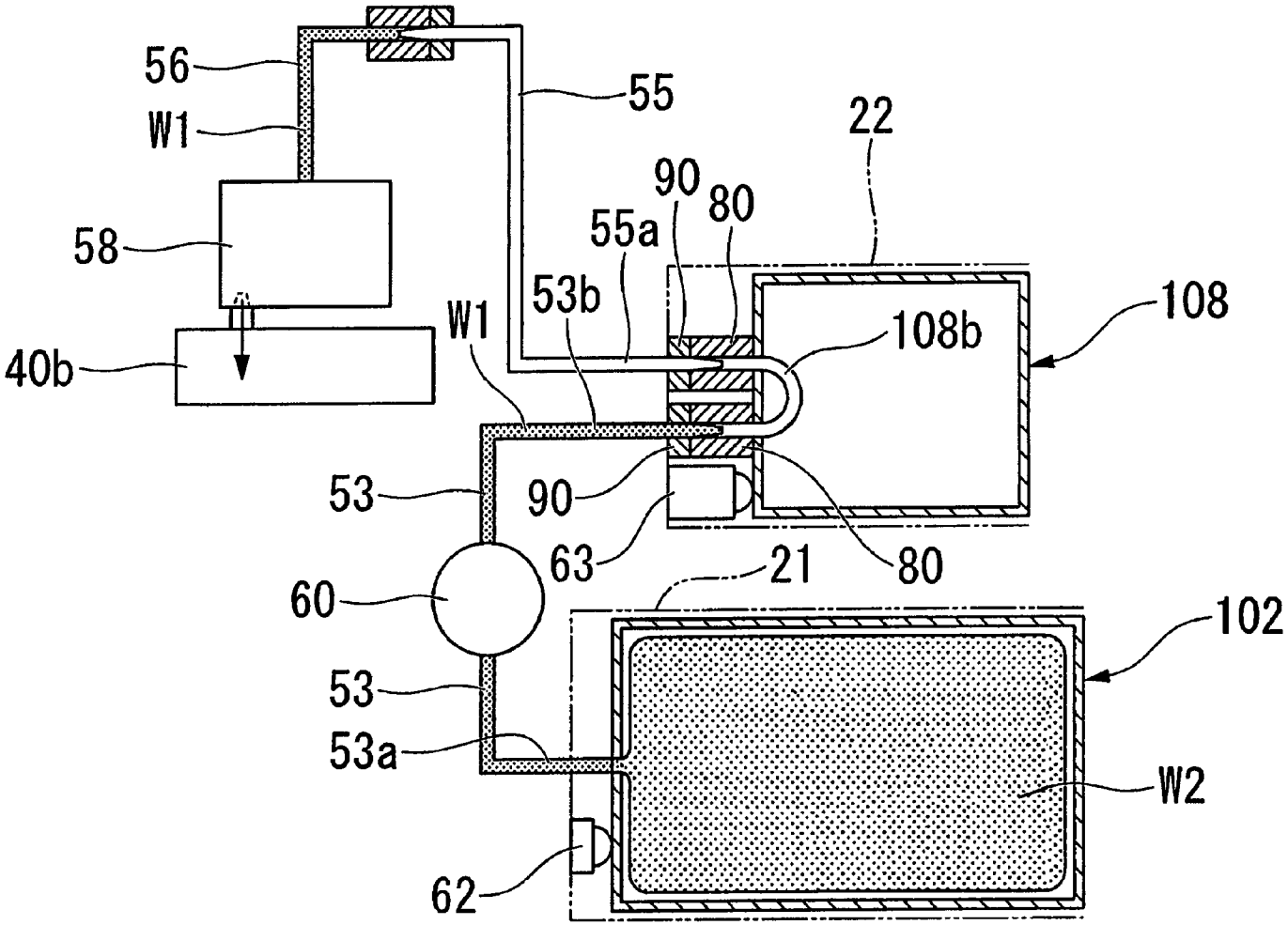
FIG. 32 is an explanatory diagram illustrating steps of the ink supplying method for the ink supplying system of the ink jet printer according to the second modification of the present invention.

Next, the operator of the ink jet printer temporarily releases the connection between the joint member 90 provided at the another end 55*b* of the first divided pipe 55 and the valve unit main body 80 provided at the one end 56*a* of the first divided pipe 56, leads the air into the first divided pipe 55 from the joint member 90, and shifts to Step S32 (see FIG. 31).

Then, at least a part of the first ink W1 in the first divided pipe 55 is stored in the sub-tank bag 104*b* of the first sub-tank 104. Therefore, an amount of ink to be discarded during ink replacement can be controlled.

Next, in a second auxiliary connecting means connecting step (Step S32), the operator releases the connection between each of the joint member 90 provided at the another end 53*b* of the first pipe 53 and the joint member 90 provided at the one end 55*a* of the first divided pipe 55 and the two valve unit main bodies 80 provided to the first sub-tank 104. Then, the operator connects the two joint members 90 and the two valve unit main bodies 80 provided to the second dummy sub-tank 108.

Moreover, in a first and second main tanks replacing step (Step S33), the operator releases the connection between the one end 53*a* of the first pipe 53 and the first cartridge 101, and connects the one end 53*a* of the first pipe 53 and the second cartridge 102 (see FIG. 22). The operator sends a signal representing the end of Step S33 to the ink control device 61*a* via the input and output panel 47 and shifts to Step S34 (See FIG. 32).

Figure 33:
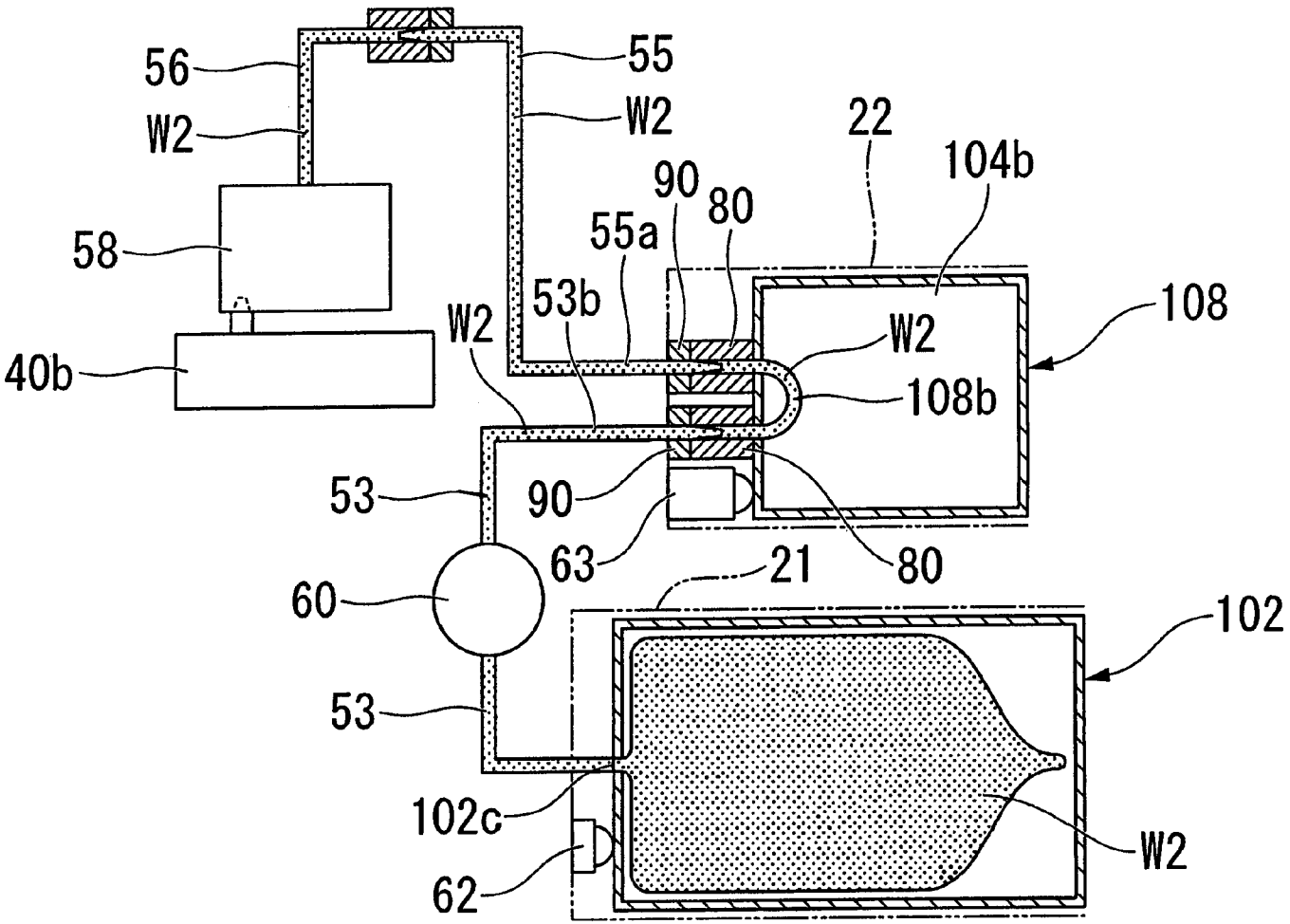
FIG. 33 is an explanatory diagram illustrating steps of the ink supplying method for the ink supplying system of the ink jet printer according to the second modification of the present invention.
Figure 34:
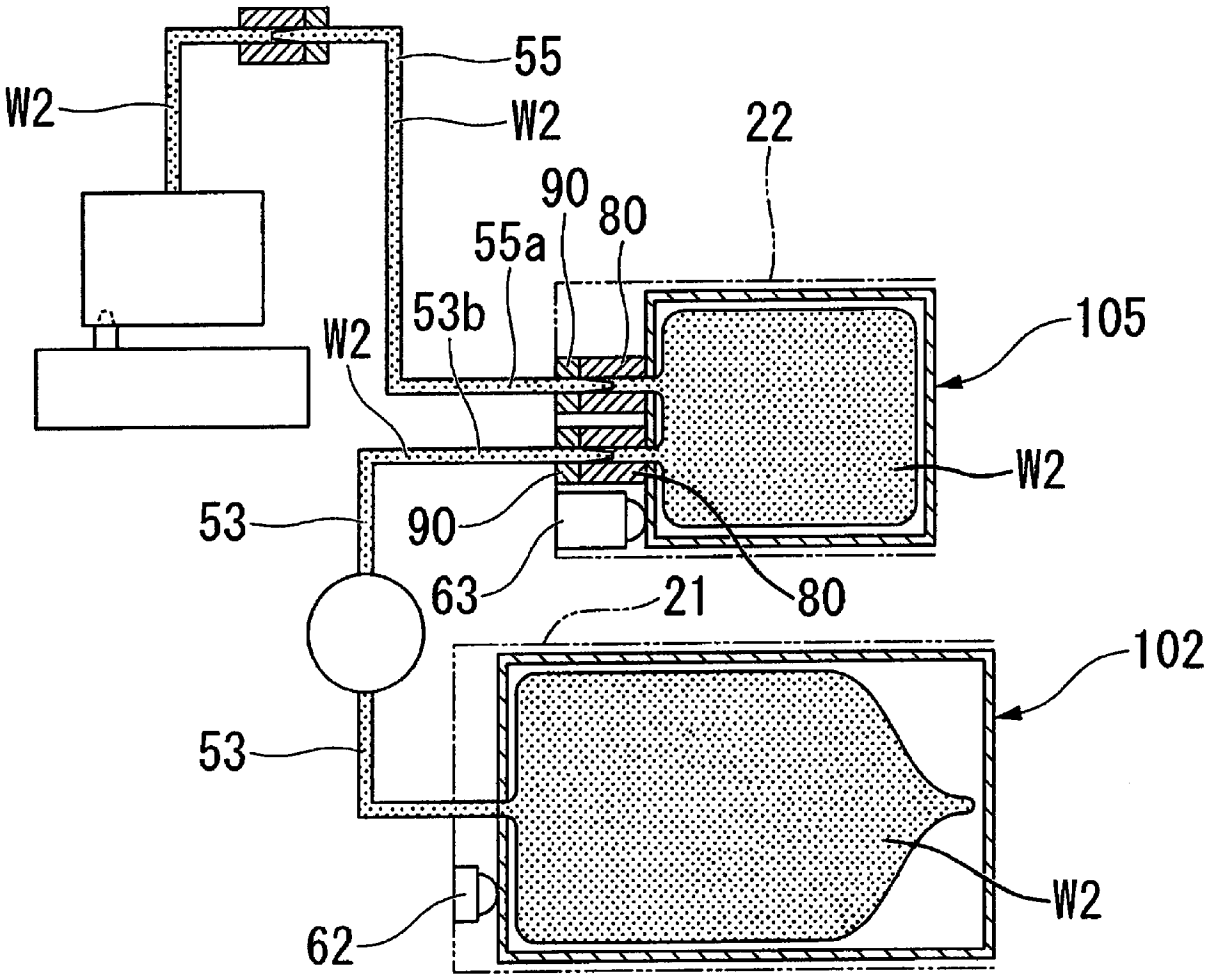
FIG. 34 is an explanatory diagram illustrating steps of the ink supplying method for the ink supplying system of the ink jet printer according to the second modification of the present invention.

Next, in a second ink filling step (Step S34), when the ink control device 61*a* detects that Step S33 ends, the ink control device 61*a* drives the suction pump 40*b*, fills the second ink W2 stored in the second cartridge 102 into the first pipe 53, the connection pipe 108*b* of the second dummy sub-tank 108, the first divided pipe 55, the second divided pipe 56, and the ink jet head 58, stops the suction pump 40*b* when the filling is completed, and shifts to Step S35 (see FIG. 33).

Finally, in a second auxiliary tank connecting step (Step S35), the operator releases the connection between each of the joint member 90 provided at the another end 53*b* of the first pipe 53 and the joint member 90 provided at the one end 55*a* of the first divided pipe 55 and the two valve unit main bodies 80 provided to the second dummy sub-tank 108. Then, the operator connects the two joint members 90 and the two valve unit main bodies 80 provided to the second sub-tank 105 (see FIG. 34).

In this way, with the ink jet printer according to the second modification, the air is prevented from flowing into the ink when the ink is shifted. Therefore, the removing of the bubbles contained in the ink, which was conventionally performed by the on-off valve provided to the tube provided in the auxiliary tank is unnecessary. Therefore, ink replacement can be easily performed.

Third Modification

A third modification is described below.

For convenience of description, in the third modification, components same as those described in the embodiments of the present invention and other modifications are denoted by the same reference symbols and description of the components is omitted.

An ink supplying system according to this modification is the same as the ink supplying system 111 according to the third embodiment illustrated in FIGS. 18A to 18E. Moreover, the first sub-tank 104, the second sub-tank 105, the first cartridge 101, the second cartridge 102, and the second dummy sub-tank 108 illustrated in FIGS. 18A to 18E and a cleaning cartridge 103 illustrated in FIG. 25 are used.

With the ink supplying system according to this modification, ink ejected from the ink jet head 58 can be replaced, while being cleaned, from the first ink W1 to the second ink W2 by a method described below.

Figure 35:
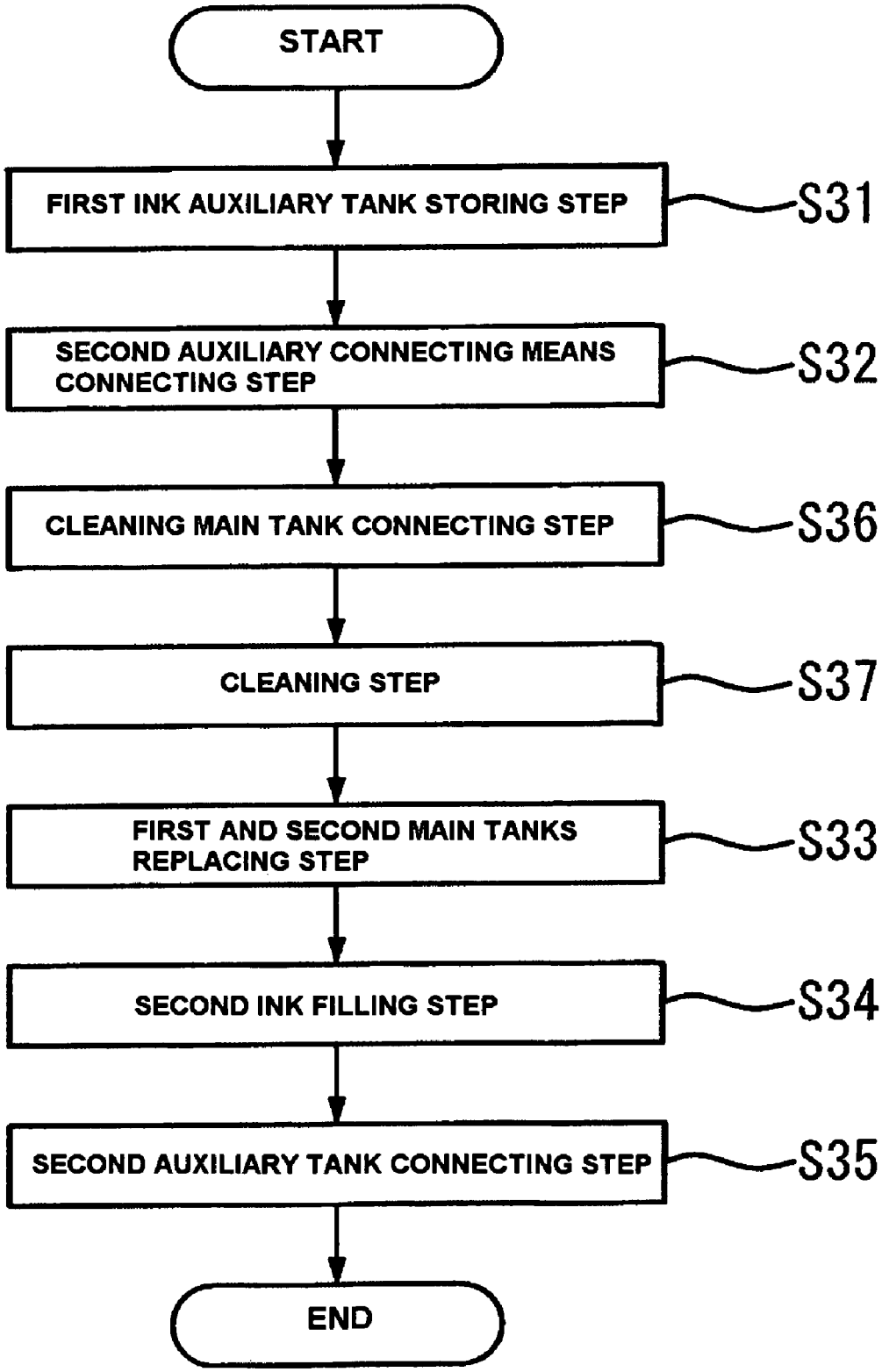
FIG. 35 is a flowchart of an ink supplying method for the ink supplying system of the ink jet printer according to the third modification of the present invention.
Figure 36:
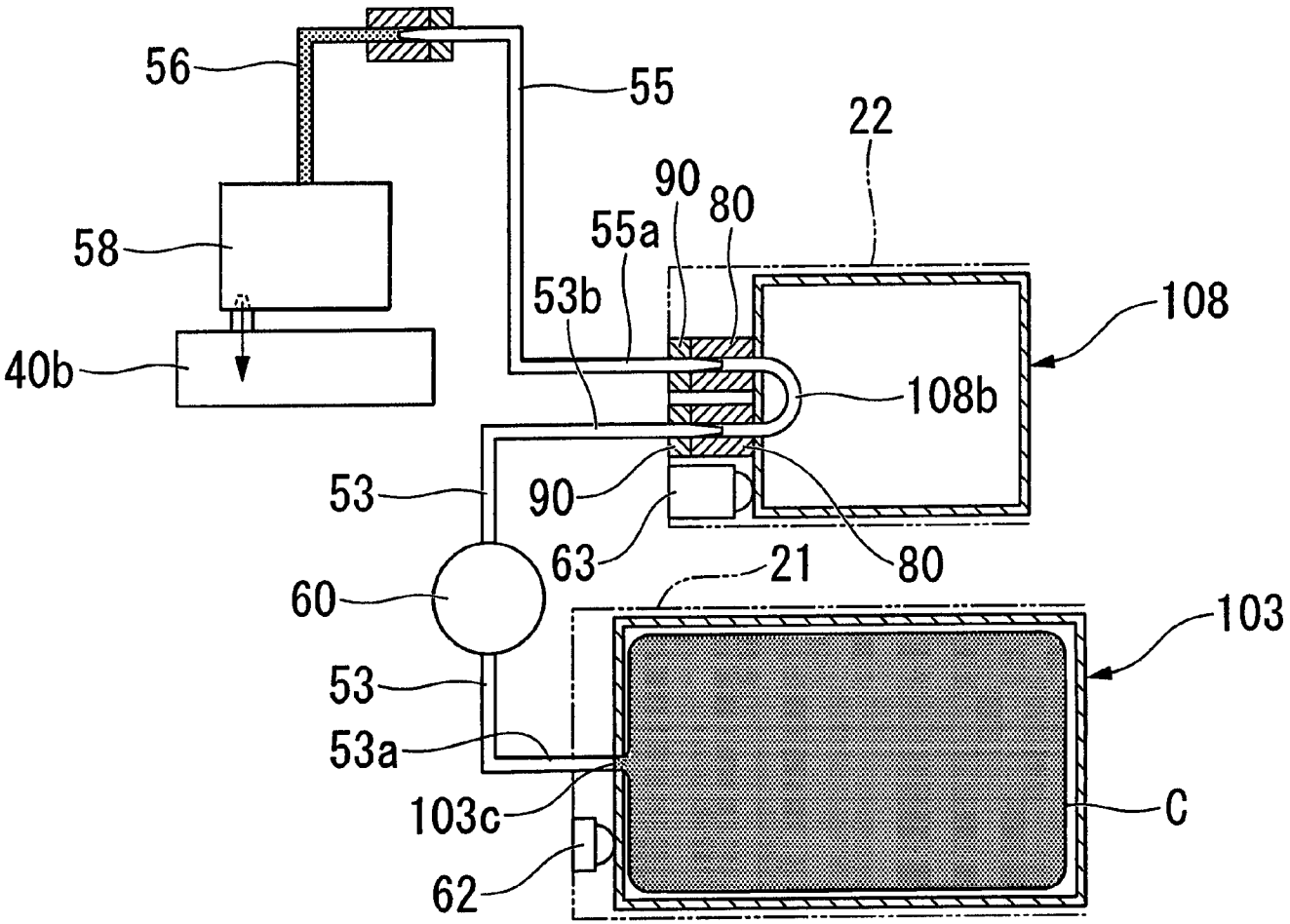
FIG. 36 is an explanatory diagram illustrating steps of the ink supplying method for the ink supplying system of the ink jet printer according to the third modification of the present invention.
Figure 37:
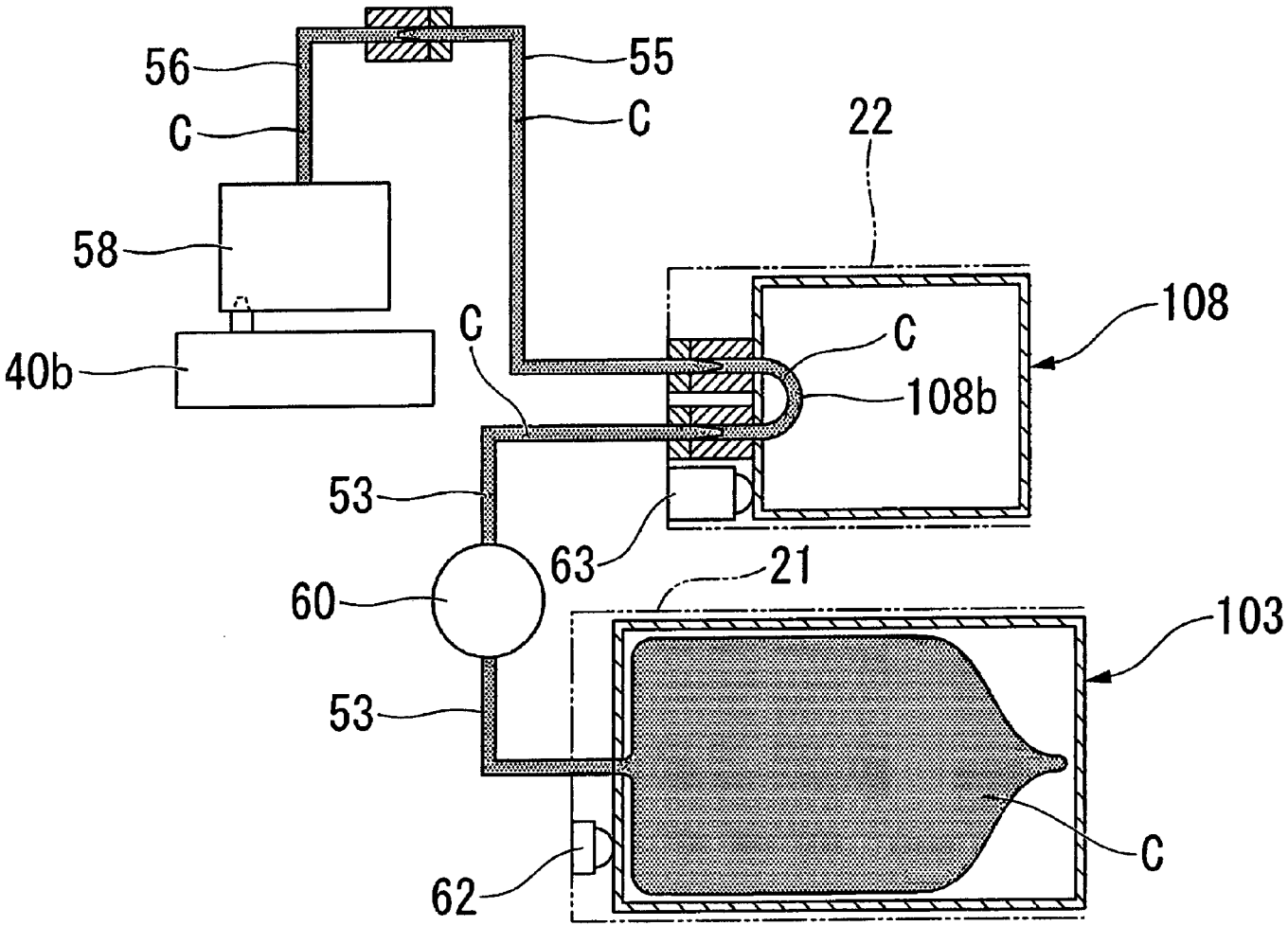
FIG. 37 is an explanatory diagram illustrating steps of the ink supplying method for the ink supplying system of the ink jet printer according to the third modification of the present invention.

Next, an ink supplying method in the ink supply system according to the third modification is described. FIG. 35 is a flowchart of the ink supplying method. FIGS. 36 to 37 are explanatory diagrams illustrating respective steps of the ink supplying method. Further, a part of the explanatory diagrams illustrating the respective steps is the same as the explanatory diagram in the second embodiment of the present invention, and hence the explanatory diagram in the second embodiment is also referred to.

As illustrated in FIG. 35, in the ink supplying method by the ink supplying system according to the third modification, a cleaning main tank connecting step (Step S32) and a cleaning step (Step S33) are inserted between the second auxiliary connecting means connecting step (Step S32) and a first and second main tanks replacing step (Step S33) of the ink supplying method by the ink supplying system according to the second modification illustrated in FIG. 30.

In the state illustrated in FIG. 31, the second auxiliary connecting means connecting step (Step S32) described in the second modification is performed and, subsequently, the cleaning main tank connecting step (Step S36) is performed. In the cleaning main tank connecting step, the operator of the ink jet printer releases the connection between the one end 53*a* of the first pipe 53 and the first cartridge 101 and connects the one end 53*a* of the first pipe 53 and the cleaning cartridge 103. Then, the operator sends a signal representing the end of Step S36 to the ink control device 61*a* via the input and output panel 47 and shifts to Step S37 (see FIG. 36).

Next, in the cleaning step (Step S37), when the ink control device 61*a* detects that Step S36 ends, the ink control device 61*a* drives the suction pump 40*b*, fills the cleaning liquid C stored in the cleaning cartridge 103 into the first pipe 53, the connection pipe 108*b* of the first dummy sub-tank 108, the first divided pipe 55, the second divided pipe 56, and the ink jet head 58, stops the suction pump 40*b*, and shifts to Step S33 (see FIG. 37).

In this way, the insides of the first pipe 53, the first divided pipe 55, the second divided pipe 56, and the ink jet head 58 are cleaned by the cleaning liquid C. Therefore, when the second ink W2 is filled later, the first ink W1 and the second ink W2 can be prevented from being mixed.

Steps after this are the same as the first and second main tanks replacing step (Step S33) described in the second modification and subsequent steps. Therefore, description of the steps is omitted.

What is claimed is:

1. An ink supplying system for an ink jet printer, comprising:

a main ink tank configured to store ink that contains no air;

a primary auxiliary ink tank configured to receive ink from the main ink tank;

a first pipe having one end configured for removable connection to the main ink tank and another end configured for removable connection to the primary auxiliary ink tank;

a second pipe having one end configured for removable connection to the primary auxiliary ink tank;

an ink jet head that connects to another end of the second pipe and that is configured to perform printing on a printing medium by ejecting ink supplied from the main ink tank via the primary auxiliary ink tank;

a secondary auxiliary ink tank having a capacity smaller than that of the primary auxiliary ink tank and being selectively exchangeable with the primary auxiliary ink tank for removing air in the ink supplying system, the secondary auxiliary ink tank having a connection pipe configured for removable connection to the another end of the first pipe and to the one end of the second pipe in fluid communication therewith, the connection pipe having the same sectional area as that of the first and second pipes; and a detachable unit via which the another end of the first pipe and the one end of the second pipe are selectively removably connected to and disconnected from the first auxiliary ink tank and the second auxiliary ink tank without allowing air to flow into the first and second auxiliary ink tanks.

2. An ink supplying system for an ink jet printer according to claim 1; further comprising means associated with each of the first and second auxiliary ink tanks for selective removable connection to and disconnection from the detachable unit to prevent air from flowing into the first and second auxiliary ink tanks.

3. An ink supplying system according to claim 2;

wherein the detachable unit comprises a pair of joint members provided to the another end of the first pipe and the one end of the second pipe, respectively; and wherein the means associated with each of the first and second auxiliary ink tanks comprises a pair of valve main bodies configured for removable connection to the respective joint members of the pair of joint members.

4. An ink supplying system according to claim 3;

further comprising means defining a sealed state between connected pairs of the joint members and valve main bodies for preventing the flow of air into the first and second auxiliary ink tanks.

5. An ink supplying system for an ink jet printer according to claim 1; wherein the primary auxiliary ink tank is previously filled with the ink with the air therein being removed.

6. An ink jet printer, comprising:

an ink supplying system for an ink jet printer according to claim 1; and a suction pump that sucks the ink from the ink jet head side.

7. An ink supplying system according to claim 1;

wherein the connection pipe of the secondary auxiliary ink tank is configured for removable direct connection to the another end of the first pipe and to the one end of the second pipe in fluid communication therewith.

8. An ink supplying system for an ink jet printer, the ink supplying system comprising:

a first pipe having one end configured for removable connection to a main ink tank storing ink containing no air and having another end configured for removable connection to a primary auxiliary ink tank that receives ink from the main ink tank;

a second pipe having one end configured for removable connection to the primary auxiliary ink tank;

an ink jet head connected to another end of the second pipe and that performs a printing operation by ejecting on a printing medium ink supplied from the main ink tank via the primary auxiliary ink tank;

a secondary auxiliary ink tank having a capacity smaller than that of the primary auxiliary ink tank and being selectively exchangeable with the primary auxiliary ink tank for removing air in the ink supplying system prior to printing by the ink jet head, the secondary auxiliary ink tank having a connection pipe configured for removable connection to the another end of the first pipe and to the one end of the second pipe in fluid communication therewith, the connection pipe having the same sectional area as that of the first and second pipes; and a detachable unit via which the another end of the first pipe and the one end of the second pipe is selectively removably connected to and disconnected from the first auxiliary ink tank and the second auxiliary ink tank without allowing air to flow into the first and second auxiliary ink tanks.

9. An ink supplying system according to claim 8; wherein the detachable unit comprises a pair of joint members provided to the another end of the first pipe and the one end of the second pipe, respectively; and wherein the means associated with each of the first and second auxiliary ink tanks comprises a pair of valve main bodies configured for removable connection to the respective joint members of the pair of joint members.

10. An ink supplying system according to claim 9; further comprising means defining a sealed state between connected pairs of the joint members and valve main bodies for preventing the flow of air into the first and second auxiliary ink tanks.

11. An ink supplying system according to claim 8; wherein the connection pipe of the secondary auxiliary ink tank is configured for removable direct connection to the another end of the first pipe and to the one end of the second pipe in fluid communication therewith.

12. An ink jet printer comprising:

an ink supplying system according to claim 8;

a first attaching unit via which the one end of the first pipe is connected to the main ink tank; and a second attaching unit via which the another end of the first pipe and the one end of the second pipe are removably connected to the connection pipe of the secondary auxiliary ink tank for removing air in the ink supplying system prior to printing by the ink jet head and, after disconnection of the secondary auxiliary tank, are removably connected to first auxiliary ink tank for supplying ink to the ink jet head during a printing operation.

13. An ink jet printer according to claim 12; further comprising first detecting means for detecting that the main ink tank is connected to the one end of the first pipe via the first attaching unit; and second detecting means for detecting that the first auxiliary ink tank or the second auxiliary ink tank is connected to the another end of the first pipe and the one end of the second pipe via the second attaching unit.

14. An ink jet printer comprising a plurality of the ink supplying systems according to claim 8.

15. An ink supplying method for supplying ink to an ink jet printer, the ink supplying method comprising:

providing an ink supplying system comprising:

a main ink tank storing ink that contains no air;

a primary auxiliary ink tank configured to receive ink stored in the main ink tank;

a first pipe having one end configured for removable connection to the main ink tank and another end configured for removable connection to the primary auxiliary ink tank;

a second pipe having one end configured for removable connection to the primary auxiliary ink tank;

an ink jet head that connects to another end of the second pipe and that is configured to perform printing on a printing medium by ejecting ink supplied from the main ink tank via the primary auxiliary ink tank;

a secondary auxiliary ink tank having a capacity smaller than that of the primary auxiliary ink tank and being selectively exchangeable with the primary auxiliary ink tank for removing air in the ink supplying system, the secondary auxiliary ink tank having a connection pipe configured for removable connection to the another end of the first pipe and to the one end of the second pipe in fluid communication therewith, the connection pipe having the same sectional area as that of the first and second pipes; and a detachable unit via which the another end of the first pipe and the one end of the second pipe is selectively removably connected to and disconnected from the first auxiliary ink tank and the second auxiliary ink tank without allowing air to flow into the first and second auxiliary ink tanks;

connecting the secondary auxiliary ink tank to each of the another end of the first pipe and the one end of the second pipe and connecting the main ink tank to the one end of the first pipe;

filling the ink stored in the main ink tank into the first pipe, the secondary auxiliary ink tank, the second pipe, and the ink jet head;

releasing the connection each of the another end of the first pipe and the one end of the second pipe from the secondary auxiliary ink tank, and connecting the primary auxiliary ink tank to each of the another end of the first pipe and the one end of the second pipe; and filling the primary auxiliary ink tank with the ink stored in the main tank.

16. An ink supplying method for supplying ink to an ink jet printer, the ink supplying method comprising:

providing an ink supplying system comprising:

a main ink tank storing ink that contains no air;

a primary auxiliary ink tank containing ink that contains no air;

a first pipe having one end configured for removable connection to the main ink tank and another end configured for removable connection to the primary auxiliary ink tank;

a second pipe having one end configured for removable connection to the primary auxiliary ink tank;

an ink let head that connects to another end of the second pipe and that is configured to perform printing on a printing medium by ejecting ink supplied from the main ink tank via the primary auxiliary ink tank;

a secondary auxiliary ink tank having a capacity smaller than that of the primary auxiliary ink tank and being selectively exchangeable with the primary auxiliary ink tank for removing air in the ink supplying system, the secondary auxiliary ink tank having a connection pipe configured for removable connection to the another end of the first pipe and to the one end of the second pipe in fluid communication therewith, the connection pipe having the same sectional area as that of the first and second pipes; and a detachable unit via which the another end of the first pipe and the one end of the second pipe is selectively removably connected to and disconnected from the first auxiliary ink tank and the second auxiliary ink tank without allowing air to flow into the first and second auxiliary ink tanks;

connecting the secondary auxiliary ink tank to each of the another end of the first pipe and the one end of the second pipe and connecting the main tank to the one end of the first pipe;

filling the ink stored in the main tank into the first pipe, the secondary auxiliary ink tank, the second pipe, and the ink jet head; and releasing connection of each of the another end of the first pipe and the one end of the second pipe from the secondary auxiliary ink tank and connecting the primary auxiliary ink tank filled with the ink and from which the air therein has been removed to the another end of the first pipe and the one end of the second pipe.

17. An ink supplying method for an ink jet printer comprising:

providing a first pipe having one end connected to a first main tank in which first ink is stored and that contains no air;

providing a second pipe having one end connected to a first auxiliary tank filled with the first ink that contains no air and connected to another end of the first pipe;

providing an air lead-in valve that is provided in the second pipe and switches lead-in and blocking of the air into the second pipe;

providing an ink jet head that is connected to the another end of the second pipe and is configured to eject the first ink to perform printing on a printing medium;

a first auxiliary connecting means connecting step of releasing connection of each of the another end of the first pipe and the one end of the second pipe from the first auxiliary tank, and connecting the first and second pipes to a first auxiliary connecting means having a first connection pipe by connecting one end part of the first connection pipe with the another end of the first pipe and another end part of the first connection pipe with the one end of the second pipe;

a first ink main tank storing step of leading the air into at least the second pipe from the air lead-in valve;

a first and second auxiliary connecting means replacing step of releasing connection of each of the another end of the first pipe and the one end of the second pipe from the first auxiliary connecting means, and connecting the another end of the first pipe and the one end of the second pipe to a second auxiliary connecting means having a second connection pipe by connecting one end part of the second connection pipe with the another end of the first pipe and another end part of the second connection pipe with the one end of the second pipe;

a first and second main tanks replacing step of releasing connection between the one end of the first pipe and the first main tank, and connecting the one end of the first pipe to a second main tank in which second ink is stored with air therein being removed;

a second ink filling step of filling the second ink stored in the second main tank into the first pipe, the second connection pipe of the second auxiliary connecting means, the second pipe, and the ink jet head; and a second auxiliary tank connecting step of releasing connection each of the another end of the first pipe and the one end of the second pipe from the second auxiliary connecting means without allowing the air to flow into the first pipe, the second pipe, and the second auxiliary connecting means, and connecting the another end of the first pipe and the one end of the second pipe to a second auxiliary tank, which is filled with the second ink with air therein being removed, without allowing the air to flow into the first pipe, the second pipe, and the second auxiliary tank.

* * * * *